US007246875B2

(12) United States Patent
Berry et al.

(10) Patent No.: US 7,246,875 B2
(45) Date of Patent: Jul. 24, 2007

(54) PROTECTOR FOR A PRINTHEAD CAPPING FACILITY

(75) Inventors: Norman Michael Berry, Balmain (AU); Akira Nakazawa, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 316 days.

(21) Appl. No.: 11/003,619

(22) Filed: Dec. 6, 2004

(65) Prior Publication Data

US 2006/0119656 A1 Jun. 8, 2006

(51) Int. Cl.
*B41J 2/165* (2006.01)

(52) U.S. Cl. ..... 347/29; 347/30; 347/32

(58) Field of Classification Search ..... 347/22, 347/29, 30

See application file for complete search history.

(56) References Cited

U.S. PATENT DOCUMENTS 5,619,232 A 4/1997 Maeno
5,627,573 A 5/1997 Fahy
5,663,751 A * 9/1997 Holbrook ..... 347/22
6,398,338 B1 6/2002 Berg et al.
6,533,386 B1 3/2003 Sawicki et al.

FOREIGN PATENT DOCUMENTS

WO WO 01/089848 A1 11/2001

* cited by examiner

*Primary Examiner*—Shih-Wen Hsieh

(57) ABSTRACT

A protector is provided for a capping facility for a printhead. The protector comprises a covering member which is arranged to engage with the capping facility during intervals when the capping facility is not engaged with the printhead, whereby the capping facility is protected against loss of moisture and/or ingress of contaminating material. In one of its possible forms, the protector is provided for a capping facility in the form of a capping mechanism for a printhead having a plurality of ink-delivery nozzles. In this embodiment a) the capping mechanism comprises a capping member that is configured to contact the printhead in nozzle capping engagement, a carrier supporting the capping member, and an actuating mechanism arranged to effect movement of the carrier back and forth between a first position at which the capping member is located remotely with respect to the printhead and a second position at which the capping member is located in contact with the printhead, and b) the protector comprises a covering member which is arranged to be engaged by the capping member when the capping member is located in the first position.

19 Claims, 29 Drawing Sheets

PROTECTOR FOR A PRINTHEAD CAPPING FACILITY

FIELD OF THE INVENTION

This invention relates in general terms to Inkjet printers and more particularly to capping the nozzles in inkjet printheads. The invention has been developed primarily in relation to a pagewidth printhead and the invention is herein described largely in that context. However, it will be understood that the invention does have broader application, including reciprocating type printheads.

CO-PENDING APPLICATIONS

The following applications have been filed by the Applicant simultaneously with the present application:

| | | | | | |
|---|---|---|---|---|---|
| 11/003786 | 11/003616 | 11/003418 | 11/003334 | 11/003600 | 11/003404 |
| 11/003419 | 11/003700 | 11/003601 | 11/003618 | 11/003615 | 11/003337 |
| 11/003698 | 11/003420 | 6984017 | 11/003699 | 11/003463 | 11/003701 |
| 11/003683 | 11/003614 | 11/003702 | 11/003684 | 11/003617 | |

The disclosures of these co-pending applications are incorporated herein by reference.

CROSS REFERENCES TO RELATED APPLICATIONS

The following patents or patent applications filed by the applicant or assignee of the present invention are hereby incorporated by cross-reference.

| | | | | | |
|---|---|---|---|---|---|
| 6623101 | 6406129 | 6505916 | 6457809 | 6550895 | 6457812 |
| 7152962 | 6428133 | 10/815625 | 10/815624 | 10/815628 | 10/913375 |
| 10/913373 | 10/913374 | 10/913372 | 7138391 | 7153956 | 10/913380 |
| 10/913379 | 10/913376 | 7122076 | 7148345 | 10/407212 | 10/407207 |
| 10/683064 | 10/683041 | 6746105 | 7156508 | 7159972 | 7083271 |
| 7165834 | 7080894 | 10/760218 | 7090336 | 7156489 | 10/760233 |
| 10/760246 | 7083257 | 10/760243 | 10/760201 | 10/760185 | 10/760253 |
| 10/760255 | 10/760209 | 7118192 | 10/760194 | 10/760238 | 7077505 |
| 10/760235 | 7077504 | 10/760189 | 10/760262 | 10/760232 | 10/760231 |
| 7152959 | 10/760190 | 10/760191 | 10/760227 | 7108353 | 7104629 |
| 10/728804 | 7128400 | 7108355 | 6991322 | 10/728790 | 7118197 |
| 10/728970 | 10/728784 | 10/728783 | 7077493 | 6962402 | 10/728803 |
| 7147308 | 10/728779 | 7118198 | 7168790 | 7172270 | 10/773199 |
| 6830318 | 10/773201 | 10/773191 | 10/773183 | 7108356 | 7118202 |
| 10/773199 | 7134744 | 10/773185 | 7134743 | 10/773197 | 10/773203 |
| 10/773199 | 7134745 | 7156484 | 7118201 | 7111926 | 10/773184 |
| 09/575197 | 7079712 | 09/575123 | 6825945 | 09/575165 | 6813039 |
| 6987506 | 7038797 | 6980318 | 6816274 | 7102772 | 09/575186 |
| 6681045 | 6728000 | 7173722 | 7088459 | 09/575181 | 7068382 |
| 7062651 | 6789194 | 6789191 | 6644642 | 6502614 | 6622999 |
| 6669385 | 6549935 | 6987573 | 6727996 | 6591884 | 6439706 |
| 6760119 | 09/575198 | 6290349 | 6428155 | 6785016 | 6870966 |
| 6822639 | 6737591 | 7055739 | 09/575129 | 6830196 | 6832717 |
| 6957768 | 7170499 | 7106888 | 7123239 | 10/727181 | 10/727162 |
| 10/727163 | 10/727245 | 7121639 | 7165824 | 7152942 | 10/727157 |
| 10/727178 | 7096137 | 10/727257 | 10/727238 | 10/727251 | 10/727159 |
| 10/727180 | 10/727179 | 10/727192 | 10/727274 | 10/727164 | 10/727161 |
| 10/727198 | 10/727158 | 10/754536 | 10/754938 | 10/727227 | 10/727160 |
| 10/934720 | 10/296522 | 6795215 | 7070098 | 7154638 | 6805419 |
| 6859289 | 6977751 | 6398332 | 6394573 | 6622923 | 6747760 |
| 6921144 | 10/884881 | 7092112 | 10/949294 | 10/854521 | 10/854522 |
| 10/854488 | 10/854487 | 10/854503 | 10/854504 | 10/854509 | 10/854510 |
| 7093989 | 10/854497 | 10/854495 | 10/854498 | 10/854511 | 10/854512 |
| 10/854525 | 10/854526 | 10/854516 | 10/854508 | 10/854507 | 10/854515 |
| 10/854506 | 10/854505 | 10/854493 | 10/854494 | 10/854489 | 10/854490 |
| 10/854492 | 10/854491 | 10/854528 | 10/854523 | 10/854527 | 10/854524 |

-continued

| | | | | | |
|---|---|---|---|---|---|
| 10/854520 | 10/854514 | 10/854519 | 10/854513 | 10/854499 | 10/854501 |
| 10/854500 | 10/854502 | 10/854518 | 10/854517 | 10/934628 | |

Definitions

The expression "pagewidth printhead" is applicable to a printhead that has a length which extends across substantially the full width of (paper, card, textile or other) media to be printed and which, whilst remaining in a stationary position, is controlled to deposit printing ink across the full print width of advancing print media.

The expression "reciprocating printhead" is applicable to a printhead of the type that normally is integrated with an ink cartridge, which is carried by a reciprocating carriage and which is controlled to deposit printing ink whilst scanning across (momentarily) stationary print media.

The expression "capping facility" is applicable to a capping mechanism of a type used for capping and, if required, purging ink-delivery nozzles in a pagewidth printhead and to a service station of a type used in the capping and purging of ink-delivery nozzles in a reciprocating printhead.

BACKGROUND OF THE INVENTION

The printheads of Inkjet printers have a series of nozzles from which individual ink droplets are ejected to deposit on print media to form desired printed images. The nozzles are incorporated in various types of printheads and their proper functioning is critical to the creation of quality images. Thus, any partial or total blockage of even a single nozzle may have a significant impact on a printed image, particularly in the case of a pagewidth printer.

The nozzles are prone to blockage due to their exposure to ever-present paper dust and other particulate matter and due to the tendency of ink to dry in the nozzles during, often very short, idle periods. That is, ink which is awaiting delivery from a nozzle forms a meniscus at the nozzle mouth and, when exposed to (frequently warm, dry) air, the ink solvent is evaporated to leave a nozzle blocking deposit.

Servicing systems are conventionally employed for maintaining the functionality of printheads, such systems providing one or more of the functions of capping, purging and wiping. Capping involves the covering of idle nozzles to preclude exposure of ink to drying air. Purging is normally effected by sucking deposits from the printhead that block or have the potential to block the nozzles. Wiping is performed in conjunction with the capping and/or purging functions and involves gently sweeping a membrane across the face of the printhead.

The majority of conventional inkjet printers, particularly so-called desk top printers, employ reciprocating printheads which, as above mentioned, are driven to traverse across the width of momentarily stationary print media. In these printers, service stations are provided at one side of the printing zone and, on command, the printhead is traversed to the service station where it is docked for such time as servicing is performed and/or the printer is idle. However, inclusion of the service stations increases the total width of the printers and this is recognised as a problem in the context of trends to minimise the size of desk-top printers.

Moreover, the above described servicing system cannot feasibly be employed in relation to pagewidth printers which, as above mentioned, have a stationary printhead that extends across the full width of the printing zone. The printhead has a length that effectively defines the printing zone and it cannot be moved outside of that zone for servicing. Furthermore, a pagewidth printhead has a significantly larger surface area and contains a vastly greater number of nozzles than a reciprocating printhead, especially in the case of a large format printer, all of which dictate an entirely different servicing approach from that which has conventionally been adopted.

Also, in the case of a pagewidth printer it is most desirable that the printhead be not moved relative to its supporting structure, and this gives rise to the following requirements:

1. The servicing system must be moved to the printhead to effect a servicing operation.

2. The servicing system must be moved away from the region of the printhead during a printing operation, to permit passage of print media.

3. The servicing system should desirably be moved into servicing engagement with the printhead in a manner that minimises the risk of damage being done to the printhead nozzles.

Furthermore, capping facilities, whether of the capping mechanism type or the service station type, should advantageously be protected against loss of contained moisture and ingress of contaminating material. That is, it has been recognised that contained moisture should be maintained in the capping facility between capping operations, so as to minimise the risk of nozzle blockage during a capping operation. Similarly, contaminating material should be excluded from the capping facility during intervals between capping operations.

SUMMARY OF THE INVENTION

In a first aspect the present invention provides a printer comprising:

(a) a pagewidth print head assembly having
  (i) at least one pagewidth print head and
  (ii) a plurality of nozzles located along the at least one print head and arranged in use to deliver ink onto print media as it is transported past the at least one print head, and (b) a capping mechanism having
  (i) at least one capping member having a length corresponding substantially to that of the at least one print head,
  (ii) a first actuating mechanism arranged to move the at least one print head in an arcuate direction from a first to a second position and
  (iii) a second actuating mechanism arranged to move the at least one capping member in a direction normal to the at least one print head to effect nozzle capping engagement of the of the at least one print head when the at least one print head is in the second position.

Optionally at least one capping member is formed effectively as a one-piece member.

Optionally the at least one capping member comprises conjoined capping member portions having an aggregate length corresponding substantially to that of the at least one print head.

Optionally the at least one capping member comprises a body portion formed from a rigid material and a capping portion having a) an integrally formed elastomeric material lip portion and b) a cavity surrounded by the lip portion, and wherein the lip portion is peripherally configured to surround the nozzles collectively.

Optionally the print heads are disposed in confronting relationship when in the first position.

In a further aspect the present invention provides printer comprising:

(a) a pagewidth print head assembly having
  (i) two opposed pagewidth print heads and
  (ii) a plurality of nozzles located along each of the print heads and arranged in use to deliver ink onto print media as it is transported past the print heads, and (b) a capping mechanism having
  (i) two capping members located adjacent respective ones of the print heads and having a length corresponding substantially to that of the print heads,
  (ii) first actuating mechanisms arranged to move the respective print heads in an arcuate direction from a first to a second position and
  (iii) second actuating mechanisms arranged to move the capping members rectilinearly in directions normal to the respective print heads to effect nozzle capping engagement of the respective print heads when the respective print heads are in the second position.

Optionally each of the capping members is formed effectively as a one-piece member.

Optionally each of the capping members comprises conjoined capping member portions having an aggregate length corresponding substantially to that of the respective print heads.

Optionally each of the capping members comprises a body portion formed from a rigid material and a capping portion having a) an integrally formed elastomeric material lip portion and b) a cavity surrounded by the lip portion, and wherein the lip portion is peripherally configured to surround the nozzles collectively.

Optionally the print heads are disposed in confronting relationship when in the first position.

In a further aspect there is provided a printer wherein:

the pagewidth print head assembly has two opposed pagewidth print heads and a plurality of nozzles located along each of the print heads and arranged in use to deliver ink onto print media as it is transported past the print heads;

the capping member is located adjacent the print heads and has a length corresponding substantially to that of the print heads;

the first actuating mechanism is arranged to effect relative movement of the print heads from the printing first position to a spaced-apart second position; and the second actuating mechanism is arranged to interpose the capping member between the print heads to effect nozzle capping engagement of the two print heads when the print heads are in the second position.

In a further aspect there is provided a printer, wherein:

the pagewidth print head assembly has a single pagewidth print head;

the capping member is located in a non-capping first position spaced-apart from but confronting the print head; and the capping mechanism further has a motor drive arranged for camming engagement with the capping member to effect its linear transitioning from the non-capping first position to a second position at which the capping member is located in nozzle capping engagement with the print head.

In a further aspect there is provided a printer, wherein:

the capping member is located in a non-capping first position adjacent the at least one print head;

the capping mechanism further has purging means associated with the capping member and arranged to receive material that is purged from the nozzle environment of the at least one print head; and the second actuating mechanism is arranged to effect transitioning of the capping member from the non-capping first position to a second position at which the capping member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping mechanism has:

a capping member associated with each of the print heads, the capping members having lengths corresponding substantially to those of the print heads and each said capping member being moveable between a non-capping first position and a second position at which the capping member is located in nozzle capping engagement with the associated print head; and an actuating mechanism associated with each of the capping members and arranged to effect transitioning of each of the capping members from its first position to its second position.

In a further aspect there is provided a printer, wherein:

the pagewidth print head assembly has a single pagewidth print head;

the capping member is located in a non-capping first position spaced-apart from the print head; and the second actuating mechanism is arranged to effect arcuate transitioning of the capping member from the non-capping first position to a second position at which the capping member is located in nozzle capping engagement with the print head.

In a further aspect there is provided a printer, wherein:the pagewidth print head assembly has a single pagewidth print head;

the capping member is located in a non-capping first position adjacent the print head;

the capping mechanism further has purging means associated with the capping member and arranged to receive material that is purged from the nozzle environment of the print head; and the second actuating mechanism is arranged to effect transitioning of the capping member in an arcuate direction from the non-capping first position to a second position at which the capping member is located in nozzle capping engagement with the print head.

In a further aspect there is provided a printer, wherein the second actuating mechanism is arranged to move the at least one capping member in an arcuate second direction opposite to that of the first direction to effect nozzle capping engagement of the at least one print head when the at least one print head is in the second position.

In a further aspect there is provided a printer, wherein:

the first actuating mechanism is arranged to move the at least one print head in an arcuate first direction from the first position to the second position and a third position; and the second actuating mechanism is arranged to move the at least one capping member in an arcuate second direction opposite to that of the first direction to effect nozzle capping engagement of the at least one print head when the at least one print head is in the second position and to permit purging of the nozzles when the at least one print head is in the third position.

In a further aspect there is provided a printer, wherein the capping mechanism has:

a rotatable turret having a longitudinal length corresponding substantially to that of the at least one print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a printer, wherein the capping mechanism has:

a rotatable turret having a longitudinal length corresponding substantially to that of the at least one print head, a longitudinally extending capping member carried by the turret, and an actuating mechanism arranged to effect rotation of the turret to move the capping member from a non-capping first position to a second position at which the capping member is located in nozzle capping engagement with the at least one print head.

In a further aspect there is provided a printer, wherein the capping mechanism has:

a carrier positioned adjacent the at least one print head and having a longitudinal length corresponding substantially to that of the at least one print head, a longitudinally extending capping member pivotally mounted to the carrier and having a longitudinal length corresponding substantially to that of the at least one print head, and an actuating mechanism arranged to effect pivoting of the capping member from a non-capping first position to a second position at which the capping member is located in nozzle capping engagement with the at least one print head.

In a further aspect there is provided a printer, wherein:

the capping member is formed from a flexible sheet-like material and has a width corresponding substantially to the length of the at least one print head; and the second actuating mechanism is arranged to effect relative movement of the capping member and the at least one print head to a position at which the capping member is located in nozzle capping engagement with the at least one print head.

In a further aspect there is provided a printer, wherein the capping member is formed from a flexible sheet-like material and has a width corresponding substantially to the length of the at least one print head, the flexible sheet-like material being provided as a replaceable roll from which a portion of the material is in use drawn to locate, as the capping member, in nozzle capping engagement with the at least one print head.

In a further aspect there is provided a printer, wherein:

the capping member is formed from a flexible sheet-like material and has a width corresponding substantially to the length of the at least one print head, the flexible sheet-like material being provided as a replaceable roll from which a portion of the material is in use drawn to locate, as the capping member, in nozzle capping engagement with the at least one print head; and the capping mechanism further has a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one print head.

In a second aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping mechanism having (i) at least one capping member having a length corresponding substantially to that of the at least one print head, (ii) a first actuating mechanism arranged to move the at least one print head in an arcuate direction from a first to a second position and (iii) a second actuating mechanism arranged to move the at least one capping member in a lateral direction relative to the at least one print head to effect nozzle capping engagement of the of the at least one print head when the at least one print head is in the second position.

Optionally the at least one capping member is formed effectively as a one-piece member.

Optionally the at least one capping member comprises conjoined capping member portions having an aggregate length corresponding substantially to that of the at least one print head.

Optionally the at least one capping member comprises a body portion formed from a rigid material and a capping portion having a) an integrally formed elastomeric material lip portion and b) a cavity surrounded by the lip portion, and wherein the lip portion is peripherally configured to surround the nozzles collectively.

Optionally the print heads are disposed in confronting relationship when in the first position.

In a further aspect there is provided a printer comprising:

(a) a pagewidth print head assembly having (i) two opposed pagewidth print heads and (ii) a plurality of nozzles located along each of the print heads and arranged in use to deliver ink onto print media as it is transported past the print heads, and (b) a capping mechanism having (i) two capping members located adjacent respective ones of the print heads and having a length corresponding substantially to that of the print heads, (ii) first actuating mechanisms arranged to move the respective print heads in an arcuate direction from a first to a second position and (iii) second actuating mechanisms arranged to move the capping members rectilinearly in a lateral direction relative to the respective print heads to effect nozzle capping engagement of the respective print heads when the respective print heads are in the second position.

Optionally each of the capping members is formed effectively as a one-piece member.

Optionally each of the capping members comprises conjoined capping member portions having an aggregate length corresponding substantially to that of the respective print heads.

Optionally each of the capping members is formed from an elastomeric material and has a body portion, an integrally formed lip portion and a cavity surrounded by the lip portion, and wherein the lip portion is peripherally configured to surround the nozzles collectively.

Optionally the print heads are disposed in confronting relationship when in the first position.

In a further aspect there is provided a printer, wherein:

the pagewidth print head assembly has two opposed pagewidth print heads and a plurality of nozzles located along each of the print heads and arranged in use to deliver ink onto print media as it is transported past the print heads;

the capping member is located adjacent the print heads and has a length corresponding substantially to that of the print heads;

the first actuating mechanism is arranged to effect relative movement of the print heads from the printing first position to a spaced-apart second position; and the second actuating mechanism is arranged to interpose the capping member between the print heads to effect nozzle capping engagement of the two print heads when the print heads are in the second position.

In a further aspect there is provided a printer, wherein:

the pagewidth print head assembly has a single pagewidth print head;

the capping member is located in a non-capping first position spaced-apart from but confronting the print head; and the capping mechanism further has a motor drive arranged for camming engagement with the capping member to effect its linear transitioning from the non-capping first position to a second position at which the capping member is located in nozzle capping engagement with the print head.

In a further aspect there is provided a printer, wherein:

the capping member is located in a non-capping first position adjacent the at least one print head;

the capping mechanism further has purging means associated with the capping member and arranged to receive material that is purged from the nozzle environment of the at least one print head; and the second actuating mechanism is arranged to effect transitioning of the capping member from the non-capping first position to a second position at which the capping member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping mechanism has:

a capping member associated with each of the print heads, the capping members having lengths corresponding substantially to those of the print heads and each said capping member being moveable between a non-capping first position and a second position at which the capping member is located in nozzle capping engagement with the associated print head; and an actuating mechanism associated with each of the capping members and arranged to effect transitioning of each of the capping members from its first position to its second position.

In a further aspect there is provided a printer, wherein:

the pagewidth print head assembly has a single pagewidth print head; and the capping member is located in a non-capping first position spaced-apart from the print head; and the second actuating mechanism is arranged to effect arcuate transitioning of the capping member from the non-capping first position to a second position at which the capping member is located in nozzle capping engagement with the print head.

In a further aspect there is provided a printer, wherein:

the pagewidth print head assembly has a single pagewidth print head;

the capping member is located in a non-capping first position adjacent the print head;

the capping mechanism further has purging means associated with the capping member and arranged to receive material that is purged from the nozzle environment of the print head; and the second actuating mechanism is arranged to effect transitioning of the capping member in an arcuate direction from the non-capping first position to a second position at which the capping member is located in nozzle capping engagement with the print head.

In a further aspect there is provided a printer, wherein the second actuating mechanism is arranged to move the at least one capping member in an arcuate second direction opposite to that of the first direction to effect nozzle capping engagement of the at least one print head when the at least one print head is in the second position.

In a further aspect there is provided a printer, wherein:

the first actuating mechanism is arranged to move the at least one print head in an arcuate first direction from the first position to the second position and a third position; and the second actuating mechanism is arranged to move the at least one capping member in an arcuate second direction opposite to that of the first direction to effect nozzle capping engagement of the at least one print head when the at least one print head is in the second position and to permit purging of the nozzles when the at least one print head is in the third position.

In a further aspect there is provided a printer, wherein the capping mechanism has:

a rotatable turret having a longitudinal length corresponding substantially to that of the at least one print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a printer, wherein the capping mechanism has:

a rotatable turret having a longitudinal length corresponding substantially to that of the at least one print head, a longitudinally extending capping member carried by the turret, and an actuating mechanism arranged to effect rotation of the turret to move the capping member from a non-capping first position to a second position at which the capping member is located in nozzle capping engagement with the at least one print head.

In a further aspect there is provided a printer, wherein the capping mechanism has:

a carrier positioned adjacent the at least one print head and having a longitudinal length corresponding substantially to that of the at least one print head, a longitudinally extending capping member pivotally mounted to the carrier and having a longitudinal length corresponding substantially to that of the at least one print head, and an actuating mechanism arranged to effect pivoting of the capping member from a non-capping first position to a second position at which the capping member is located in nozzle capping engagement with the at least one print head.

In a further aspect there is provided a printer, wherein:

the capping member is formed from a flexible sheet-like material and has a width corresponding substantially to the length of the at least one print head; and the second actuating mechanism is arranged to effect relative movement of the capping member and the at least one print head to a position at which the capping member is located in nozzle capping engagement with the at least one print head.

In a further aspect there is provided a printer, wherein the capping member is formed from a flexible sheet-like material and has a width corresponding substantially to the length of the at least one print head, the flexible sheet-like material being provided as a replaceable roll from which a portion of the material is in use drawn to locate, as the capping member, in nozzle capping engagement with the at least one print head.

In a further aspect there is provided a printer, wherein:

the capping member is formed from a flexible sheet-like material and has a width corresponding substantially to the length of the at least one print head, the flexible sheet-like material being provided as a replaceable roll from which a portion of the material is in use drawn to locate, as the capping member, in nozzle capping engagement with the at least one print head; and the capping mechanism further has a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one printhead.

In a third aspect there is provided a printer comprising:

(a) a pagewidth print head assembly having (i) two opposed pagewidth print heads and (ii) a plurality of nozzles located along each of the print heads and arranged in use to deliver ink onto print media as it is transported past the print heads, and (b) a capping mechanism having (i) a capping member located adjacent the print heads and having a length corresponding substantially to that of the print heads, (ii) a first actuating mechanism arranged to effect relative movement of the print heads from a printing first position to a spaced-apart second position and (iii) a second actuating mechanism arranged to interpose the capping member between the print heads to effect nozzle capping engagement of the two print heads when the print heads are in the second position.

Optionally the second actuating mechanism is arranged to effect rectilinear movement of the capping member in a lateral direction, relative to the print heads, when moving the capping member from the location adjacent the print heads to the position at which the capping member is interposed between the print heads.

Optionally the capping member has two oppositely directed capping portions, respective ones of which are arranged to engage in nozzle capping engagement with respective ones of the print heads when in the second position.

Optionally the capping member comprises a body portion formed from a rigid material and on which the capping portions are located, wherein each capping portion has a) an integrally formed elastomeric material lip portion and b) a cavity surrounded by the lip portion, and wherein the lip portion is peripherally configured to surround the nozzles collectively on the respective print heads.

and wherein the lip portion is peripherally configured to surround the nozzles collectively on the respective print heads.

Optionally the capping member is formed effectively as a one-piece member.

Optionally wherein the print heads are disposed in confronting relationship when in the first position.

In a further aspect there is provided a printer, wherein:

the first actuating mechanism is arranged to move the print head in an arcuate direction from the first to the second positions; and the second actuating mechanism is arranged to move the capping member in a direction normal to the print head to effect nozzle capping engagement of the print head when the print head is in the second position.

In a further aspect there is provided a printer, wherein:

the first actuating mechanism is arranged to move the print head in an arcuate direction from the first to the second positions; and the second actuating mechanism is arranged to move the capping member in a lateral direction relative to the print head to effect nozzle capping engagement of the print head when the print head is in the second position.

In a further aspect there is provided a printer, wherein:

the capping member is located in a non-capping first position adjacent the print head;

the capping mechanism further has purging means associated with the capping member and arranged to receive material that is purged from the nozzle environment of the print head; and the second actuating mechanism is arranged to effect transitioning of the capping member from the non-capping first position to a capping second position at which the capping member is located in nozzle capping engagement with the print head.

In a further aspect there is provided a printer, wherein:

the first actuating mechanism is arranged to move the print head in an arcuate direction from the first to the second positions; and the second actuating mechanism is arranged to move the capping member in an arcuate second direction opposite to that of the first direction to effect nozzle capping engagement of the print head when the print head is in the second position.

In a further aspect there is provided a printer, wherein:

the first actuating mechanism is arranged to move the print head in an arcuate first direction from the first position to the second position and a third position; and the second actuating mechanism is arranged to move the capping member in an arcuate second direction opposite to that of the first direction to effect nozzle capping engagement of the print head when the print head is in the second position and to permit purging of the nozzles when the print head is in the third position.

In a further aspect there is provided a printer, wherein the capping mechanism has:

a rotatable turret having a longitudinal length corresponding substantially to that of the print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the print head, and a second actuating mechanism arranged to effect movement of the turret whereby an aligned one of the capping member and the purging chamber is selectively positioned in engagement with the print head.

In a further aspect there is provided a printer, wherein the capping mechanism has:

a rotatable turret having a longitudinal length corresponding substantially to that of the print head, a longitudinally extending capping member carried by the turret, and an actuating mechanism arranged to effect rotation of the turret to move the capping member from a non-capping first position to a capping second position at which the capping member is located in nozzle capping engagement with the print head.

In a further aspect there is provided a printer, wherein the capping mechanism has:

a carrier positioned adjacent the print head and having a longitudinal length corresponding substantially to that of the print head, a longitudinally extending capping member pivotally mounted to the carrier and having a longitudinal length corresponding substantially to that of the print head, and an actuating mechanism arranged to effect pivoting of the capping member from a non-capping first position to a second capping position at which the capping member is located in nozzle capping engagement with the print head.

In a further aspect there is provided a printer, wherein:

the capping member is formed from a flexible sheet-like material and has a width corresponding substantially to the length of the print head; and the second actuating mechanism is arranged to effect relative movement of the capping member and the print head to a position at which the capping member is located in nozzle capping engagement with the print head.

Optionally the capping member is formed from a flexible sheet-like material and has a width corresponding substantially to the length of the print head, the flexible sheet-like material being provided as a replaceable roll from which a portion of the material is in use drawn to locate, as the capping member, in nozzle capping engagement with the print head.

In a further aspect there is provided a printer, wherein:

the capping member is formed from a flexible sheet-like material and has a width corresponding substantially to the length of the print head, the flexible sheet-like material being provided as a replaceable roll from which a portion of the material is in use drawn to locate, as the capping member, in nozzle capping engagement with the print head; and the capping mechanism further has a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the print head, and the body portion having a length corresponding substantially to that of the print head.

In a fourth aspect the present invention provides a printer comprising:

(a) a pagewidth print head assembly having (i) a single pagewidth print head and (ii) a plurality of nozzles located along the print head and arranged in use to deliver ink onto print media as it is transported past the print head, and (b) a capping mechanism having (i) a capping member having a length corresponding substantially to that of the print head and located in a non-capping first position spaced-apart from but confronting the print head, and (ii) a motor drive arranged for camming engagement with the capping member to effect its linear transitioning from the first position to a second position at which the capping member is located in nozzle capping engagement with the print head.

Optionally the actuating mechanism is arranged to effect transitioning of the capping member in a direction normal to the direction of transport of print media past the print head.

Optionally the capping member when in the first position is located below the print head and wherein the capping member is raised from the first position to the second position to effect nozzle capping engagement of the print head.

Optionally the capping member comprises a body portion formed from a rigid material and a capping portion having a) an integrally formed elastomeric material lip portion and b) a cavity surrounded by the lip portion, and wherein the lip portion is peripherally configured to surround the print head nozzles.

Optionally the capping member is formed effectively as a one-piece member.

Optionally the capping mechanism further has:

a first actuating mechanism arranged to move the print head in an arcuate direction from a first to a second position; and a second actuating mechanism arranged to move the capping member in a direction normal to the print head to effect nozzle capping engagement of the print head when the print head is in the second position.

Optionally the capping mechanism further has:

a first actuating mechanism arranged to move the print head in an arcuate direction from a first to a second position; and a second actuating mechanism arranged to move the capping member in a lateral direction relative to the print head to effect nozzle capping engagement of the print head when the print head is in the second position.

Optionally the capping mechanism further has purging means associated with the capping member and arranged to receive material that is purged from the nozzle environment of the print head.

Optionally in the capping mechanism has:

a rotatable turret having a longitudinal length corresponding substantially to that of the print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the print head, and a second actuating mechanism arranged to effect movement of the turret whereby an aligned one of the capping member and the purging chamber is selectively positioned in engagement with the print head.

Optionally the capping mechanism has:

a rotatable turret having a longitudinal length corresponding substantially to that of the print head, a longitudinally extending capping member carried by the turret, and an actuating mechanism arranged to effect rotation of the turret to move the capping member from the non-capping first position to the second position at which the capping member is located in nozzle capping engagement with the print head.

In a further aspect there is provided a printer, wherein:

the capping member is formed from a flexible sheet-like material and has a width corresponding substantially to the length of the print head; and the second actuating mechanism is arranged to effect relative movement of the capping member and the print head to a position at which the capping member is located in nozzle capping engagement with the print head.

In a further aspect there is provided a printer, wherein the capping member is formed from a flexible sheet-like material and has a width corresponding substantially to the length of the print head, the flexible sheet-like material being provided as a replaceable roll from which a portion of the material is in use drawn to locate, as the capping member, in nozzle capping engagement with the print head.

In a further aspect there is provided a printer, wherein:

the capping member is formed from a flexible sheet-like material and has a width corresponding substantially to the length of the print head, the flexible sheet-like material being provided as a replaceable roll from which a portion of the material is in use drawn to locate, as the capping member, in nozzle capping engagement with the print head; and the capping mechanism further has a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the print head, and the body portion having a length corresponding substantially to that of the print head.

In a fifth aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping/purging mechanism having (i) a capping member associated with the at least one print head, the capping member having a length corresponding substantially to that of the at least one print head and being located in a non-capping first position adjacent the at least one print head, (ii) purging means associated with the capping member and arranged to receive material that is purged from the nozzle environment of the at least one print head, and (iii) an actuating mechanism arranged to effect transitioning of the capping member from the first position to a second position at which the capping member is located in nozzle capping engagement with the print head.

In a further aspect there is provided a printer comprising:

(a) a pagewidth print head assembly having (i) a single pagewidth print head and (ii) a plurality of nozzles located along the print head and arranged in use to deliver ink onto print media as it is transported past the print head, and (b) a capping/purging mechanism having (i) a capping member associated with the print head, the capping member having a length corresponding substantially to that of the print head and being located in a non-capping first position adjacent the print head, (ii) purging means associated with the capping member and arranged to receive material that is purged from the nozzle environment of the print head, and (iii) an actuating mechanism arranged to effect transitioning of the capping member from the first position to a second position at which the capping member is located in nozzle capping engagement with the print head.

Optionally the capping member when in the first position is located in spaced-apart confronting relationship to the print head.

Optionally the actuating mechanism is arranged to effect linear transitioning of the capping member from the first position to the second position.

Optionally the purging means includes a suction device that is arranged to suck purged material from the nozzle environment of the print head.

Optionally the capping member is formed with a) an elastomeric material a lip portion and b) a cavity surrounded by the lip portion, and wherein the lip portion is peripherally configured to surround the print head nozzles.

Optionally the capping member is formed effectively as a one-piece member.

Optionally a chamber is located within the capping member and is connected in fluid passage communication with the cavity, and wherein the chamber is arranged to be connected to a suction device whereby material may be sucked from the nozzle environment of the print head.

Optionally the actuating mechanism is arranged to effect transitioning of the capping member in a direction normal to the direction of transport of print media past the print head.

Optionally the capping member when in the first position is located below the print head and wherein the capping member is raised from the first position to the second position to effect nozzle capping engagement of the print head.

In a further aspect there is provided a printer, wherein the capping/purging mechanism further has:

a first actuating mechanism arranged to move the at least one print head in an arcuate direction from a first to a second position; and a second actuating mechanism arranged to move the capping member in a direction normal to the at least one print head to effect nozzle capping engagement of the at least one print head when the at least one print head is in the second position.

In a further aspect there is provided a printer, wherein the capping/purging mechanism further has:

a first actuating mechanism arranged to move the at least one print head in an arcuate direction from a first to a second position; and a second actuating mechanism arranged to move the capping member in a lateral direction relative to the at least one print head to effect nozzle capping engagement of the at least one print head when the at least one print head is in the second position.

In a further aspect there is provided a printer, wherein:

the pagewidth print head assembly has two opposed pagewidth print heads and a plurality of nozzles located along each of the print heads and arranged in use to deliver ink onto print media as it is transported past the print heads;

the capping member is located adjacent the print heads and has a length corresponding substantially to that of the print heads;

a first actuating mechanism arranged to effect relative movement of the print heads from a printing first position to a spaced-apart second position; and a second actuating mechanism arranged to interpose the capping member between the print heads to effect nozzle capping engagement of the two print heads when the print heads are in the second position.

In a further aspect there is provided a printer, wherein:

the pagewidth print head assembly has a single pagewidth print head; and the capping mechanism further has a motor drive arranged for camming engagement with the capping member to effect its linear transitioning from the non-capping first position to the second position at which the capping member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping/purging mechanism has:

a capping member associated with each of the print heads, the capping members having lengths corresponding substantially to those of the print heads and each said capping member being moveable between a non-capping first position and a capping second position at which the capping member is located in nozzle capping engagement with the associated print head; and an actuating mechanism associated with each of the capping members and arranged to effect transitioning of each of the capping members from its first position to its second position.

In a further aspect there is provided a printer, wherein:

the pagewidth print head assembly has a single pagewidth print head; and the capping member is located in the non-capping first position spaced-apart from the print head; and the actuating mechanism is arranged to effect arcuate transitioning of the capping member from the non-capping first position to the second position at which the capping member is located in nozzle capping engagement with the print head.

In a further aspect there is provided a printer, wherein:

the pagewidth print head assembly has a single pagewidth print head; and the actuating mechanism is arranged to effect transitioning of the capping member in an arcuate direction from the non-capping first position to the second position at which the capping member is located in nozzle capping engagement with the print head.

In a further aspect there is provided a printer, wherein the capping/purging mechanism further has:

a first actuating mechanism arranged to move the at least one print head in a arcuate first direction from a first to a second position; and a second actuating mechanism arranged to move the capping member in an arcuate second direction opposite to that of the first direction to effect nozzle capping engagement of the at least one print head when the at least one print head is in the second position.

In a further aspect there is provided a printer, wherein the capping/purging mechanism further has:

a first actuating mechanism arranged to move the at least one print head in a arcuate first direction from a first position to a second position and a third position; and a second actuating mechanism arranged to move the capping member in an arcuate second direction opposite to that of the first direction to effect nozzle capping engagement of the at least one print head when the at least one print head is in the second position and to permit purging of the nozzles when the at least one print head is in the third position.

In a further aspect there is provided a printer, wherein the capping/purging mechanism has:

a rotatable turret having a longitudinal length corresponding substantially to that of the at least one print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a printer, wherein the capping/purging mechanism has:

a rotatable turret having a longitudinal length corresponding substantially to that of the at least one print head, a longitudinally extending capping member carried by the turret, and an actuating mechanism arranged to effect rotation of the turret to move the capping member from the non-capping first position to the second position at which the capping member is located in nozzle capping engagement with the at least one print head.

In a further aspect there is provided a printer, wherein the capping/purging mechanism has:

a carrier positioned adjacent the at least one print head and having a longitudinal length corresponding substantially to that of the at least one print head, a longitudinally extending capping member pivotally mounted to the carrier and having a longitudinal length corresponding substantially to that of the at least one print head, and an actuating mechanism arranged to effect pivoting of the capping member from the non-capping first position to the second position at which the capping member is located in nozzle capping engagement with the at least one print head.

In a further aspect there is provided a printer, wherein:

the capping member is formed from a flexible sheet-like material and has a width corresponding substantially to the length of the at least one print head; and the actuating mechanism is arranged to effect relative movement of the capping member and the at least one print head to a position at which the capping member is located in nozzle capping engagement with the at least one print head.

In a further aspect there is provided a printer, wherein the capping member is formed from a flexible sheet-like material and has a width corresponding substantially to the length of the at least one print head, the flexible sheet-like material being provided as a replaceable roll from which a portion of the material is in use drawn to locate, as the capping member, in nozzle capping engagement with the at least one print head.

In a further aspect there is provided a printer, wherein:

the capping member is formed from a flexible sheet-like material and has a width corresponding substantially to the length of the at least one print head, the flexible sheet-like material being provided as a replaceable roll from which a portion of the material is in use drawn to locate, as the capping member, in nozzle capping engagement with the at least one print head; and the capping/purging mechanism further has a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one print head.

In a sixth aspect the present invention provides a printer comprising:

(a) a pagewidth print head assembly having (i) two offset pagewidth print heads and (ii) a plurality of nozzles located along each of the print heads and arranged in use to deliver ink onto print media as it is transported past the print heads, and (b) a capping mechanism having (i) a capping member associated with each of the print heads, the capping members having lengths corresponding substantially to those of the print heads and each said capping member being moveable between a non-capping first position and a second position at which the capping member is located in nozzle capping engagement with the associated print head, and (ii) an actuating mechanism associated with each of the capping members and arranged to effect transitioning of each of the capping members from its first position to its second position.

Optionally the print heads are orientated in mutually opposite directions and are arranged to deliver ink onto opposite faces of print media as it is transported between the print heads Optionally the capping members when in the first position are located in vertical spaced relationship to the respective print heads and are located one at each side of the plane of print media feed through the printer.

Optionally the respective actuating mechanisms are arranged to effect transitioning of the associated capping members in a direction normal to the direction of transport of print media past the respective print heads.

Optionally each said capping member comprises a) an elastomeric material lip portion and b) a cavity surrounded by the lip portion, and wherein the lip portion is peripherally configured to surround the print head nozzles.

Optionally each said capping member is formed effectively as a one-piece member.

In a further aspect there is provided a printer, wherein the capping mechanism further has:

a first actuating mechanism arranged to move the print head in an arcuate direction from a first to a second position; and a second actuating mechanism arranged to move the capping member in a direction normal to the print head to effect nozzle capping engagement of the print head when the print head is in the second position.

In a further aspect there is provided a printer, wherein the capping mechanism further has:

a first actuating mechanism arranged to move the print head in an arcuate direction from a first to a second position; and a second actuating mechanism arranged to move the capping member in a lateral direction relative to the print head to effect nozzle capping engagement of the print head when the print head is in the second position.

In a further aspect there is provided a printer, wherein the capping mechanism further has purging means associated with the capping member and arranged to receive material that is purged from the nozzle environment of the print head.

In a further aspect there is provided a printer, wherein the capping mechanism further has:

a first actuating mechanism arranged to move the print head in an arcuate first direction from a first to a second position; and a second actuating mechanism arranged to move the capping members in an arcuate second direction opposite to that of the first direction to effect nozzle capping engagement of the print head when the print head is in the second position.

In a further aspect there is provided a printer, wherein the capping mechanism further has:

a first actuating mechanism arranged to move the print heads in an arcuate first direction from a first position to a second position and a third position; and a second actuating mechanism arranged to move the capping members in an arcuate second direction opposite to that of the first direction to effect nozzle capping engagement of the print head when the print head is in the second position and to permit purging of the nozzles when the print head is in the third position.

In a further aspect there is provided a printer, wherein the capping mechanism has:

a rotatable turret having a longitudinal length corresponding substantially to that of the print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the print head, and a second actuating mechanism arranged to effect movement of the turret whereby an aligned one of the capping member and the purging chamber is selectively positioned in engagement with the print head.

In a further aspect there is provided a printer, wherein the capping mechanism has:

a rotatable turret having a longitudinal length corresponding substantially to that of the print head, a longitudinally extending capping member carried by the turret, and an actuating mechanism arranged to effect rotation of the turret to move the capping member from the non-capping first position to the second position at which the capping member is located in nozzle capping engagement with the print head.

In a further aspect there is provided a printer, wherein the capping mechanism has:

a carrier positioned adjacent the print head and having a longitudinal length corresponding substantially to that of the print head, a longitudinally extending capping member pivotally mounted to the carrier and having a longitudinal length corresponding substantially to that of the print head, and an actuating mechanism arranged to effect pivoting of the capping member from the non-capping first position to the second position at which the capping member is located in nozzle capping engagement with the print head.

In a further aspect there is provided a printer, wherein:

the capping member is formed from a flexible sheet-like material and has a width corresponding substantially to the length of the print head; and the actuating mechanism is arranged to effect relative movement of the capping member and the print head to a position at which the capping member is located in nozzle capping engagement with the print head.

In a further aspect there is provided a printer, wherein the capping member is formed from a flexible sheet-like material and has a width corresponding substantially to the length of the print head, the flexible sheet-like material being provided as a replaceable roll from which a portion of the material is in use drawn to locate, as the capping member, in nozzle capping engagement with the print head.

In a further aspect there is provided a printer, wherein:

the capping member is formed from a flexible sheet-like material and has a width corresponding substantially to the length of the print head, the flexible sheet-like material being provided as a replaceable roll from which a portion of the material is in use drawn to locate, as the capping member, in nozzle capping engagement with the print head; and the capping mechanism further has a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the print head, and the body portion having a length corresponding substantially to that of the print head.

In a seventh aspect the present invention provides a printer comprising:

(a) a pagewidth print head assembly having (i) a single pagewidth print head and (ii) a plurality of nozzles located along the print head and arranged in use to deliver ink onto print media as it is transported past the print head, and (b) a capping mechanism having (i) a capping member having a length corresponding substantially to that of the print head and located in a non-capping first position spaced-apart from the print head, and (ii) an actuating mechanism arranged to effect arcuate transitioning of the capping member from the first position to a second position at which the capping member is located in nozzle capping engagement with the print head.

Optionally the actuating mechanism is arranged to effect transitioning of the capping member in a direction approximately normal to the direction of transport of print media past the print head.

Optionally the capping member when in the first position is located below the print head and wherein the capping member is raised in the arcuate direction from the first position to the second position to effect nozzle capping engagement of the print head.

Optionally the capping member comprises:

a) an elastomeric material lip portion and b) a cavity surrounded by the lip portion, and wherein the lip portion is peripherally configured to surround the print head nozzles.

Optionally the capping member is formed effectively as a one-piece member.

Optionally the capping mechanism further has:

a first actuating mechanism arranged to move the print head in an arcuate direction from a first to a second position; and a second actuating mechanism arranged to move the capping member in a direction normal to the print head to effect nozzle capping engagement of the print head when the print head is in the second position.

In a further aspect there is provided a printer, wherein the capping mechanism further has:

a first actuating mechanism arranged to move the print head in an arcuate direction from a first to a second position; and a second actuating mechanism arranged to move the capping member in a lateral direction relative to the print head to effect nozzle capping engagement of the print head when the print head is in the second position.

In a further aspect there is provided a printer, wherein:

the capping member is located in the non-capping first position adjacent the print head; and the capping mechanism further has purging means associated with the capping member and arranged to receive material that is purged from the nozzle environment of the print head.

In a further aspect there is provided a printer, wherein:

the capping member is located in the non-capping first position adjacent the print head;

the capping mechanism further has purging means associated with the capping member and arranged to receive material that is purged from the nozzle environment of the print head; and the actuating mechanism is arranged to effect transitioning of the capping member in an arcuate direction from the non-capping first position to the second position at which the capping member is located in nozzle capping engagement with the print head.

In a further aspect there is provided a printer, wherein the capping mechanism further has:

a first actuating mechanism arranged to move the print head in an arcuate first direction from a first to a second position; and a second actuating mechanism arranged to move the capping member in an arcuate second direction opposite to that of the first direction to effect nozzle capping engagement of the print head when the print head is in the second position.

In a further aspect there is provided a printer, wherein the capping mechanism further has:

a first actuating mechanism arranged to move the print head in an arcuate first direction from a first position to a second position and a third position; and a second actuating mechanism arranged to move the capping member in an arcuate second direction opposite to that of the first direction to effect nozzle capping engagement of the print head when the print head is in the second position and to permit purging of the nozzles when the print head is in the third position.

In a further aspect there is provided a printer, wherein the capping mechanism has:

a rotatable turret having a longitudinal length corresponding substantially to that of the print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the print head, and a second actuating mechanism arranged to effect movement of the turret whereby an aligned one of the capping member and the purging chamber is selectively positioned in engagement with the print head.

In a further aspect there is provided a printer, wherein the capping mechanism has:

a rotatable turret having a longitudinal length corresponding substantially to that of the print head, a longitudinally extending capping member carried by the turret, and an actuating mechanism arranged to effect rotation of the turret to move the capping member from the non-capping first position to the second position at which the capping member is located in nozzle capping engagement with the print head.

In a further aspect there is provided a printer, wherein the capping mechanism has:

a carrier positioned adjacent the print head and having a longitudinal length corresponding substantially to that of the print head, a longitudinally extending capping member pivotally mounted to the carrier and having a longitudinal length corresponding substantially to that of the print head, and an actuating mechanism arranged to effect pivoting of the capping member from the non-capping first position to the second position at which the capping member is located in nozzle capping engagement with the print head.

In a further aspect there is provided a printer, wherein:

the capping member is formed from a flexible sheet-like material and has a width corresponding substantially to the length of the print head; and the actuating mechanism is arranged to effect relative movement of the capping member and the print head to a position at which the capping member is located in nozzle capping engagement with the print head.

In a further aspect there is provided a printer, wherein the capping member is formed from a flexible sheet-like material and has a width corresponding substantially to the length of the print head, the flexible sheet-like material being provided as a replaceable roll from which a portion of the material is in use drawn to locate, as the capping member, in nozzle capping engagement with the print head.

In a further aspect there is provided a printer, wherein:

the capping member is formed from a flexible sheet-like material and has a width corresponding substantially to the length of the print head, the flexible sheet-like material being provided as a replaceable roll from which a portion of the material is in use drawn to locate, as the capping member, in nozzle capping engagement with the print head; and the capping mechanism further has a take-up reel arranged to take-up spent capping material following a capping operation.

In a further aspect there is provided a printer wherein the capping member comprises:

a) a lip portion that is formed integrally with a body portion; and b) a cavity surrounded by the lip portion, the lip portion being peripherally configured to surround the nozzles on the print head, and the body portion having a length corresponding substantially to that of the print head.

In an eighth aspect the present invention provides a printer comprising:

(a) a pagewidth print head assembly having (i) a single pagewidth print head and (ii) a plurality of nozzles located along the print head and arranged in use to deliver ink onto print media as it is transported past the print head, and (b) a capping/purging mechanism having (i) a capping member associated with the print head, the capping member having a length corresponding substantially to that of the print head and being located in a non-capping first position adjacent the print head, (ii) purging means associated with the capping member and arranged to receive material that is purged from the nozzle environment of the print head, and (iii) an actuating mechanism arranged to effect transitioning of the capping member in an arcuate direction from the first position to a second position at which the capping member is located in nozzle capping engagement with the print head.

Optionally the capping member when in the first position is located in spaced-apart substantially confronting relationship to the print head.

Optionally the purging means includes a suction device that is arranged to suck purged material from the nozzle environment of the print head.

Optionally the capping member comprises a) an elastomeric material a lip portion and b) a cavity surrounded by the lip portion, and wherein the lip portion is peripherally configured to surround the print head nozzles.

Optionally the capping member is formed effectively as a one-piece member.

Optionally a chamber is located within the capping member and is connected in fluid passage communication with the cavity, and wherein the chamber is arranged to be connected to a suction device whereby material may be sucked from the nozzle environment of the print head.

Optionally the actuating mechanism is arranged to effect transitioning of the capping member in a direction approximately normal to the direction of transport of print media past the print head.

In a further aspect there is provided a printer wherein the capping member when in the first position is located below the print head and wherein the capping member is raised in the arcuate direction from the first position to the second position to effect nozzle capping engagement of the print head.

In a further aspect there is provided a printer, wherein the capping/purging mechanism further has:

a first actuating mechanism arranged to move the print head in an arcuate direction from a first to a second position; and a second actuating mechanism arranged to move the capping member in a direction normal to the print head to effect nozzle capping engagement of the print head when the print head is in the second position.

In a further aspect there is provided a printer, wherein the capping/purging mechanism further has:

a first actuating mechanism arranged to move the print head in an arcuate direction from a first to a second position; and a second actuating mechanism arranged to move the capping member in a lateral direction relative to the print head to effect nozzle capping engagement of the print head when the print head is in the second position.

In a further aspect there is provided a printer, wherein the capping member is located in the non-capping first position spaced-apart from the print head.

In a further aspect there is provided a printer, wherein the capping/purging mechanism further has:

a first actuating mechanism arranged to move the print head in an arcuate first direction from a first to a second position; and a second actuating mechanism arranged to move the capping member in an arcuate second direction opposite to that of the first direction to effect nozzle capping engagement of the print head when the print head is in the second position.

In a further aspect there is provided a printer, wherein the capping/purging mechanism further has:

a first actuating mechanism arranged to move the print head in an arcuate first direction from a first position to a second position and a third position; and a second actuating mechanism arranged to move the capping member in an arcuate second direction opposite to that of the first direction to effect nozzle capping engagement of the print head when the print head is in the second position and to permit purging of the nozzles when the print head is in the third position.

In a further aspect there is provided a printer, wherein the capping/purging mechanism has:

a rotatable turret having a longitudinal length corresponding substantially to that of the print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the print head, and a second actuating mechanism arranged to effect movement of the turret whereby an aligned one of the capping member and the purging chamber is selectively positioned in engagement with the print head.

In a further aspect there is provided a printer, wherein the capping/purging mechanism has:

a rotatable turret having a longitudinal length corresponding substantially to that of the print head, a longitudinally extending capping member carried by the turret, and an actuating mechanism arranged to effect rotation of the turret to move the capping member from the non-capping first position to the second position at which the capping member is located in nozzle capping engagement with the print head.

In a further aspect there is provided a printer, wherein the capping/purging mechanism has:

a carrier positioned adjacent the print head and having a longitudinal length corresponding substantially to that of the print head, a longitudinally extending capping member pivotally mounted to the carrier and having a longitudinal length corresponding substantially to that of the print head, and an actuating mechanism arranged to effect pivoting of the capping member from the non-capping first position to the second position at which the capping member is located in nozzle capping engagement with the print head.

In a further aspect there is provided a printer, wherein:

the capping member is formed from a flexible sheet-like material and has a width corresponding substantially to the length of the print head; and the actuating mechanism is arranged to effect relative movement of the capping member and the print head to a position at which the capping member is located in nozzle capping engagement with the print head.

In a further aspect there is provided a printer, wherein the capping member is formed from a flexible sheet-like material and has a width corresponding substantially to the length of the print head, the flexible sheet-like material being provided as a replaceable roll from which a portion of the material is in use drawn to locate, as the capping member, in nozzle capping engagement with the print head.

In a further aspect there is provided a printer, wherein:

the capping member is formed from a flexible sheet-like material and has a width corresponding substantially to the length of the print head, the flexible sheet-like material being provided as a replaceable roll from which a portion of the material is in use drawn to locate, as the capping member, in nozzle capping engagement with the print head; and the capping/purging mechanism further has a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the print head, and the body portion having a length corresponding substantially to that of the print head.

In a ninth aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping mechanism having (i) at least one capping member having a length corresponding substantially to that of the at least one print head, (ii) a first actuating mechanism arranged to move the at least one print head in a arcuate first direction from a first to a second position and (iii) a second actuating mechanism arranged to move the at least one capping member in an arcuate second direction opposite to that of the first direction to effect nozzle capping engagement of the at least one print head when the at least one print head is in the second position.

Optionally the at least one capping member is formed effectively as a one-piece member.

Optionally the at least one capping member comprises conjoined capping member portions having an aggregate length corresponding substantially to that of the at least one print head.

Optionally wherein the at least one capping member comprises a body portion formed from a rigid material and a capping portion having a) an integrally formed elastomeric material lip portion and b) a cavity surrounded by the lip portion, and wherein the lip portion is peripherally configured to surround the nozzles collectively.

Optionally the print heads are disposed in confronting relationship when in the first position.

In a further aspect there is provided a printer comprising:

(a) a pagewidth print head assembly having (i) two opposed pagewidth print heads and (ii) a plurality of nozzles located along each of the print heads and arranged in use to deliver ink onto print media as it is transported past the print heads, and (b) a capping mechanism having (i) two capping members located adjacent respective ones of the print heads and having a length corresponding substantially to that of the print heads, (ii) first actuating mechanisms arranged to move the respective print heads in an arcuate first direction from a first to a second position and (iii) second actuating mechanisms arranged to move the capping members in an arcuate second direction opposite to that of the first direction to effect nozzle capping engagement of the respective print heads when the respective print heads are in the second position.

Optionally each of the capping members is formed effectively as a one-piece member.

Optionally each of the capping members comprises conjoined capping member portions having an aggregate length corresponding substantially to that of the respective print heads.

Optionally each of the capping members comprises a body portion formed from a rigid material and a capping portion having a) an integrally formed elastomeric material lip portion and b) a cavity surrounded by the lip portion, and wherein the lip portion is peripherally configured to surround the nozzles collectively.

Optionally the print heads are disposed in confronting relationship when in the first position.

Optionally the second actuating mechanism is arranged to move the at least one capping member in a direction normal to the at least one print head to effect nozzle capping engagement of the at least one print head when the at least one print head is in the second position.

Optionally the second actuating mechanism is arranged to move the at least one capping member in a lateral direction relative to the at least one print head to effect nozzle capping engagement of the at least one print head when the at least one print head is in the second position.

In a further aspect there is provided a printer, wherein:

the pagewidth print head assembly has two opposed pagewidth print heads and a plurality of nozzles located along each of the print heads and arranged in use to deliver ink onto print media as it is transported past the print heads;

the capping member is located adjacent the print heads and has a length corresponding substantially to that of the print heads;

the first actuating mechanism is arranged to effect relative movement of the print heads from the printing first position to a spaced-apart second position; and the second actuating mechanism is arranged to interpose the capping member between the print heads to effect nozzle capping engagement of the two print heads when the print heads are in the second position.

In a further aspect there is provided a printer, wherein:

the capping member is located in a non-capping first position adjacent the at least one print head;

the capping mechanism further has purging means associated with the capping member and arranged to receive material that is purged from the nozzle environment of the at least one print head; and the second actuating mechanism is arranged to effect transitioning of the capping member from the non-capping first position to a second position at which the capping member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping mechanism has:

a capping member associated with each of the print heads, the capping members having lengths corresponding substantially to those of the print heads and each said capping member being moveable between a non-capping first position and a second position at which the capping member is located in nozzle capping engagement with the associated print head; and an actuating mechanism associated with each of the capping members and arranged to effect transitioning of each of the capping members from its first position to its second position.

In a further aspect there is provided a printer, wherein:

the pagewidth print head assembly has a single pagewidth print head; and the capping member is located in a non-capping first position spaced-apart from the print head; and the second actuating mechanism is arranged to effect arcuate transitioning of the capping member from the non-capping first position to a second position at which the capping member is located in nozzle capping engagement with the print head.

In a further aspect there is provided a printer, wherein:

the pagewidth print head assembly has a single pagewidth print head;

the capping member is located in a non-capping first position adjacent the print head;

the capping mechanism further has purging means associated with the capping member and arranged to receive material that is purged from the nozzle environment of the print head; and the second actuating mechanism is arranged to effect transitioning of the capping member in an arcuate direction from the non-capping first position to a second position at which the capping member is located in nozzle capping engagement with the print head.

In a further aspect there is provided a printer, wherein:

the first actuating mechanism is arranged to move the at least one print head in an arcuate first direction from the first position to the second position and a third position; and the second actuating mechanism is arranged to permit purging of the nozzles when the at least one print head is in the third position.

In a further aspect there is provided a printer, wherein the capping mechanism has:

a rotatable turret having a longitudinal length corresponding substantially to that of the at least one print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a printer, wherein the capping mechanism has:

a rotatable turret having a longitudinal length corresponding substantially to that of the at least one print head, a longitudinally extending capping member carried by the turret, and an actuating mechanism arranged to effect rotation of the turret to move the capping member from a non-capping first position to a second position at which the capping member is located in nozzle capping engagement with the at least one print head.

In a further aspect there is provided a printer, wherein the capping mechanism has:

a carrier positioned adjacent the at least one print head and having a longitudinal length corresponding substantially to that of the at least one print head, a longitudinally extending capping member pivotally mounted to the carrier and having a longitudinal length corresponding substantially to that of the at least one print head, and an actuating mechanism arranged to effect pivoting of the capping member from a non-capping first position to a second position at which the capping member is located in nozzle capping engagement with the at least one print head.

In a further aspect there is provided a printer, wherein:

the capping member is formed from a flexible sheet-like material and has a width corresponding substantially to the length of the at least one print head; and the second actuating mechanism is arranged to effect relative movement of the capping member and the at least one print head to a position at which the capping member is located in nozzle capping engagement with the at least one print head.

In a further aspect there is provided a printer, wherein the capping member is formed from a flexible sheet-like material and has a width corresponding substantially to the length of the at least one print head, the flexible sheet-like material being provided as a replaceable roll from which a portion of the material is in use drawn to locate, as the capping member, in nozzle capping engagement with the at least one print head.

In a further aspect there is provided a printer, wherein:

the capping member is formed from a flexible sheet-like material and has a width corresponding substantially to the length of the at least one print head, the flexible sheet-like material being provided as a replaceable roll from which a portion of the material is in use drawn to locate, as the capping member, in nozzle capping engagement with the at least one print head; and the capping mechanism further has a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one print head.

In a tenth aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping/purging mechanism having (i) at least one capping/purging member having a length corresponding substantially to that of the at least one print head, (ii) a first actuating mechanism arranged to move the at least one print head in a arcuate first direction from a first position to a second position and a third position, and (iii) a second actuating mechanism arranged to move the at least one capping/purging member in an arcuate second direction opposite to that of the first direction to effect nozzle capping engagement of the at least one print head when the at least one print head is in the second position and to permit purging of the nozzles when the at least one print head is in the third position.

Optionally the at least one capping/purging member is formed effectively as a one-piece member.

Optionally the at least one capping/purging member comprises conjoined member portions having an aggregate length corresponding substantially to that of the at least one print head.

Optionally the at least one capping/purging member comprises a body portion, a lip portion formed from an elastomeric material, a capping cavity surrounded by the lip portion, a purging chamber also surrounded by the lip portion, and wherein the lip portion is peripherally configured to surround the print head nozzles.

Optionally the capping cavity and the purging chamber form integral portions of the capping/purging member.

Optionally the purging chamber in the at least one capping/purging member is connected to a suction device.

Optionally the purging chamber is connected to the suction device by a way of an extractor tube.

Optionally the print heads are disposed in confronting relationship when in the first position.

In a further aspect there is provided a printer comprising:

(a) a pagewidth print head assembly having (i) two opposed pagewidth print heads and (ii) a plurality of nozzles located along each of the print heads and arranged in use to deliver ink onto print media as it is transported past the print heads, and (b) a capping/purging mechanism having (i) two capping members located adjacent respective ones of the print heads and having a length corresponding substantially to that of the print heads, (ii) first actuating mechanisms arranged to move the respective print heads in an arcuate first direction from a first to second and third positions and (iii) second actuating mechanisms arranged to move the capping members in an arcuate second direction opposite to that of the first direction to effect nozzle capping engagement of the respective print heads when the respective print heads are in the second position and to permit purging of the nozzles when the print heads are in the third position.

Optionally each said capping/purging member is formed effectively as a one-piece member.

Optionally each said capping/purging member comprises conjoined capping member portions having an aggregate length corresponding substantially to that of each of the print heads.

Optionally each said capping/purging member has a body portion, a lip portion formed from an elastomeric material, a capping cavity surrounded by the lip portion, a purging chamber also surrounded by the lip portion, and wherein the lip portion is peripherally configured to surround the print head nozzles.

Optionally the capping cavity and the purging chamber form integral portions of the capping/purging member.

Optionally the purging chamber in each said capping/purging member is connected to a suction device.

Optionally the purging chamber is connected to the suction device by a way of an extractor tube.

Optionally the print heads are disposed in confronting relationship when in the first position.

Optionally the second actuating mechanism is arranged to move the at least one capping/purging member in a direction normal to the at least one print head to effect nozzle capping engagement of the at least one print head when the at least one print head is in the second position.

Optionally the second actuating mechanism is arranged to move the at least one capping/purging member in a lateral direction relative to the at least one print head to effect nozzle capping engagement of the at least one print head when the at least one print head is in the second position.

In a further aspect there is provided a printer, wherein:

the pagewidth print head assembly has two opposed pagewidth print heads and a plurality of nozzles located along each of the print heads and arranged in use to deliver ink onto print media as it is transported past the print heads;

the capping/purging member is located adjacent the print heads and has a length corresponding substantially to that of the print heads;

the first actuating mechanism is arranged to effect relative movement of the print heads from the printing first position to a spaced-apart second position; and the second actuating mechanism is arranged to interpose the capping/purging member between the print heads to effect nozzle capping engagement of the two print heads when the print heads are in the second position.

In a further aspect there is provided a printer, wherein:

the capping/purging member is located in a non-capping first position adjacent the at least one print head;

the capping/purging mechanism further has purging means associated with the capping/purging member and arranged to receive material that is purged from the nozzle environment of the at least one print head; and the second actuating mechanism is arranged to effect transitioning of the capping/purging member from the non-capping first position to a second position at which the capping/purging member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping/purging mechanism has:

a capping member associated with each of the print heads, the capping members having lengths corresponding substantially to those of the print heads and each said capping member being moveable between a non-capping first position and a second position at which the capping member is located in nozzle capping engagement with the associated print head; and an actuating mechanism associated with each of the capping members and arranged to effect transitioning of each of the capping members from its first position to its second position.

In a further aspect there is provided a printer, wherein:

the pagewidth print head assembly has a single pagewidth print head; and the capping/purging member is located in a non-capping first position spaced-apart from the print head; and the second actuating mechanism is arranged to effect arcuate transitioning of the capping/purging member from the non-capping first position to a second position at which the capping/purging member is located in nozzle capping engagement with the print head.

In a further aspect there is provided a printer, wherein:

the pagewidth print head assembly has a single pagewidth print head;

the capping/purging member is located in a non-capping first position adjacent the print head;

the capping/purging mechanism further has purging means associated with the capping/purging member and arranged to receive material that is purged from the nozzle environment of the print head; and the second actuating mechanism is arranged to effect transitioning of the capping/purging member in an arcuate direction from the non-capping first position to a second position at which the capping/purging member is located in nozzle capping engagement with the print head.

In a further aspect there is provided a printer, wherein the capping/purging mechanism has:

a rotatable turret having a longitudinal length corresponding substantially to that of the at least one print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a printer, wherein the capping/purging mechanism has:

a rotatable turret having a longitudinal length corresponding substantially to that of the at least one print head, a longitudinally extending capping member carried by the turret, and an actuating mechanism arranged to effect rotation of the turret to move the capping member from a non-capping first position to a second position at which the capping member is located in nozzle capping engagement with the at least one print head.

In a further aspect there is provided a printer, wherein the capping/purging mechanism has:

a carrier positioned adjacent the at least one print head and having a longitudinal length corresponding substantially to that of the at least one print head, a longitudinally extending capping member pivotally mounted to the carrier and having a longitudinal length corresponding substantially to that of the at least one print head, and an actuating mechanism arranged to effect pivoting of the capping member from a non-capping first position to a second position at which the capping member is located in nozzle capping engagement with the at least one print head.

In a further aspect there is provided a printer, wherein:

the capping/purging member is formed from a flexible sheet-like material and has a width corresponding substantially to the length of the at least one print head; and the second actuating mechanism is arranged to effect relative movement of the capping/purging member and the at least one print head to a position at which the capping/purging member is located in nozzle capping engagement with the at least one print head.

In a further aspect there is provided a printer, wherein the capping/purging member is formed from a flexible sheet-like material and has a width corresponding substantially to the length of the at least one print head, the flexible sheet-like material being provided as a replaceable roll from which a portion of the material is in use drawn to locate, as the capping/purging member, in nozzle capping engagement with the at least one print head.

In a further aspect there is provided a printer, wherein:

the capping/purging member is formed from a flexible sheet-like material and has a width corresponding substantially to the length of the at least one print head, the flexible sheet-like material being provided as a replaceable roll from which a portion of the material is in use drawn to locate, as the capping/purging member, in nozzle capping engagement with the at least one print head; and the capping/purging mechanism further has a take-up reel arranged to take-up spent capping material following a capping operation.

In a further aspect there is provided a printer, wherein the capping/purging member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one print head.

In an eleventh aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping/purging mechanism associated with the at least one print head and comprising (i) a rotatable turret having a longitudinal length corresponding substantially to that of the at least one print head, (ii) a longitudinally extending capping member carried by the turret, (iii) a purging chamber carried by the turret and connected in fluid passage communication with a suction device, (iv) a first actuating mechanism arranged to effect rotation of the turret selectively to position the capping member or the purging chamber in alignment with the nozzles of the at least one print head, and (v) a second actuating mechanism arranged to effect movement of the turret whereby an aligned one of the capping member and the purging chamber is selectively positioned in engagement with the at least one print head.

Optionally a longitudinally extending platen also is carried by the turret and wherein the first actuating mechanism is arranged to effect rotation of the turret to a position at which the platen is located in aligned spaced-apart relationship with the at least one print head.

In a further aspect there is provided a printer comprising:

(a) a pagewidth print head assembly having (i) a pagewidth print head and (ii) a plurality of nozzles located along the print head and arranged in use to deliver ink onto print media as it is transported past the print head, and (b) a capping/purging mechanism associated with the print head and comprising (i) a rotatable turret having a longitudinal length corresponding substantially to that of the print head, (ii) a longitudinally extending capping member carried by the turret, (iii) a purging chamber carried by the turret and connected in fluid passage communication with a suction device, (iv) a first actuating mechanism arranged to effect rotation of the turret selectively to position the capping member or the purging chamber in alignment with the nozzles of the at least one print head, and (v) a second actuating mechanism arranged to effect movement of the turret whereby an aligned one of the capping member and the purging chamber is selectively positioned in engagement with the the print head.

Optionally a longitudinally extending platen also is carried by the turret and wherein the first actuating mechanism is arranged to effect rotation of the turret to a position at which the platen is located in aligned spaced-apart relationship with the print head.

Optionally the capping member is formed effectively as a one-piece member and has a length corresponding substantially to that of the print head.

Optionally the capping member comprises conjoined member portions having an aggregate length corresponding substantially to that of the print head.

Optionally the capping member comprises a body portion, a lip portion formed from an elastomeric material and a cavity surrounded by the lip portion, and wherein the lip portion is peripherally configured to surround the print head nozzles.

Optionally the purging chamber comprises a longitudinally extending member and has a length corresponding substantially to that of the print head.

Optionally the purging chamber comprises conjoined member portions having an aggregate length corresponding substantially to that of the print head.

Optionally the purging chamber comprises a body portion, a lip portion formed from an elastomeric material and a cavity surrounded by the lip portion, and wherein the lip portion is peripherally configured to surround the print head nozzles.

Optionally the turret has a generally triangular cross-section and wherein the platen, the capping member and the purging chamber are located on respective sides of the turret.

In a further aspect there is provided a printer, wherein the capping/purging mechanism has:

at least one capping member having a length corresponding substantially to that of the at least one print head, a first actuating mechanism arranged to move the at least one print head in an arcuate direction from a first to a second position; and a second actuating mechanism arranged to move the at least one capping member in a direction normal to the at least one print head to effect nozzle capping engagement of the at least one print head when the at least one print head is in the second position.

In a further aspect there is provided a printer, wherein the capping/purging mechanism has:

at least one capping member having a length corresponding substantially to that of the at least one print head, a first actuating mechanism arranged to move the at least one print head in an arcuate direction from a first to a second position; and a second actuating mechanism arranged to move the at least one capping member in a lateral direction relative to the at least one print head to effect nozzle capping engagement of the at least one print head when the at least one print head is in the second position.

In a further aspect there is provided a printer, wherein:

the pagewidth print head assembly has two opposed pagewidth print heads and a plurality of nozzles located along each of the print heads and arranged in use to deliver ink onto print media as it is transported past the print heads; and the capping/purging mechanism has:

a capping member located adjacent the print heads and having a length corresponding substantially to that of the print heads, a first actuating mechanism arranged to effect relative movement of the print heads from a printing first position to a spaced-apart second position, and a second actuating mechanism arranged to interpose the capping member between the print heads to effect nozzle capping engagement of the two print heads when the print heads are in the second position.

In a further aspect there is provided a printer, wherein:

the pagewidth print head assembly has a single pagewidth print head; and the capping/purging mechanism has:

a capping member having a length corresponding substantially to that of the print head and located in a non-capping first position spaced-apart from but confronting the print head, and a motor drive arranged for camming engagement with the capping member to effect its linear transitioning from the first position to a second position at which the capping member is located in nozzle capping engagement with the print head.

In a further aspect there is provided a printer, wherein the capping/purging mechanism has:

a capping member associated with the at least one print head, the capping member having a length corresponding substantially to that of the at least one print head and being located in a non-capping first position adjacent the at least one print head, purging means associated with the capping member and arranged to receive material that is purged from the nozzle environment of the at least one print head, and an actuating mechanism arranged to effect transitioning of the capping member from the first position to a second position at which the capping member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping/purging mechanism has:

a capping member associated with each of the print heads, the capping members having lengths corresponding substantially to those of the print heads and each said capping member being moveable between a non-capping first position and a second position at which the capping member is located in nozzle capping engagement with the associated print head, and an actuating mechanism associated with each of the capping members and arranged to effect transitioning of each of the capping members from its first position to its second position.

In a further aspect there is provided a printer, wherein:

the pagewidth print head assembly has a single pagewidth print head; and the capping/purging mechanism has:

a capping member having a length corresponding substantially to that of the print head and located in a non-capping first position spaced-apart from the print head, and an actuating mechanism arranged to effect arcuate transitioning of the capping member from the first position to a second position at which the capping member is located in nozzle capping engagement with the print head.

In a further aspect there is provided a printer, wherein:

the pagewidth print head assembly has a single pagewidth print head; and the capping/purging mechanism has:

a capping member associated with the print head, the capping member having a length corresponding substantially to that of the print head and being located in a non-capping first position adjacent the print head, purging means associated with the capping member and arranged to receive material that is purged from the nozzle environment of the print head, and an actuating mechanism arranged to effect transitioning of the capping member in an arcuate direction from the first position to a second position at which the capping member is located in nozzle capping engagement with the print head.

In a further aspect there is provided a printer, wherein the capping/purging mechanism has:

at least one capping member having a length corresponding substantially to that of the at least one print head, a first actuating mechanism arranged to move the at least one print head in a arcuate first direction from a first to a second position, and a second actuating mechanism arranged to move the at least one capping member in an arcuate second direction opposite to that of the first direction to effect nozzle capping engagement of the at least one print head when the at least one print head is in the second position.

In a further aspect there is provided a printer, wherein the capping/purging mechanism has:

at least one capping/purging member having a length corresponding substantially to that of the at least one print head, a first actuating mechanism arranged to move the at least one print head in a arcuate first direction from a first position to a second position and a third position, and a second actuating mechanism arranged to move the at least one capping/purging member in an arcuate second direction opposite to that of the first direction to effect nozzle capping engagement of the at least one print head when the at least one print head is in the second position and to permit purging of the nozzles when the at least one print head is in the third position.

In a further aspect there is provided a printer, wherein the second actuating mechanism is arranged to effect rotation of the turret to move the capping member from a non-capping first position to a second position at which the capping member is located in nozzle capping engagement with the at least one print head.

In a further aspect there is provided a printer, wherein the capping/purging mechanism has:

a carrier positioned adjacent the at least one print head and having a longitudinal length corresponding substantially to that of the at least one print head, a longitudinally extending capping member pivotally mounted to the carrier and having a longitudinal length corresponding substantially to that of the at least one print head, and an actuating mechanism arranged to effect pivoting of the capping member from a non-capping first position to a second position at which the capping member is located in nozzle capping engagement with the at least one print head.

In a further aspect there is provided a printer, wherein the capping/purging mechanism has:

a capping member formed from a flexible sheet-like material and having a width corresponding substantially to the length of the at least one print head, and an actuating mechanism arranged to effect relative movement of the capping member and the at least one print head to a position at which the capping member is located in nozzle capping engagement with the at least one print head.

In a further aspect there is provided a printer, wherein the capping/purging mechanism has a capping member formed from a flexible sheet-like material and having a width corresponding substantially to the length of the at least one print head, the flexible sheet-like material being provided as a replaceable roll from which a portion of the material is in use drawn to locate, as the capping member, in nozzle capping engagement with the at least one print head.

In a further aspect there is provided a printer, wherein the capping/purging mechanism has:

a capping member formed from a flexible sheet-like material and having a width corresponding substantially to the length of the at least one print head, the flexible sheet-like material being provided as a replaceable roll from which a portion of the material is in use drawn to locate, as the capping member, in nozzle capping engagement with the at least one print head, and a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one print head.

In a twelfth aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping mechanism associated with the at least one print head and comprising (i) a rotatable turret having a longitudinal length corresponding substantially to that of the at least one print head, (ii) a longitudinally extending capping member carried by the turret and (iii) an actuating mechanism arranged to effect rotation of the turret to move the capping member from a non-capping first position to a second position at which the capping member is located in nozzle capping engagement with the at least one print head.

Optionally the turret incorporates a purging chamber which is aligned with the print head nozzles when the capping member is in the first position.

In a further aspect there is provided a printer comprising:

(a) a pagewidth print head assembly having (i) a pagewidth print head and (ii) a plurality of nozzles located along the print head and arranged in use to deliver ink onto print media as it is transported past the print head, and (b) a capping mechanism associated with the print head and comprising (i) a rotatable turret having a longitudinal length corresponding substantially to that of the print head, (ii) a longitudinally extending capping member carried by the turret and (iii) an actuating mechanism arranged to effect rotation of the turret to move the capping member from a non-capping first position to a second position at which the capping member is located in nozzle capping engagement with the print head.

Optionally the turret incorporates a purging chamber which is aligned with the print head nozzles when the capping member is in the first position.

Optionally the turret has a longitudinally extending substantially flat land portion that locates adjacent the print head when the capping member is in the non-capping first position.

Optionally the capping member is carried by an eccentric land portion of the turret.

Optionally the purging chamber is located interiorly of the turret.

Optionally the purging chamber opens to the flat land portion of the turret by way of a port.

Optionally the purging chamber is connected to a suction device.

Optionally the flat land portion of the turret effectively forms a platen when the capping member is in the first position.

Optionally the capping member is formed effectively as a one-piece member and has a length corresponding substantially to that of the print head.

Optionally the capping member comprises a body portion, a lip portion formed from an elastomeric material and a cavity surrounded by the lip portion, and wherein the lip portion is peripherally configured to surround the print head nozzles.

Optionally the capping member comprises conjoined member portions having an aggregate length corresponding substantially to that of the print head.

Optionally the capping member is carried by an eccentric land portion of the turret.

In a further aspect there is provided a printer, wherein the capping mechanism has:

at least one capping member having a length corresponding substantially to that of the at least one print head, a first actuating mechanism arranged to move the at least one print head in an arcuate direction from a first to a second position; and a second actuating mechanism arranged to move the at least one capping member in a direction normal to the at least one print head to effect nozzle capping engagement of the at least one print head when the at least one print head is in the second position.

In a further aspect there is provided a printer, wherein the capping mechanism has:

at least one capping member having a length corresponding substantially to that of the at least one print head, a first actuating mechanism arranged to move the at least one print head in an arcuate direction from a first to a second position; and a second actuating mechanism arranged to move the at least one capping member in a lateral direction relative to the at least one print head to effect nozzle capping engagement of the at least one print head when the at least one print head is in the second position.

In a further aspect there is provided a printer, wherein:

the pagewidth print head assembly has two opposed pagewidth print heads and a plurality of nozzles located along each of the print heads and arranged in use to deliver ink onto print media as it is transported past the print heads; and the capping mechanism has:

a capping member located adjacent the print heads and having a length corresponding substantially to that of the print heads, a first actuating mechanism arranged to effect relative movement of the print heads from a printing first position to a spaced-apart second position, and a second actuating mechanism arranged to interpose the capping member between the print heads to effect nozzle capping engagement of the two print heads when the print heads are in the second position.

In a further aspect there is provided a printer, wherein:

the pagewidth print head assembly has a single pagewidth print head; and the capping mechanism has:

a capping member having a length corresponding substantially to that of the print head and located in a non-capping first position spaced-apart from but confronting the print head, and a motor drive arranged for camming engagement with the capping member to effect its linear transitioning from the first position to a second position at which the capping member is located in nozzle capping engagement with the print head.

In a further aspect there is provided a printer, wherein the capping mechanism has:

a capping member associated with the at least one print head, the capping member having a length corresponding substantially to that of the at least one print head and being located in a non-capping first position adjacent the at least one print head, purging means associated with the capping member and arranged to receive material that is purged from the nozzle environment of the at least one print head, and an actuating mechanism arranged to effect transitioning of the capping member from the first position to a second position at which the capping member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping mechanism has:

a capping member associated with each of the print heads, the capping members having lengths corresponding substantially to those of the print heads and each said capping member being moveable between a non-capping first position and a second position at which the capping member is located in nozzle capping engagement with the associated print head, and an actuating mechanism associated with each of the capping members and arranged to effect transitioning of each of the capping members from its first position to its second position.

In a further aspect there is provided a printer, wherein:

the pagewidth print head assembly has a single pagewidth print head; and the capping mechanism has:

a capping member having a length corresponding substantially to that of the print head and located in a non-capping first position spaced-apart from the print head, and an actuating mechanism arranged to effect arcuate transitioning of the capping member from the first position to a second position at which the capping member is located in nozzle capping engagement with the print head.

In a further aspect there is provided a printer, wherein:

the pagewidth print head assembly has a single pagewidth print head; and the capping mechanism has:

a capping member associated with the print head, the capping member having a length corresponding substantially to that of the print head and being located in a non-capping first position adjacent the print head, purging means associated with the capping member and arranged to receive material that is purged from the nozzle environment of the print head, and an actuating mechanism arranged to effect transitioning of the capping member in an arcuate direction from the first position to a second position at which the capping member is located in nozzle capping engagement with the print head.

In a further aspect there is provided a printer, wherein the capping mechanism has:

at least one capping member having a length corresponding substantially to that of the at least one print head, a first actuating mechanism arranged to move the at least one print head in a arcuate first direction from a first to a second position, and a second actuating mechanism arranged to move the at least one capping member in an arcuate second direction opposite to that of the first direction to effect nozzle capping engagement of the at least one print head when the at least one print head is in the second position.

In a further aspect there is provided a printer, wherein the capping mechanism has:

at least one capping member having a length corresponding substantially to that of the at least one print head, a first actuating mechanism arranged to move the at least one print head in a arcuate first direction from a first position to a second position and a third position, and a second actuating mechanism arranged to move the at least one capping member in an arcuate second direction opposite to that of the first direction to effect nozzle capping engagement of the at least one print head when the at least one print head is in the second position and to permit purging of the nozzles when the at least one print head is in the third position.

In a further aspect there is provided a printer, wherein the capping mechanism has:

a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a printer, wherein the capping mechanism has:

a carrier positioned adjacent the at least one print head and having a longitudinal length corresponding substantially to that of the at least one print head, a longitudinally extending capping member pivotally mounted to the carrier and having a longitudinal length corresponding substantially to that of the at least one print head, and an actuating mechanism arranged to effect pivoting of the capping member from a non-capping first position to a second position at which the capping member is located in nozzle capping engagement with the at least one print head.

In a further aspect there is provided a printer, wherein the capping mechanism has:

a capping member formed from a flexible sheet-like material and having a width corresponding substantially to the length of the at least one print head, and an actuating mechanism arranged to effect relative movement of the capping member and the at least one print head to a position at which the capping member is located in nozzle capping engagement with the at least one print head.

In a further aspect there is provided a printer, wherein the capping mechanism has a capping member formed from a flexible sheet-like material and having a width corresponding substantially to the length of the at least one print head, the flexible sheet-like material being provided as a replaceable roll from which a portion of the material is in use drawn to locate, as the capping member, in nozzle capping engagement with the at least one print head.

In a further aspect there is provided a printer, wherein the capping mechanism has:

a capping member formed from a flexible sheet-like material and having a width corresponding substantially to the length of the at least one print head, the flexible sheet-like material being provided as a replaceable roll from which a portion of the material is in use drawn to locate, as the capping member, in nozzle capping engagement with the at least one print head, and a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one print head.

In a thirteenth aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping mechanism associated with the at least one print head and comprising (i) a carrier positioned adjacent the at least one print head and having a longitudinal length corresponding substantially to that of the at least one print head, (ii) a longitudinally extending capping member pivotally mounted to the carrier and having a longitudinal length corresponding substantially to that of the at least one print head, and (iii) an actuating mechanism arranged to effect pivoting of the capping member from a non-capping first position to a second position at which the capping member is located in nozzle capping engagement with the at least one print head.

Optionally the carrier incorporates a purging chamber into which material may be purged from the print head nozzles.

In a further aspect there is provided a printer comprising:

(a) a pagewidth print head assembly having (i) a pagewidth print head and (ii) a plurality of nozzles located along the print head and arranged in use to deliver ink onto print media as it is transported past the print head, and (b) a capping mechanism associated with the print head and comprising (i) a carrier positioned adjacent the print head and having a longitudinal length corresponding substantially to that of the print head, (ii) a longitudinally extending capping member pivotally mounted to the carrier and having a longitudinal length corresponding substantially to that of the print head, and (iii) an actuating mechanism arranged to effect pivoting of the capping member from a non-capping first position to a second position at which the capping member is located in nozzle capping engagement with the print head.

Optionally the carrier incorporates a purging chamber into which material may be purged from the print head nozzles.

Optionally the purging chamber is connected to a suction device.

Optionally the carrier is positioned in confronting relationship to the print head and is spaced from the print head to form a lower margin of a passage for print media that, in use, is transported past the print head Optionally the capping member comprises a body portion, a lip portion formed from an elastomeric material and a cavity surrounded by the lip portion, and wherein the lip portion is peripherally configured to surround the print head nozzles.

In a further aspect there is provided a printer, wherein the capping mechanism has:

at least one capping member having a length corresponding substantially to that of the at least one print head, a first actuating mechanism arranged to move the at least one print head in an arcuate direction from a first to a second position; and a second actuating mechanism arranged to move the at least one capping member in a direction normal to the at least one print head to effect nozzle capping engagement of the at least one print head when the at least one print head is in the second position.

In a further aspect there is provided a printer, wherein the capping mechanism has:

at least one capping member having a length corresponding substantially to that of the at least one print head, a first actuating mechanism arranged to move the at least one print head in an arcuate direction from a first to a second position; and a second actuating mechanism arranged to move the at least one capping member in a lateral direction relative to the at least one print head to effect nozzle capping engagement of the at least one print head when the at least one print head is in the second position.

In a further aspect there is provided a printer, wherein:

the pagewidth print head assembly has two opposed pagewidth print heads and a plurality of nozzles located along each of the print heads and arranged in use to deliver ink onto print media as it is transported past the print heads; and the capping mechanism has:

a capping member located adjacent the print heads and having a length corresponding substantially to that of the print heads, a first actuating mechanism arranged to effect relative movement of the print heads from a printing first position to a spaced-apart second position, and a second actuating mechanism arranged to interpose the capping member between the print heads to effect nozzle capping engagement of the two print heads when the print heads are in the second position.

In a further aspect there is provided a printer, wherein:

the pagewidth print head assembly has a single pagewidth print head; and the capping mechanism has:

a capping member having a length corresponding substantially to that of the print head and located in a non-capping first position spaced-apart from but confronting the print head, and a motor drive arranged for camming engagement with the capping member to effect its linear transitioning from the first position to a second position at which the capping member is located in nozzle capping engagement with the print head.

In a further aspect there is provided a printer, wherein the capping mechanism has:

a capping member associated with the at least one print head, the capping member having a length corresponding substantially to that of the at least one print head and being located in a non-capping first position adjacent the at least one print head, purging means associated with the capping member and arranged to receive material that is purged from the nozzle environment of the at least one print head, and an actuating mechanism arranged to effect transitioning of the capping member from the first position to a second position at which the capping member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping mechanism has:

a capping member associated with each of the print heads, the capping members having lengths corresponding substantially to those of the print heads and each said capping member being moveable between a non-capping first position and a second position at which the capping member is located in nozzle capping engagement with the associated print head, and an actuating mechanism associated with each of the capping members and arranged to effect transitioning of each of the capping members from its first position to its second position.

In a further aspect there is provided a printer, wherein:

the pagewidth print head assembly has a single pagewidth print head; and the capping mechanism has:

a capping member having a length corresponding substantially to that of the print head and located in a non-capping first position spaced-apart from the print head, and an actuating mechanism arranged to effect arcuate transitioning of the capping member from the first position to a second position at which the capping member is located in nozzle capping engagement with the print head.

In a further aspect there is provided a printer, wherein:

the pagewidth print head assembly has a single pagewidth print head; and the capping mechanism has:

a capping member associated with the print head, the capping member having a length corresponding substantially to that of the print head and being located in a non-capping first position adjacent the print head, purging means associated with the capping member and arranged to receive material that is purged from the nozzle environment of the print head, and an actuating mechanism arranged to effect transitioning of the capping member in an arcuate direction from the first position to a second position at which the capping member is located in nozzle capping engagement with the print head.

In a further aspect there is provided a printer, wherein the capping mechanism has:

at least one capping member having a length corresponding substantially to that of the at least one print head, a first actuating mechanism arranged to move the at least one print head in a arcuate first direction from a first to a second position, and a second actuating mechanism arranged to move the at least one capping member in an arcuate second direction opposite to that of the first direction to effect nozzle capping engagement of the at least one print head when the at least one print head is in the second position.

In a further aspect there is provided a printer, wherein the capping mechanism has:

at least one capping member having a length corresponding substantially to that of the at least one print head, a first actuating mechanism arranged to move the at least one print head in a arcuate first direction from a first position to a second position and a third position, and a second actuating mechanism arranged to move the at least one capping member in an arcuate second direction opposite to that of the first direction to effect nozzle capping engagement of the at least one print head when the at least one print head is in the second position and to permit purging of the nozzles when the at least one print head is in the third position.

In a further aspect there is provided a printer, wherein the capping mechanism has:

a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a printer, wherein the capping mechanism has:

a rotatable turret having a longitudinal length corresponding substantially to that of the at least one print head, a longitudinally extending capping member carried by the turret, and an actuating mechanism arranged to effect rotation of the turret to move the capping member from a non-capping first position to a second position at which the capping member is located in nozzle capping engagement with the at least one print head.

In a further aspect there is provided a printer, wherein the capping mechanism has:

a capping member formed from a flexible sheet-like material and having a width corresponding substantially to the length of the at least one print head, and an actuating mechanism arranged to effect relative movement of the capping member and the at least one print head to a position at which the capping member is located in nozzle capping engagement with the at least one print head.

In a further aspect there is provided a printer, wherein the capping mechanism has a capping member formed from a flexible sheet-like material and having a width corresponding substantially to the length of the at least one print head, the flexible sheet-like material being provided as a replaceable roll from which a portion of the material is in use drawn to locate, as the capping member, in nozzle capping engagement with the at least one print head.

In a further aspect there is provided a printer, wherein the capping mechanism has:

a capping member formed from a flexible sheet-like material and having a width corresponding substantially to the length of the at least one print head, the flexible sheet-like material being provided as a replaceable roll from which a portion of the material is in use drawn to locate, as the capping member, in nozzle capping engagement with the at least one print head, and a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one print head.

In a fourteenth aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping mechanism associated with the at least one print head and comprising i) a capping member formed from a flexible sheet-like material and having a width corresponding substantially to the length of the at least one print head, and ii) an actuating mechanism arranged to effect relative movement of the capping member and the at least one print head to a position at which the capping member is located in nozzle capping engagement with the at least one print head.

In a further aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping mechanism associated with the at least one print head and comprising i) a capping member formed from a flexible sheet-like material and having a width corresponding substantially to the length of the at least one print head, and ii) an actuating mechanism arranged to position the capping member in nozzle capping engagement with the at least one print head.

In a further aspect the present invention provides printer comprising:

(a) a pagewidth print head assembly having (i) two pagewidth print heads and (ii) a plurality of nozzles located along each of the print heads and arranged in use to deliver ink onto print media as it is transported between the print heads, and (b) a capping mechanism associated with the print heads and comprising i) a capping member formed from a flexible sheet-like material and having a width corresponding substantially to the length of the print heads, and ii) an actuating mechanism arranged to position the capping member between the two print heads and in nozzle capping engagement with the print heads.

Optionally the capping member comprises a single layer sheet-like material.

Optionally the capping member comprises a multi-layer sheet-like material.

Optionally the capping member comprises a compressible sheet-like material.

Optionally fluid delivery means are provided for delivering a fluid to a region between the multiple layers of the capping member.

Optionally the capping member is formed from a sheet-like material having hydrophobic properties.

Optionally the capping member is formed from a closed cell thermoplastics material.

Optionally the capping member is formed from a sheet-like material having hydrophilic properties.

Optionally the capping member is formed from an open cell silicone material.

In a further aspect there is provided a printer, wherein the capping mechanism has:

a first actuating mechanism arranged to move the at least one print head in an arcuate direction from a first to a second position, and a second actuating mechanism arranged to move the at least one capping member in a direction normal to the at least one print head to effect nozzle capping engagement of the at least one print head when the at least one print head is in the second position.

In a further aspect there is provided a printer, wherein the capping mechanism has:

a first actuating mechanism arranged to move the at least one print head in an arcuate direction from a first to a second position, and a second actuating mechanism arranged to move the at least one capping member in a lateral direction relative to the at least one print head to effect nozzle capping engagement of the at least one print head when the at least one print head is in the second position.

In a further aspect there is provided a printer, wherein:

the pagewidth print head assembly has two opposed pagewidth print heads and a plurality of nozzles located along each of the print heads and arranged in use to deliver ink onto print media as it is transported past the print heads;

the capping member is located adjacent the print heads and has a length corresponding substantially to that of the print heads; and the capping mechanism has:

a first actuating mechanism arranged to effect relative movement of the print heads from a printing first position to a spaced-apart second position; and a second actuating mechanism arranged to interpose the capping member between the print heads to effect nozzle capping engagement of the two print heads when the print heads are in the second position.

In a further aspect there is provided a printer, wherein:

the pagewidth print head assembly has a single pagewidth print head;

the capping member is located in a non-capping first position spaced-apart from but confronting the print head; and the capping mechanism further has a motor drive arranged for camming engagement with the capping member to effect its linear transitioning from the non-capping first position to a second position at which the capping member is located in nozzle capping engagement with the print head.

In a further aspect there is provided a printer, wherein:

the capping member is located in a non-capping first position adjacent the at least one print head;

the capping mechanism further has purging means associated with the capping member and arranged to receive material that is purged from the nozzle environment of the at least one print head; and the actuating mechanism is arranged to effect transitioning of the capping member from the non-capping first position to a second position at which the capping member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping mechanism has:

a capping member associated with each of the print heads, the capping members having lengths corresponding substantially to those of the print heads and each said capping member being moveable between a non-capping first position and a second position at which the capping member is located in nozzle capping engagement with the associated print head; and an actuating mechanism associated with each of the capping members and arranged to effect transitioning of each of the capping members from its first position to its second position.

In a further aspect there is provided a printer, wherein:

the pagewidth print head assembly has a single pagewidth print head;

the capping member is located in a non-capping first position spaced-apart from the print head; and the actuating mechanism is arranged to effect arcuate transitioning of the capping member from the non-capping first position to a second position at which the capping member is located in nozzle capping engagement with the print head.

In a further aspect there is provided a printer, wherein:

the pagewidth print head assembly has a single pagewidth print head;

the capping member is located in a non-capping first position adjacent the print head;

the capping mechanism further has purging means associated with the capping member and arranged to receive material that is purged from the nozzle environment of the print head; and the actuating mechanism is arranged to effect transitioning of the capping member in an arcuate direction from the non-capping first position to a second position at which the capping member is located in nozzle capping engagement with the print head.

In a further aspect there is provided a printer, wherein the capping mechanism has:

a first actuating mechanism arranged to move the at least one print head in a arcuate first direction from a first to a second position; and a second actuating mechanism arranged to move the at least one capping member in an arcuate second direction opposite to that of the first direction to effect nozzle capping engagement of the at least one print head when the at least one print head is in the second position.

In a further aspect there is provided a printer, wherein the capping mechanism has:

a first actuating mechanism arranged to move the at least one print head in a arcuate first direction from a first position to a second position and a third position, and a second actuating mechanism arranged to move the at least one capping member in an arcuate second direction opposite to that of the first direction to effect nozzle capping engagement of the at least one print head when the at least one print head is in the second position and to permit purging of the nozzles when the at least one print head is in the third position.

In a further aspect there is provided a printer, wherein the capping mechanism has:

a rotatable turret having a longitudinal length corresponding substantially to that of the at least one print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a printer, wherein the capping mechanism has:

a rotatable turret having a longitudinal length corresponding substantially to that of the at least one print head, a longitudinally extending capping member carried by the turret, and an actuating mechanism arranged to effect rotation of the turret to move the capping member from a non-capping first position to a second position at which the capping member is located in nozzle capping engagement with the at least one print head.

In a further aspect there is provided a printer, wherein the capping mechanism has:

a carrier positioned adjacent the at least one print head and having a longitudinal length corresponding substantially to that of the at least one print head, a longitudinally extending capping member pivotally mounted to the carrier and having a longitudinal length corresponding substantially to that of the at least one print head, and an actuating mechanism arranged to effect pivoting of the capping member from a non-capping first position to a second position at which the capping member is located in nozzle capping engagement with the at least one print head.

In a further aspect there is provided a printer, wherein the flexible sheet-like material is provided as a replaceable roll from which a portion of the material is in use drawn to locate, as the capping member, in nozzle capping engagement with the at least one print head.

In a further aspect there is provided a printer, wherein:

the flexible sheet-like material is provided as a replaceable roll from which a portion of the material is in use drawn to locate, as the capping member, in nozzle capping engagement with the at least one print head; and the capping mechanism further has a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one print head.

In a fifteenth aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping mechanism associated with the at least one print head and comprising a capping member formed from a flexible sheet-like material and having a width corresponding substantially to the length of the at least one print head, the flexible sheet-like material being provided as a replaceable roll from which a portion of the material is in use drawn to locate, as the capping member, in nozzle capping engagement with the at least one print head.

Optionally the capping member comprises a single layer sheet-like material.

Optionally the capping member comprises a multi-layer sheet-like material.

Optionally the capping member comprises a compressible sheet-like material.

Optionally the capping member is formed from a sheet-like material having hydrophobic properties.

Optionally the capping member is formed from a closed cell thermoplastics material.

Optionally the capping member is formed from a sheet-like material having hydrophilic properties.

Optionally the capping member is formed from an open cell silicone material.

Optionally a cutter mechanism is provided for selectively cutting the portion of the material from the replaceable roll.

In a further aspect there is provided a printer comprising:

(a) a pagewidth print head assembly having (i) a pagewidth print head and (ii) a plurality of nozzles located along the print head and arranged in use to deliver ink onto print media as it is transported past the print head, and (b) a capping mechanism associated with the print head and comprising (i) a capping member formed from a flexible sheet-like material and having a width corresponding substantially to the length of the print head, the flexible sheet-like material being provided as a replaceable roll from which a portion of the material is in use drawn to form the capping member, and ii) a platen positioned adjacent the print head and arranged to engage with and position the capping member in nozzle capping engagement with the print head.

Optionally the capping member comprises a single layer sheet-like material.

Optionally the capping member comprises a multi-layer sheet-like material.

Optionally the capping member comprises a compressible sheet-like material.

Optionally the capping member is formed from a sheet-like material having hydrophobic properties.

Optionally the capping member is formed from a closed cell thermoplastics material.

Optionally the capping member is formed from a sheet-like material having hydrophilic properties.

Optionally the capping member is formed from an open cell silicone material.

Optionally a cutter mechanism is provided for selectively cutting the portion of the material from the replaceable roll.

Optionally an actuating mechanism is provided to effect movement of the platen whereby it causes the capping member to move into nozzle capping engagement with the print head.

In a further aspect there is provided a printer, wherein the capping mechanism has a first actuating mechanism arranged to move the at least one print head in an arcuate direction from a first to a second position, and a second actuating mechanism arranged to move the at least one capping member in a direction normal to the at least one print head to effect nozzle capping engagement of the at least one print head when the at least one print head is in the second position.

In a further aspect there is provided a printer, wherein the capping mechanism has:

a first actuating mechanism arranged to move the at least one print head in an arcuate direction from a first to a second position, and a second actuating mechanism arranged to move the at least one capping member in a lateral direction relative to the at least one print head to effect nozzle capping engagement of the at least one print head when the at least one print head is in the second position.

In a further aspect there is provided a printer, wherein:

the pagewidth print head assembly has two opposed pagewidth print heads and a plurality of nozzles located along each of the print heads and arranged in use to deliver ink onto print media as it is transported past the print heads;

the capping member is located adjacent the print heads and has a length corresponding substantially to that of the print heads; and the capping mechanism has:

a first actuating mechanism arranged to effect relative movement of the print heads from a printing first position to a spaced-apart second position; and a second actuating mechanism arranged to interpose the capping member between the print heads to effect nozzle capping engagement of the two print heads when the print heads are in the second position.

In a further aspect there is provided a printer, wherein:

the pagewidth print head assembly has a single pagewidth print head;

the capping member is located in a non-capping first position spaced-apart from but confronting the print head; and the capping mechanism further has a motor drive arranged for camming engagement with the capping member to effect its linear transitioning from the non-capping first position to a second position at which the capping member is located in nozzle capping engagement with the print head.

In a further aspect there is provided a printer, wherein:

the capping member is located in a non-capping first position adjacent the at least one print head; and the capping mechanism further has:

purging means associated with the capping member and arranged to receive material that is purged from the nozzle environment of the at least one print head; and an actuating mechanism arranged to effect transitioning of the capping member from the non-capping first position to a second position at which the capping member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping mechanism has:

a capping member associated with each of the print heads, the capping members having lengths corresponding substantially to those of the print heads and each said capping member being moveable between a non-capping first position and a second position at which the capping member is located in nozzle capping engagement with the associated print head; and an actuating mechanism associated with each of the capping members and arranged to effect transitioning of each of the capping members from its first position to its second position.

In a further aspect there is provided a printer, wherein:

the pagewidth print head assembly has a single pagewidth print head;

the capping member is located in a non-capping first position spaced-apart from the print head; and the capping mechanism has an actuating mechanism arranged to effect arcuate transitioning of the capping member from the non-capping first position to a second position at which the capping member is located in nozzle capping engagement with the print head.

In a further aspect there is provided a printer, wherein:

the pagewidth print head assembly has a single pagewidth print head;

the capping member is located in a non-capping first position adjacent the print head; and the capping mechanism further has:

purging means associated with the capping member and arranged to receive material that is purged from the nozzle environment of the print head; and an actuating mechanism arranged to effect transitioning of the capping member in an arcuate direction from the non-capping first position to a second position at which the capping member is located in nozzle capping engagement with the print head.

In a further aspect there is provided a printer, wherein the capping mechanism has:

a first actuating mechanism arranged to move the at least one print head in a arcuate first direction from a first to a second position; and a second actuating mechanism arranged to move the at least one capping member in an arcuate second direction opposite to that of the first direction to effect nozzle capping engagement of the at least one print head when the at least one print head is in the second position.

In a further aspect there is provided a printer, wherein the capping mechanism has:

a first actuating mechanism arranged to move the at least one print head in a arcuate first direction from a first position to a second position and a third position, and a second actuating mechanism arranged to move the at least one capping member in an arcuate second direction opposite to that of the first direction to effect nozzle capping engagement of the at least one print head when the at least one print head is in the second position and to permit purging of the nozzles when the at least one print head is in the third position.

In a further aspect there is provided a printer, wherein the capping mechanism has:

a rotatable turret having a longitudinal length corresponding substantially to that of the at least one print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a printer, wherein the capping mechanism has:

a rotatable turret having a longitudinal length corresponding substantially to that of the at least one print head, a longitudinally extending capping member carried by the turret, and an actuating mechanism arranged to effect rotation of the turret to move the capping member from a non-capping first position to a second position at which the capping member is located in nozzle capping engagement with the at least one print head.

In a further aspect there is provided a printer, wherein the capping mechanism has:

a carrier positioned adjacent the at least one print head and having a longitudinal length corresponding substantially to that of the at least one print head, a longitudinally extending capping member pivotally mounted to the carrier and having a longitudinal length corresponding substantially to that of the at least one print head, and an actuating mechanism arranged to effect pivoting of the capping member from a non-capping first position to a second position at which the capping member is located in nozzle capping engagement with the at least one print head.

In a further aspect there is provided a printer, wherein the capping mechanism further has an actuating mechanism arranged to effect relative movement of the capping member and the at least one print head to a position at which the capping member is located in nozzle capping engagement with the at least one print head.

In a further aspect there is provided a printer, wherein the capping mechanism further has a take-up reel arranged to take-up spent capping material following a capping operation.

In a further aspect there is provided a printer, wherein the capping member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one print head.

In a sixteenth aspect the present invention provides a printer comprising:

(a) a pagewidth print head assembly having (i) at least one pagewidth print head and (ii) a plurality of nozzles located along the at least one print head and arranged in use to deliver ink onto print media as it is transported past the at least one print head, and (b) a capping mechanism associated with the at least one print head and comprising (i) a capping member formed from a flexible sheet-like material and having a width corresponding substantially to the length of the at least one print head, the flexible sheet-like material being provided as a replaceable roll from which a portion of the material is in use drawn to locate, as the capping member, in nozzle capping engagement with the at least one print head, and (ii) a take-up reel arranged to take-up spent capping material following a capping operation.

Optionally the capping member comprises a single layer sheet-like material.

Optionally the capping member comprises a multi-layer sheet-like material.

Optionally the capping member comprises a compressible sheet-like material.

Optionally the capping member is formed from a sheet-like material having hydrophobic properties.

Optionally the capping member is formed from a closed cell thermoplastics material.

Optionally the capping member is formed from a sheet-like material having hydrophilic properties.

Optionally the capping member is formed from an open cell silicone material.

In a further aspect there is provided a printer comprising:

(a) a pagewidth print head assembly having (i) a pagewidth print head and (ii) a plurality of nozzles located along the print head and arranged in use to deliver ink onto print media as it is transported past the print head, and (b) a capping mechanism associated with the print head and comprising (i) a capping member formed from a flexible sheet-like material and having a width corresponding substantially to the length of the print head, the flexible sheet-like material being provided as a replaceable roll from which a portion of the material is in use drawn to locate, as the capping member, in nozzle capping engagement with the print head, ii) a platen positioned adjacent the print head and arranged to engage with and position the capping member in nozzle capping engagement with the print head, and (iii) a take-up reel arranged to take-up spent capping material following a capping operation, and Optionally the capping member comprises a single layer sheet-like material.

Optionally the capping member comprises a multi-layer sheet-like material.

Optionally the capping member comprises a compressible sheet-like material.

Optionally the capping member is formed from a sheet-like material having hydrophobic properties.

Optionally the capping member is formed from a closed cell thermoplastics material.

Optionally the capping member is formed from a sheet-like material having hydrophilic properties.

Optionally the capping member is formed from an open cell silicone material.

In a further aspect there is provided a printer, wherein the capping mechanism has:

a first actuating mechanism arranged to move the at least one print head in an arcuate direction from a first to a second position, and a second actuating mechanism arranged to move the at least one capping member in a direction normal to the at least one print head to effect nozzle capping engagement of the at least one print head when the at least one print head is in the second position.

In a further aspect there is provided a printer, wherein the capping mechanism has:

a first actuating mechanism arranged to move the at least one print head in an arcuate direction from a first to a second position, and a second actuating mechanism arranged to move the at least one capping member in a lateral direction relative to the at least one print head to effect nozzle capping engagement of the at least one print head when the at least one print head is in the second position.

In a further aspect there is provided a printer, wherein:

the pagewidth print head assembly has two opposed pagewidth print heads and a plurality of nozzles located along each of the print heads and arranged in use to deliver ink onto print media as it is transported past the print heads;

the capping member is located adjacent the print heads and has a length corresponding substantially to that of the print heads; and the capping mechanism has:

a first actuating mechanism arranged to effect relative movement of the print heads from a printing first position to a spaced-apart second position; and a second actuating mechanism arranged to interpose the capping member between the print heads to effect nozzle capping engagement of the two print heads when the print heads are in the second position.

In a further aspect there is provided a printer, wherein:

the pagewidth print head assembly has a single pagewidth print head;

the capping member is located in a non-capping first position spaced-apart from but confronting the print head; and the capping mechanism further has a motor drive arranged for camming engagement with the capping member to effect its linear transitioning from the non-capping first position to a second position at which the capping member is located in nozzle capping engagement with the print head.

In a further aspect there is provided a printer, wherein:

the capping member is located in a non-capping first position adjacent the at least one print head; and the capping mechanism further has:

purging means associated with the capping member and arranged to receive material that is purged from the nozzle environment of the at least one print head; and an actuating mechanism arranged to effect transitioning of the capping member from the non-capping first position to a second position at which the capping member is located in nozzle capping engagement with the print head.

In a further aspect there is provided a printer, wherein:

the pagewidth print head assembly has two offset pagewidth print heads and a plurality of nozzles located along each of the print heads and arranged in use to deliver ink onto print media as it is transported past the print heads; and the capping mechanism has:

a capping member associated with each of the print heads, the capping members having lengths corresponding substantially to those of the print heads and each said capping member being moveable between a non-capping first position and a second position at which the capping member is located in nozzle capping engagement with the associated print head; and an actuating mechanism associated with each of the capping members and arranged to effect transitioning of each of the capping members from its first position to its second position.

In a further aspect there is provided a printer, wherein:

the pagewidth print head assembly has a single pagewidth print head;

the capping member is located in a non-capping first position spaced-apart from the print head; and the capping mechanism has an actuating mechanism arranged to effect arcuate transitioning of the capping member from the non-capping first position to a second position at which the capping member is located in nozzle capping engagement with the print head.

In a further aspect there is provided a printer, wherein:

the pagewidth print head assembly has a single pagewidth print head;

the capping member is located in a non-capping first position adjacent the print head; and the capping mechanism further has:

purging means associated with the capping member and arranged to receive material that is purged from the nozzle environment of the print head; and an actuating mechanism arranged to effect transitioning of the capping member in an arcuate direction from the non-capping first position to a second position at which the capping member is located in nozzle capping engagement with the print head.

In a further aspect there is provided a printer, wherein the capping mechanism has:

a first actuating mechanism arranged to move the at least one print head in a arcuate first direction from a first to a second position; and a second actuating mechanism arranged to move the at least one capping member in an arcuate second direction opposite to that of the first direction to effect nozzle capping engagement of the at least one print head when the at least one print head is in the second position.

In a further aspect there is provided a printer, wherein the capping mechanism has:

a first actuating mechanism arranged to move the at least one print head in a arcuate first direction from a first position to a second position and a third position, and a second actuating mechanism arranged to move the at least one capping member in an arcuate second direction opposite to that of the first direction to effect nozzle capping engagement of the at least one print head when the at least one print head is in the second position and to permit purging of the nozzles when the at least one print head is in the third position.

In a further aspect there is provided a printer, wherein the capping mechanism has:

a rotatable turret having a longitudinal length corresponding substantially to that of the at least one print head, a longitudinally extending capping member carried by the turret, a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a printer, wherein the capping mechanism has:

a rotatable turret having a longitudinal length corresponding substantially to that of the at least one print head, a longitudinally extending capping member carried by the turret, and an actuating mechanism arranged to effect rotation of the turret to move the capping member from a non-capping first position to a second position at which the capping member is located in nozzle capping engagement with the at least one print head.

In a further aspect there is provided a printer, wherein the capping mechanism has:

a carrier positioned adjacent the at least one print head and having a longitudinal length corresponding substantially to that of the at least one print head, a longitudinally extending capping member pivotally mounted to the carrier and having a longitudinal length corresponding substantially to that of the at least one print head, and an actuating mechanism arranged to effect pivoting of the capping member from a non-capping first position to a second position at which the capping member is located in nozzle capping engagement with the at least one print head.

In a further aspect there is provided a printer, wherein the capping mechanism further has an actuating mechanism arranged to effect relative movement of the capping member and the at least one print head to a position at which the capping member is located in nozzle capping engagement with the at least one print head.

In a further aspect there is provided a printer, wherein the capping member comprises:

a) a lip portion that is formed integrally with a body portion; and b) a cavity surrounded by the lip portion, the lip portion being peripherally configured to surround the nozzles on the at least one print head, and the body portion having a length corresponding substantially to that of the at least one print head.

In a seventeenth aspect the present invention provides a capping member for a pagewidth print head assembly having (i) at least one pagewidth printhead; and (ii) a plurality of nozzles located along the at least one printhead, the capping member comprising:

a) a lip portion that is formed integrally with a body portion; and b) a cavity surrounded by the lip portion; wherein, the lip portion is peripherally configured to surround the nozzles on the at least one print head, and the body portion has a length corresponding substantially to that of the at least one printhead.

Optionally the lip portion is formed from an elastomeric material.

Optionally the body portion is formed from a rigid material.

Optionally the body portion is formed from a metal.

Optionally the body portion is formed from a plastics material.

Optionally the body portion and the lip portion are formed as a unitary structure for the full length of the member.

Optionally the capping portion is formed on each of two sides of the body portion.

Optionally a purging chamber is formed within the member.

In a further aspect there is provided a capping member for incorporation in a capping mechanism of a printer comprising the pagewidth print head assembly, wherein:

the capping member has a length corresponding substantially to that of the at least one print head, and the capping mechanism has:

a first actuating mechanism arranged to move the at least one print head in an arcuate direction from a first to a second position, and a second actuating mechanism, the capping member being adapted to be moved by the second actuating mechanism in a direction normal to the at least one print head to effect nozzle capping engagement of the of the at least one print head when the at least one print head is in the second position.

In a further aspect there is provided a capping member for incorporation in a capping mechanism of a printer comprising the pagewidth print head assembly, wherein:

the capping member has a length corresponding substantially to that of the at least one print head, and the capping mechanism has:

a first actuating mechanism arranged to move the at least one print head in an arcuate direction from a first to a second position, and a second actuating mechanism, the capping member being adapted to be moved by the second actuating mechanism in a lateral direction relative to the at least one print head to effect nozzle capping engagement of the of the at least one print head when the at least one print head is in the second position.

In a further aspect there is provided a capping member for incorporation in a capping mechanism of a printer comprising the pagewidth print head assembly, wherein:

the pagewidth print head assembly has two opposed pagewidth print heads and a plurality of nozzles located along each of the print heads and arranged in use to deliver ink onto print media as it is transported past the print heads, the capping member is adapted to be located adjacent the print heads and has a length corresponding substantially to that of the print heads, and the capping mechanism has:

a first actuating mechanism arranged to effect relative movement of the print heads from a printing first position to a spaced-apart second position and a second actuating mechanism, the capping member being adapted to be interposed between the print heads by the second actuating mechanism to effect nozzle capping engagement of the two print heads when the print heads are in the second position.

In a further aspect there is provided a capping member for incorporation in a capping mechanism of a printer comprising the pagewidth print head assembly, wherein:

the pagewidth print head assembly has a single pagewidth print head, the capping member has a length corresponding substantially to that of the print head and is adapted to be located in a non-capping first position spaced-apart from but confronting the print head, and the capping mechanism has a motor drive arranged for camming engagement with the capping member, the capping member being adapted to be linear transitioned by the motor drive from the first to a second position at which the capping member is located in nozzle capping engagement with the print head.

In a further aspect there is provided a capping member for incorporation in a capping/purging mechanism of a printer comprising the pagewidth print head assembly, wherein:

the capping member has a length corresponding substantially to that of the print head and is adapted to be located in a non-capping first position adjacent the at least one print head, and the capping/purging mechanism has:

purging means associated with the capping member and arranged to receive material that is purged from the nozzle environment of the at least one print head, and an actuating mechanism, the capping member being adapted to be transitioned by the actuating mechanism from the first position to a second position at which the capping member is located in nozzle capping engagement with the print head.

In a further aspect there is provided a capping member for incorporation in a capping mechanism of a printer comprising the pagewidth print head assembly, wherein:

the pagewidth print head assembly has two offset pagewidth print heads and a plurality of nozzles located along each of the print heads and arranged in use to deliver ink onto print media as it is transported past the print heads, the capping member has a length corresponding substantially to those of the print heads and is adapted to be associated with one of the print heads and to be moveable between a non-capping first position and a second position at which the capping member is located in nozzle capping engagement with the associated print head, and the capping mechanism has an actuating mechanism associated with the capping member, the capping member being adapted to be transitioned by the actuating mechanism from its first position to its second position.

In a further aspect there is provided a capping member for incorporation in a capping mechanism of a printer comprising the pagewidth print head assembly, wherein:

the pagewidth print head assembly has a single pagewidth print head, the capping member has a length corresponding substantially to that of the print head and is adapted to be located in a non-capping first position spaced-apart from the print head, and the capping mechanism has an actuating mechanism, the capping member being adapted to undergo arcuate transitioning by the actuating mechanism from the first position to a second position at which the capping member is located in nozzle capping engagement with the print head.

In a further aspect there is provided a capping member for incorporation in a capping/purging mechanism of a printer comprising the pagewidth print head assembly, wherein:

the pagewidth print head assembly has a single pagewidth print head, the capping member has a length corresponding substantially to that of the print head and is adapted to be located in a non-capping first position adjacent the print head, and the capping/purging mechanism has:

purging means associated with the capping member and arranged to receive material that is purged from the nozzle environment of the print head, and an actuating mechanism, the capping member being adapted to be transitioned by the actuating mechanism in an arcuate direction from the first position to a second position at which the capping member is located in nozzle capping engagement with the print head.

In a further aspect there is provided a capping member for incorporation in a capping mechanism of a printer comprising the pagewidth print head assembly, wherein:

the capping member has a length corresponding substantially to that of the at least one print head, and the capping mechanism has:

a first actuating mechanism arranged to move the at least one print head in an arcuate first direction from a first to a second position, and a second actuating mechanism, the capping member being adapted to be moved by the second actuating mechanism in an arcuate second direction opposite to that of the first direction to effect nozzle capping engagement of the at least one print head when the at least one print head is in the second position.

In a further aspect there is provided a capping member for incorporation in a capping/purging mechanism of a printer comprising the pagewidth print head assembly, wherein:

the capping member has a length corresponding substantially to that of the at least one print head, and the capping/purging mechanism has:

a first actuating mechanism arranged to move the at least one print head in an arcuate first direction from a first position to a second position and a third position, and a second actuating mechanism, the capping member being adapted to be moved by the second actuating mechanism in an arcuate second direction opposite to that of the first direction to effect nozzle capping engagement of the at least one print head when the at least one print head is in the second position and to permit purging of the nozzles when the at least one print head is in the third position.

In a further aspect there is provided a capping member for incorporation in a capping/purging mechanism of a printer comprising the pagewidth print head assembly, the capping/purging mechanism being associated with the at least one print head and comprising a rotatable turret having a longitudinal length corresponding substantially to that of the at least one print head, wherein:

the capping member is a longitudinally extending capping member adapted to be carried by the turret, and the capping/purging mechanism further comprises:

a purging chamber carried by the turret and connected in fluid passage communication with a suction device, a first actuating mechanism arranged to effect rotation of the turret selectively to position the capping member or the purging chamber in alignment with the nozzles of the at least one print head, and a second actuating mechanism arranged to effect movement of the turret whereby an aligned one of the capping member and the purging chamber is selectively positioned in engagement with the at least one print head.

In a further aspect there is provided a capping member for incorporation in a capping mechanism of a printer comprising the pagewidth print head assembly, the capping mechanism being associated with the at least one print head and comprising a rotatable turret having a longitudinal length corresponding substantially to that of the at least one print head, wherein:

the capping member is a longitudinally extending capping member adapted to be carried by the turret, and the capping mechanism further comprises an actuating mechanism arranged to effect rotation of the turret, the capping member being adapted to move with the turret from a non-capping first position to a second position at which the capping member is located in nozzle capping engagement with the at least one print head.

In a further aspect there is provided a capping member for incorporation in a capping mechanism of a printer comprising the pagewidth print head assembly, the capping mechanism being associated with the at least one print head and comprising a carrier positioned adjacent the at least one print head and having a longitudinal length corresponding substantially to that of the at least one print head, wherein:

the capping member is a longitudinally extending capping member adapted to be pivotally mounted to the carrier and to have a longitudinal length corresponding substantially to that of the at least one print head, and the capping mechanism further comprises an actuating mechanism, the capping member being adapted to be pivoted by the actuating mechanism from a non-capping first position to a second position at which the capping member is located in nozzle capping engagement with the at least one print head.

In a further aspect there is provided a capping member for incorporation in a capping mechanism of a printer comprising the pagewidth print head assembly, wherein:

the capping member is formed from a flexible sheet-like material and has a width corresponding substantially to the length of the at least one print head, and the capping mechanism is associated with the at least one print head and comprises an actuating mechanism, the capping member and the at least one print head being adapted to be relatively moved by the actuating mechanism to a position at which the capping member is located in nozzle capping engagement with the at least one print head.

In a further aspect there is provided a capping member for incorporation in a capping mechanism of a printer comprising the pagewidth print head assembly, wherein:

the capping mechanism is associated with the at least one print head, and the capping member is formed from a flexible sheet-like material and has a width corresponding substantially to the length of the at least one print head, the flexible sheet-like material being provided as a replaceable roll from which a portion of the material is in use drawn to locate, as the capping member, in nozzle capping engagement with the at least one print head.

In a further aspect there is provided a capping member for incorporation in a capping mechanism of a printer comprising the pagewidth print head assembly, wherein:

the capping member is formed from a flexible sheet-like material and has a width corresponding substantially to the length of the at least one print head, the flexible sheet-like material being provided as a replaceable roll from which a portion of the material is in use drawn to locate, as the capping member, in nozzle capping engagement with the at least one print head, and the capping mechanism is associated with the at least one print head and comprises a take-up reel arranged to take-up spent capping material following a capping operation.

In an eighteenth aspect the present invention provides a capping mechanism for a pagewidth print head assembly having a) at least one pagewidth print head and b) a plurality of nozzles located along the at least one print head and arranged in use to deliver ink onto print media as it is transported past the at least one print head, and the capping mechanism comprising i) at least one capping member having a length corresponding substantially to that of the at least one print head, and ii) actuating means arranged to effect linear relative transitioning of the at least one capping member and the at least one print head to a position at which nozzle capping engagement is effected between the at least one capping member and the at least one print head.

Optionally the actuating means is arranged to effect linear transitioning of the at least one capping member from a non-capping first position to a second position at which the at least one capping member is located in nozzle capping engagement with the at least one print head.

In a further aspect there is provided a capping mechanism for a pagewidth print head assembly having a) a pagewidth print head and b) a plurality of nozzles located along the print head and arranged in use to deliver ink onto print media as it is transported past the print head, the capping mechanism comprising i) a capping member having a length corresponding substantially to that of the print head, and ii) an actuating mechanism arranged to effect linear transitioning of the capping member from a non-capping first position to a second position at which the capping member is located in nozzle capping engagement with the print head.

Optionally the capping member is formed effectively as a one-piece member.

Optionally the capping member comprises conjoined capping member portions having an aggregate length corresponding substantially to that of the print head.

Optionally the capping member comprises a body portion formed from a rigid material and a capping portion having a) an integrally formed elastomeric material lip portion and b) a cavity surrounded by the lip portion, and wherein the lip portion is peripherally configured to surround the nozzles collectively.

Optionally the capping member is arranged to be connected to a suction device whereby material may be sucked from the nozzle environment of the print head.

Optionally a chamber is located within the capping member and is connected in fluid passage communication with the cavity and wherein the chamber is arranged to be connected to a suction device whereby material may be sucked from the nozzle environment of the print head.

Optionally a second actuating mechanism is provided for effecting movement of the print head to the second position.

Optionally the second actuating mechanism is arranged to impart linear movement to the print head.

Optionally the second actuating mechanism is arranged to impart arcuate movement to the print head.

Optionally the capping member is positioned in confronting relationship with the print head and wherein the actuating mechanism is arranged to move the capping member in a direction normal to the print head when effecting linear transitioning of the capping member from the first to the second position.

In a further aspect there is provided a capping mechanism for a pagewidth print head assembly having a) two confronting pagewidth print heads and b) a plurality of nozzles arranged in use to deliver ink onto print media as it is transported past the print heads, the capping mechanism comprising i) a capping member associated with each of the print heads and having a length corresponding substantially to that of the print heads, and ii) actuating mechanisms arranged to effect linear transitioning of each of the capping members from a non-capping first position to a second position at which each said capping member is located in nozzle capping engagement with the associated print head.

Optionally each of the capping members is formed effectively as a one-piece member.

Optionally each of the capping members comprises conjoined capping member portions having an aggregate length corresponding substantially to that of the print head.

Optionally each of the capping members comprises a body portion formed from a rigid material and a capping portion having a) an integrally formed elastomeric material lip portion and b) a cavity surrounded by the lip portion, and wherein the lip portion is peripherally configured to surround the nozzles collectively.

Optionally further actuating mechanisms are provided for effecting movement of the print heads to the second position.

Optionally the further actuating mechanisms are arranged to impart linear movement to the print heads.

Optionally the further actuating mechanisms are arranged to impart arcuate movement to the print heads.

Optionally the capping members are positioned in confronting relationship with the respective print heads when the print heads are in the second position and wherein the actuating mechanisms are arranged to move the respective capping members in directions normal to the associated print heads when effecting linear transitioning of the capping members from the first to the second position.

Optionally the capping members are positioned laterally with respect with the respective print heads when the print heads are in the second position and wherein the actuating mechanisms are arranged to move the respective capping members in a lateral direction when effecting linear transitioning of the capping members from the first to the second position.

Optionally a further actuating mechanism is provided for imparting linear movement to at least one of the print heads, wherein the capping members are positioned laterally with respect to the print heads when in the first position and wherein the capping members are moved laterally to a position between the print heads when transiting linearly from the first to the second position.

In a further aspect there is provided a capping mechanism for a pagewidth print head assembly having a) two offset pagewidth print heads and b) a plurality of nozzles located along each of the print heads and arranged in use to deliver ink onto print media as it is transported past the print heads, the capping mechanism comprising i) a capping member associated with each of the print heads and having a length corresponding substantially to that of the print heads, and ii) actuating mechanisms arranged to effect linear relative transitioning of each of the associated capping members and print heads to a position at which the capping members is located in nozzle capping engagement with the associated print heads.

Optionally the actuating mechanisms are arranged to effect linear transitioning of each of the capping members from a non-capping first position to a second position at which each said capping member is located in nozzle capping engagement with the associated print head.

Optionally the capping members are positioned in confronting relationship with the respective print heads and wherein the actuating mechanisms are arranged to move the respective capping members in directions normal to the associated print heads when effecting linear transitioning of the capping members from the first to the second position.

In a further aspect the present invention provides a printer comprising:

(a) a print head assembly having (i) at least one pagewidth print head and (ii) a plurality of nozzles located along the at least one print head and arranged in use to deliver ink onto print media as it is transported past the at least one print head, and (b) a capping mechanism having i) at least one capping member having a length corresponding substantially to that of the at least one print head, and ii) actuating means arranged to effect linear relative transitioning of the at least one capping member and the at least one print head to a position at which nozzle capping engagement is effected between the at least one capping member and the at least one print head.

In a further aspect there is provided a method of capping a pagewidth print head assembly having a) at least one pagewidth print head and b) a plurality of nozzles located along the at least one print head and arranged in use to deliver ink onto print media as it is transported past the at least one print head;

and wherein the method comprises:

effecting linear relative transitioning of the at least one print head and at least one associated capping member to a position at which the at least one capping member is located in nozzle capping engagement with the at least one print head.

In a nineteenth aspect the present invention provides a a capping mechanism for a printhead having a plurality of nozzles arranged to deliver ink onto print media which, in use, is transported past the printhead, the capping mechanism comprising actuating means arranged to move the printhead in an arcuate direction away from a transport plane of the print media, from a printing first position to a capping second position, and a capping member which is arranged to engage in nozzle capping engagement with the printhead when the printhead is in the second position.

In another aspect there is provided a printer comprising a) at least one printhead having a plurality of nozzles arranged to deliver ink onto print media which, in use, is transported past the printhead, and b) a capping mechanism having actuating means arranged to move the printhead in an arcuate direction away from a transport plane of the print media, from a printing first position to a capping second position, and a capping member which is arranged to engage in nozzle capping engagement with the printhead when the printhead is in the second position.

In a further aspect there is provided a capping mechanism for a pagewidth printhead assembly having a) at least one pagewidth printhead and b) a plurality of nozzles located along the printhead and arranged in use to deliver ink onto print media as it is transported past the printhead;

the capping mechanism comprising i) at least one capping member having a length corresponding substantially to that of the at least one printhead, and ii) actuating means arranged to move the at least one printhead in an arcuate direction away from the transport plane of the print media, from a printing first position to a second position at which the at least one capping member is engaged in nozzle capping engagement with the at least one printhead.

Optionally the at least one capping member is formed effectively as a one-piece member.

Optionally the at least one capping member comprises conjoined capping member portions having an aggregate length corresponding substantially to that of the printhead.

Optionally the at least one capping member comprises a body portion formed from a rigid material and a capping portion having a) an integrally formed elastomeric material lip portion and b) a cavity surrounded by the lip portion, and wherein the lip portion is peripherally configured to surround the nozzles collectively of the associated printhead.

Optionally the at least one capping member is arranged to be connected to a suction device whereby material may be sucked from the nozzle environment of the associated printhead.

Optionally a purging chamber is located within the at least one capping member and is arranged to be connected to a suction device whereby material may be sucked from the nozzle environment of the printhead.

Optionally a further actuating mechanism is provided to effect movement of the at least one capping member from a non-capping position to the second position.

Optionally the further actuating mechanism is arranged to impart linear movement to the at least one capping member.

Optionally the further actuating mechanism is arranged to impart arcuate movement to the at least one capping member.

Optionally the at least one capping member is positioned in confronting relationship with an associated said printhead when the printhead is in the second position and wherein the further actuating mechanism is arranged to move the at least one capping member in a direction normal to the associated printhead when effecting linear movement of the at least one capping member from the non-capping position to the second position.

Optionally the at least one capping member is positioned adjacent to and laterally with respect to the at least one printhead, and wherein the further actuating mechanism is arranged to move the at least one capping member in a lateral direction to the second position.

In a further aspect there is provided a capping mechanism for a pagewidth printhead assembly having a) two pagewidth printheads and b) a plurality nozzles located along each of the printheads and arranged in use to deliver ink onto print media as it is transported past the printheads;

the capping mechanism comprising i) a capping member associated with each of the printheads and having a length corresponding substantially to that of the printheads, and ii) actuating means arranged to move each of the printheads in an arcuate direction away from the transport plane of the print media, from a printing first position to a second position at which the capping member is engaged in nozzle capping engagement with the associated printhead.

Optionally each capping member is formed effectively as a one-piece member.

Optionally each capping member comprises conjoined capping member portions having an aggregate length corresponding substantially to that of the printhead.

Optionally each capping member comprises a body portion formed from a rigid material and a capping portion having a) an integrally formed elastomeric material lip portion and b) a cavity surrounded by the lip portion, and wherein the lip portion is peripherally configured to surround the nozzles collectively.

Optionally each capping member is arranged to be connected to a suction device whereby material may be sucked from the nozzle environment of the associated printhead.

Optionally a purging chamber is located within each capping member and is arranged to be connected to a suction device whereby material may be sucked from the nozzle environment of the associated printhead.

Optionally a further actuating mechanism is provided to effect movement of each of the capping members from a non-capping position to the second position.

Optionally the further actuating mechanism is arranged to impart linear movement to each of the capping members.

Optionally the further actuating mechanism is arranged to impart arcuate movement to each of the capping members.

Optionally each of the capping members is positioned in confronting relationship with the associated said printhead when the printhead is in the second position and wherein the further actuating mechanism is arranged to move each of the capping members in a direction normal to the associated printhead when effecting linear movement of the capping members from the non-capping position to the second position.

Optionally each of the capping members is positioned adjacent to and laterally with respect to an associated one of the printheads, and wherein the further actuating mechanism is arranged to move each of the capping members in a lateral direction to the second position.

In a aspect the present invention provides a printer comprising:

a) printhead assembly having
   (i) at least one pagewidth printhead and
   (ii) a plurality of nozzles located along the at least one printhead and arranged in use to deliver ink onto print media as it is transported past the printhead; and b) a capping mechanism having
   (i) at least one capping member having a length corresponding substantially to that of the at least one printhead, and ii) actuating means arranged to move the at least one printhead in an arcuate direction away from the transport plane of the print media, from a printing first position to a second position at which the at least one capping member is engaged in nozzle capping engagement with the at least one print head.

In a further aspect the present invention provides a method of capping a printhead having a plurality of nozzles arranged to deliver ink onto print media which, in use, is transported past the printhead; the method comprising moving the printhead, in an arcuate direction away from a transport plane of the print media, from a printing first position to a capping second position and engaging the printhead with a capping member which in nozzle capping engagement when the printhead is in the second position.

In another aspect the present invention provides a method of capping a pagewidth printhead assembly having a) at least one pagewidth printhead and b) a plurality of nozzles arranged in use to deliver ink onto print media as it is transported past the printhead;

the method comprising moving the at least one printhead in an arcuate direction away from the transport plane of the print media, from a printing first position to a second position at which a capping member is engaged in nozzle capping engagement with the at least one printhead.

In a twentieth aspect the present invention provides a capping/purging mechanism for a pagewidth printhead assembly having a) at least one pagewidth printhead, and b) a plurality of nozzles located along the at least one printhead and arranged in use to deliver ink onto print media as it is transported past the at least one printhead;

and the capping/purging mechanism comprising
   i) at least one capping member having a length corresponding substantially to that of the at least one printhead,
   ii) means arranged to move the at least one printhead and/or the at least one capping member to a position at which the at least one capping member is located in nozzle capping engagement with the at least one printhead, and
   iii) at least one purging chamber arranged to receive material that is purged from the at least one printhead.

Optionally the at least one capping member is formed effectively as a one-piece member.

Optionally the at least one capping member comprises conjoined capping member portions having an aggregate length corresponding substantially to that of the printhead.

Optionally the at least one capping member comprises a body portion formed from a rigid material and a capping portion having a) an integrally formed elastomeric material lip portion and b) a cavity surrounded by the lip portion, and wherein the lip portion is peripherally configured to surround the nozzles collectively.

Optionally the at least one purging chamber is connectible to a suction device.

Optionally the at least one purging chamber is connectible to the suction device by way of an extractor tube.

Optionally the at least one purging chamber is integrated with the at least one capping member.

Optionally the at least one purging chamber is connected in fluid passage communication with the at least one capping member.

Optionally the at least one purging chamber is carried by a support that also carries the at least one capping member.

Optionally the at least one capping member and the at least one purging chamber form integral portions of a capping/purging member.

Optionally the means arranged to move the at least one printhead and/or the at least one capping member comprises a first actuating means arranged to move the at least one printhead in an arcuate direction away from the plane of print media feed through the printhead assembly and to the position of nozzle capping engagement.

Optionally the means arranged to move the at least one printhead and/or the at least one capping member comprises first and second actuating means arranged to move the at least one printhead and the at least one capping member in arcuate directions to the position of nozzle capping engagement.

Optionally the first actuating means is arranged to move the at least one printhead to a further position at which the purging chamber is arranged to receive material that is purged from the at least one printhead.

Optionally the second actuating means is arranged to move the at least one capping member to a further position at which the purging chamber is arranged to receive material that is purged from the at least one printhead.

Optionally the means arranged to move the at least one printhead and/or the at least one capping member comprises an actuating means arranged to move the at least one capping member and the at least one purging chamber in a linear direction to the position of nozzle capping engagement.

In a further aspect there is provided a capping/purging mechanism for a pagewidth printhead assembly having a) a pagewidth printhead, and b) a plurality of nozzles located along the printhead and arranged in use to deliver ink onto print media as it is transported past the printhead;

and the capping/purging mechanism comprising
   i) a capping member having a length corresponding substantially to that of the at least one printhead,
   ii) means arranged to move the capping member and/or the printhead to a position at which the capping member is located in nozzle capping engagement with the printhead, and
   iii) a purging chamber arranged to receive material that is purged from the printhead.

Optionally the capping member is formed effectively as a one-piece member.

Optionally the capping member comprises conjoined capping member portions having an aggregate length corresponding substantially to that of the printhead.

Optionally the capping member comprises a body portion formed from a rigid material and a capping portion having a) an integrally formed elastomeric material lip portion and b) a cavity surrounded by the lip portion, and wherein the lip portion is peripherally configured to surround the nozzles collectively.

Optionally the purging chamber is connectible to a suction device.

Optionally the purging chamber is connectible to the suction device by way of an extractor tube.

Optionally the purging chamber is integrated with the capping member.

Optionally the purging chamber is connected in fluid passage communication with the at least one capping member.

Optionally the purging chamber is carried by a support that also carries the capping member.

Optionally the capping member and the purging chamber form integral portions of a capping/purging member.

Optionally the means arranged to move the printhead and/or the capping member comprises a first actuating means arranged to move the printhead in an arcuate direction away from the plane of print media feed through the printhead assembly and to the position of nozzle capping engagement.

Optionally the means arranged to move the printhead and/or the capping member comprises actuating means arranged to move the capping member in an arcuate direction to the position of nozzle capping engagement.

Optionally the means arranged to move the printhead and/or the capping member comprises an actuating means arranged to move the capping member and the purging chamber in a linear direction to the position of nozzle capping engagement.

Optionally the capping member and the purging chamber are both carried by a rotatable turret In a further aspect there is provided a capping/purging mechanism for a pagewidth printhead assembly having a) two confronting pagewidth printheads, and b) a plurality of nozzles located along the printhead and arranged in use to deliver ink onto print media as it is transported past the printheads;

and the capping/purging mechanism comprising i) a capping member associated with each of the printheads and having a length corresponding substantially to that of the printheads, ii) means arranged to move the printheads and the capping members to positions at which the capping members are located in nozzle capping engagement with the printheads, and iii) a purging chamber associated with each of the capping members and arranged to receive material that is purged from the at least one printhead.

Optionally the means arranged to move the printheads and the capping members comprise actuating means arranged to move the capping members and the printheads in arcuate directions to the positions of nozzle capping engagement.

In a further aspect there is provided a printer comprising a) a pagewidth printhead assembly having (i) at least one pagewidth printhead, and (ii) a plurality nozzles located along the at least one printhead and arranged in use to deliver ink onto print media as it is transported past the at least one printhead, and b) a capping/purging mechanism having (i) at least one capping member having a length corresponding substantially to that of the at least one printhead, (ii) means arranged to move the at least one printhead and/or the at least one capping member to a position at which the at least one capping member is located in nozzle capping engagement with the plurality of chips on the at least one printhead and (iii) at least one purging chamber arranged to receive material that is purged from the at least one printhead.

In another aspect there is provided a method of capping and purging a pagewidth printhead assembly having a) at least one pagewidth printhead and b) a plurality of nozzles located along the at least one printhead and arranged in use to deliver ink onto print media as it is transported past the at least one printhead; the method comprising the steps of:

i) moving the at least one printhead and/or at least one associated capping member to a position at which the capping member is located in nozzle capping engagement with the at least on printhead and, either simultaneously or separately, iii) effecting purging of material from the at least one printhead by way of a purging chamber associated with the at least one capping member.

In a twenty first aspect the present invention provides a capping mechanism for a pagewidth printhead assembly having a) at least one pagewidth printhead and b) a plurality of nozzles located along the at least one printhead and arranged in use to deliver ink onto print media as it is transported past the printhead; the capping mechanism comprising i) a capping member formed from a flexible sheet-like material and having a width corresponding substantially to the length of the at least one printhead, and ii) means arranged to move the capping member and/or the at least one printhead to a position at which the capping member is located in nozzle capping engagement with the at least one printhead.

In a further aspect there is provided a capping mechanism for a pagewidth printhead assembly having a) at least one pagewidth printhead and b) a plurality of nozzles located along the at least one printhead and arranged in use to deliver ink onto print media as it is transported past the printhead; the capping mechanism comprising i) a capping member formed from a flexible sheet-like material and having a width corresponding substantially to the length of the at least one printhead, and ii) means arranged to position the capping member in nozzle capping engagement with the at least one printhead.

Optionally the capping member comprises a single layer sheet-like material.

Optionally the capping member comprises a multi-layer sheet-like material.

Optionally the capping member comprises a compressible sheet-like material.

Optionally means are provided for delivering a fluid to a region between the multiple layers of the capping member.

Optionally the capping member is formed from a sheet-like material having hydrophobic properties.

Optionally the capping member is formed from a closed cell thermoplastics material.

Optionally the capping member is formed from a sheet-like material having hydrophilic properties.

Optionally the capping member is formed from an open cell silicone material.

Optionally the capping member comprises an individual capping member.

Optionally the capping member comprises a portion of a roll of said capping member material.

In a further aspect there is provided a capping mechanism including a said roll of the capping member material from which the capping member is in use fed to the position of nozzle capping engagement with the at least one printhead.

In a further aspect there is provided a capping mechanism including a spool for receiving spent said capping member material following a capping operation.

In another aspect the present invention provides a capping mechanism for a pagewidth printhead assembly having a) a pagewidth printhead and b) a plurality nozzles located along the printhead and arranged in use to deliver ink onto print media as it is transported past the printhead; the capping mechanism comprising i) a capping member formed from a flexible sheet-like material and having a width corresponding substantially to the length of the printhead, and ii) a platen positioned adjacent the printhead and arranged to position the capping member in nozzle capping engagement with the at least one printhead.

Optionally the capping member comprises a single layer sheet-like material.

Optionally the capping member comprises a multi-layer sheet-like material.

Optionally the capping member comprises a compressible sheet-like material.

Optionally means are provided for delivering a fluid to a region between the multiple layers of the capping member.

Optionally the capping member is formed from a sheet-like material having hydrophobic properties.

Optionally the capping member is formed from a closed cell thermoplastics material.

Optionally the capping member is formed from a sheet-like material having hydrophilic properties.

Optionally the capping member is formed from an open cell silicone material.

Optionally the capping member comprises an individual capping member.

Optionally the capping member comprises a portion of a roll of said capping member material.

In another aspect the present invention provides a capping mechanism including a said roll of the capping member material from which the capping member is in use fed to the position of nozzle capping engagement with the at least one printhead.

In another aspect the present invention provides a capping mechanism including a spool for receiving spent said capping member material following a capping operation.

In a further aspect there is provided a printer comprising:

a) a pagewidth printhead assembly having (i) at least one pagewidth printhead and (ii) a plurality of nozzles located along the at least one printhead and arranged in use to deliver ink onto print media as it is transported past the at least one printhead, and b) a capping mechanism having (i) a capping member formed from a flexible sheet-like material and having a width corresponding substantially to the length of the at least one printhead, and (ii) means arranged to move the capping member and/or the at least one printhead to a position at which the capping member is located in nozzle capping engagement with the at least one printhead.

In a further aspect there is provided a printer comprising:

a) a pagewidth printhead assembly having (i) at least one pagewidth printhead and (ii) a plurality nozzles located along the at least one printhead and arranged in use to deliver ink onto print media as it is transported past the printhead, and b) a capping mechanism having (i) a capping member formed from a flexible sheet-like material and having a width corresponding substantially to the length of the at least one printhead, and (ii) means arranged to position the capping member in nozzle capping engagement with the at least one printhead.

In a further aspect there is provided a method of capping a pagewidth printhead assembly having a) at least one pagewidth printhead and b) a plurality of nozzles located along the at least one printhead and arranged in use to deliver ink onto the print media as it is transported past the at least one printhead;

the method comprising moving the at least one printhead and/or a capping member having a flexible sheet-like form to a position at which the capping member is located in nozzle capping engagement with the at least one printhead.

In another aspect there is provided a method of capping a pagewidth printhead assembly having a) at least one pagewidth printhead and b) a plurality of nozzles located along the at least one printhead and arranged in use to deliver ink onto the print media as it is transported past the at least one printhead;

the method comprising positioning a capping member having a flexible sheet-like form in nozzle capping engagement with the at least one printhead.

In a twenty second aspect the present invention provides a capping mechanism for a print head having a plurality of nozzles arranged to deliver ink onto print media which, in use, is transported past the print head; the capping mechanism comprising:

a) a capping member that is configured to contact the print head in nozzle capping engagement, b) a carrier supporting the capping member, and c) an actuating mechanism arranged to effect movement of the carrier back and forth between a first position at which the capping member is located remotely with respect to the print head and a second position at which the capping member is located in contact with the print head;

the capping member being pivotally mounted to the carrier and being arranged to pivot relative to the carrier during back and forth transitional movement of the carrier between a transition position and the second position, where the transition position is located intermediate the first and second positions.

In another aspect there is provided a method of capping a print head having a plurality of nozzles arranged to deliver ink onto print media which, in use, is transported past the print head; the method comprising the steps of:

i) effecting movement of a carrier and a capping member carried by the carrier from a first position remote from the print head to a second position at which the capping member is moved into nozzle capping engagement with the print head, ii) moving the carrier and the capping member through a transition position during their movement from the first position to the second position, and iii) effecting pivotal movement of the capping member relative to the carrier during a transitional movement made by the carrier between the transition position and the second position.

Optionally the transitional movement made by the carrier is small relative to the movement made by the carrier between the first and second positions.

In a further aspect there is provided a capping mechanism for a pagewidth print head having a plurality of nozzles located along the print head and arranged to deliver ink onto print media which, in use, is transported past the print head, the capping mechanism comprising:

a) a capping member which has a length corresponding substantially to that of the print head and which is configured to contact the print head in nozzle capping engagement, b) a carrier supporting the capping member, and c) an actuating mechanism arranged to effect movement of the carrier back and forth between a first position at which the capping member is located remotely with respect to the print head and a second position at which the capping member is located in contact with the print head;

the capping member being pivotally mounted to the carrier and being arranged to pivot relative to the carrier during back and forth transitional movement of the carrier between a transition position and the second position, where the transition position is located intermediate the first and second positions.

Optionally the actuating mechanism is arranged to move the carrier pivotally between the first and second positions during a capping operation.

Optionally the carrier is pivotally mounted to a support by way of a pivotal element having a first pivot axis, and the capping member is pivotally mounted to the carrier by way of a pivoting arrangement having a second pivot axis that is located parallel to and spaced from the first pivot axis.

Optionally the capping member has a capping element that is radially displaced from the second pivot axis, and the radial displacement of the capping element from the second pivot axis is small relative to the spacing between the first and second pivot axes.

Optionally the spacing between the first and second pivot axes is of the order of three times the radial displacement of the capping element from the second pivot axis.

Optionally the transition position is located a distance from the second position which is small relative to the distance between the first and second positions.

Optionally the ratio of the transitional pivotal movement of the carrier to the total pivotal movement of the carrier between the first and second positions is within the range 1:12 to 1:20.

Optionally the capping element comprises a substantially rigid channel-shaped element.

Optionally the capping element incorporates a lip which is formed from an elastomeric material.

Optionally the capping element is arranged to engage with a face portion of the carrier when the carrier is located in the first position whereby a recessed portion of the capping element is effectively closed against loss of contained moisture and ingress of contaminating material.

Optionally the capping element incorporates a lip which is formed from an elastomeric material, wherein the lip is configured to locate about the print head nozzles when the capping member is in the second position, and wherein the lip is arranged to engage with a face portion of the carrier when the carrier is located in the first position whereby a recessed portion of the capping element is effectively closed against loss of contained moisture and ingress of contaminating material.

Optionally the capping member is provided with at least one first stop member that is arranged to contact the print head and thereby to effect pivoting of the capping member relative to the carrier as the carrier makes the transitional movement from the transition position to the second position.

Optionally the capping member is provided with at least one second stop member that is arranged to contact the carrier and thereby prevent pivoting of the capping member relative to the carrier as the carrier moves from the transition position to the first position.

Optionally the capping member is pivotally mounted to the carrier by a pivot shaft which extends along a marginal edge portion of the carrier.

Optionally a biasing device is mounted to the capping member and engages the carrier in a manner to bias the capping member in a direction away from nozzle capping engagement with the print head.

Optionally the biasing device comprises a torsion spring.

Optionally the carrier is mounted to the support by spaced-apart end plates which are mounted to the print head.

Optionally the actuating mechanism comprises an electric motor which is coupled to the carrier and arranged to impart pivotal motion to the carrier by way of a crank and a motion translating mechanism.

Optionally at least one abutment is located adjacent the print head and is operable to effect pivoting of the capping member when the carrier approaches the first position, whereby the capping member is moved away from the print media feed path.

Optionally a capping element portion of the capping member is arranged to engage with a face portion of the carrier when the carrier is located in the first position whereby a recessed portion of the capping element is effectively closed against loss of contained moisture and ingress of contaminating material.

Optionally the capping mechanism and the printhead are arranged to operate within an inkjet printer.

Optionally the capping mechanism is configured for operative engagement with a capping mechanism protector which comprises a covering member arranged to engage with the capping mechanism during intervals when the capping mechanism is not engaged with the print head.

In a further aspect there is provided a capping mechanism wherein:

a) the capping mechanism is configured for operative engagement with a capping mechanism protector which comprises a covering member arranged to engage with the capping mechanism during intervals when the capping mechanism is not engaged with the print head, and b) the capping mechanism, the capping mechanism protector and the printhead are arranged to operate in an inkjet printer.

In a twenty third aspect the present invention provides an inkjet printer comprising:

a) a print head having a plurality of nozzles arranged to deliver ink onto print media which, in use, is transported past the print head, and b) a capping mechanism for the print head; the capping mechanism comprising i) a capping member that is configured to contact the print head in nozzle capping engagement, ii) a carrier supporting the capping member, and iii) an actuating mechanism arranged to effect movement of the carrier back and forth between a first position at which the capping member is located remotely with respect to the print head and a second position at which the capping member is located in contact with the print head;

the capping member being pivotally mounted to the carrier and being arranged to pivot relative to the carrier during back and forth transitional movement of the carrier between a transition position and the second position, where the transition position is located intermediate the first and second positions.

In another aspect the present invention provides a inkjet printer comprising:

a) a pagewidth print head having a plurality of nozzles located along the print head and arranged to deliver ink onto print media which, in use, is transported past the print head; and b) a capping mechanism for the print head; the capping mechanism comprising i) a capping member which has a length corresponding substantially to that of the print head and which is configured to contact the print head in nozzle capping engagement, ii) a carrier supporting the capping member, and ii) an actuating mechanism arranged to effect movement of the carrier back and forth between a first position at which the capping member is located remotely with respect to the print head and a second position at which the capping member is located in contact with the print head, the capping member being pivotally mounted to the carrier and being arranged to pivot relative to the carrier during back and forth transitional movement of the carrier between a transition position and the second position, where the transition position is located intermediate the first and second positions.

Optionally the actuating mechanism is arranged to move the carrier pivotally between the first and second positions during a capping operation.

Optionally the carrier is pivotally mounted to a support by way of a pivotal element having a first pivot axis, and the capping member is pivotally mounted to the carrier by way of a pivoting arrangement having a second pivot axis that is located parallel to and spaced from the first pivot axis.

Optionally the capping member has a capping element that is radially displaced from the second pivot axis, and wherein the radial displacement of the capping element from the second pivot axis is small relative to the spacing between the first and second pivot axes.

Optionally the spacing between the first and second pivot axes is of the order of three times the radial displacement of the capping element from the second pivot axis.

Optionally the transition position is located a distance from the second position which is small relative to the distance between the first and second positions.

Optionally the ratio of the transitional pivotal movement of the carrier to the total pivotal movement of the carrier between the first and second positions is within the range 1:12 to 1:20.

Optionally the capping element comprises a substantially rigid channel-shaped element.

Optionally the capping element incorporates a lip which is formed from an elastomeric material.

Optionally the capping element is arranged to engage with a face portion of the carrier when the carrier is located in the first position whereby a channel portion of the capping element is effectively closed against loss of contained moisture and ingress of contaminating material.

Optionally the capping element incorporates a lip which is formed from an elastomeric material, wherein the lip is configured to locate about the print head nozzles when the capping member is in the second position, and wherein the lip is arranged to engage with a face portion of the carrier when the carrier is located in the first position whereby a channel portion of the capping element is effectively closed against loss of contained moisture and ingress of contaminating material.

Optionally the capping member is provided with a first stop member that is arranged to contact the print head and thereby to effect pivoting of the capping member relative to the carrier as the carrier makes the transitional movement from the transition position to the second position.

Optionally the capping member is provided with a second stop member that is arranged to contact the carrier and thereby prevent pivoting of the capping member relative to the carrier as the carrier moves from the transition position to the first position.

Optionally the capping member is pivotally mounted to the carrier by a pivot shaft which extends along a marginal edge portion of the carrier.

Optionally a biasing device is mounted to the capping member and engages the carrier in a manner to bias the capping member in a direction away from nozzle capping engagement with the print head.

Optionally the biasing device comprises a torsion spring.

Optionally the carrier is mounted to the support by spaced-apart end plates which are mounted to the print head.

Optionally the actuating mechanism comprises an electric motor which is coupled to the carrier and arranged to impart pivotal motion to the carrier by way of a crank and a motion translating mechanism.

Optionally an abutment is located adjacent the print head and is operable to effect pivoting of the capping member when the carrier approaches the second position, whereby the capping member is moved away from the print media feed path.

Optionally a capping element portion of the capping member is arranged to engage with a face portion of the carrier when the carrier is located in the first position whereby a recessed portion of the capping element is effectively closed against loss of contained moisture and ingress of contaminating material.

Optionally the printer further comprising a protector for the capping mechanism, the protector comprising a covering member arranged to engage with the capping mechanism during intervals when the capping mechanism is not engaged with the print head.

In a twenty fourth aspect the present invention provides a protector for a capping facility for a print head and which comprises a covering member which is arranged to engage with the capping facility during intervals when the capping facility is not engaged with the print head.

In a further aspect there is provided a method of protecting a printer capping facility against loss of moisture and/or ingress of contaminating material, the method comprising engaging the capping facility with a covering member during intervals when the capping facility is not engaged with the print head.

In another aspect there is provided a protector for a capping facility in the form of a capping mechanism for a print head having a plurality of ink-delivery nozzles and wherein:

a) the capping mechanism comprises
   i) a capping member that is configured to contact the print head in nozzle capping engagement,
   ii) a carrier supporting the capping member, and
   iii) an actuating mechanism arranged to effect movement of the carrier back and forth between a first position at which the capping member is located remotely with respect to the print head and a second position at which the capping member is located in contact with the print head; and
b) the protector comprises a covering member which is arranged to be engaged by the capping member when the capping member is located in the first position.

In a further aspect there is provided a protector for a capping facility in the form of a capping mechanism for a pagewidth print head having a plurality of nozzles located along the print head, and wherein:

a) the capping mechanism comprises:
   i) a capping member which has a length corresponding substantially to that of the print head and which is configured to contact the print head in nozzle capping engagement,
   ii) a carrier supporting the capping member, and
   iii) an actuating mechanism arranged to effect movement of the carrier back and forth between a first position at which the capping member is located remotely with respect to the print head and a second position at which the capping member is located in contact with the print head;
b) the capping member is pivotally mounted to the carrier and is arranged to pivot relative to the carrier during back and forth transitional movement of the carrier between a transition position and the second position, where the transition position is located intermediate the first and second positions; and
c) the protector comprises a covering member which is arranged to be engaged by the capping member when the capping member is located in the first position.

Optionally the covering member is constituted by the carrier.

Optionally the actuating mechanism is arranged to move the carrier pivotally between the first and second positions during a capping operation.

Optionally the carrier is pivotally mounted to a support by way of a pivotal element having a first pivot axis, and the capping member is pivotally mounted to the carrier by way of a pivoting arrangement having a second pivot axis that is located parallel to and spaced from the first pivot axis.

Optionally the capping member has a capping element that is radially displaced from the second pivot axis, and the radial displacement of the capping element from the second pivot axis is small relative to the spacing between the first and second pivot axes.

Optionally the spacing between the first and second pivot axes is of the order of three times the radial displacement of the capping element from the second pivot axis.

Optionally the transition position is located a distance from the second position which is small relative to the distance between the first and second positions.

Optionally the ratio of the transitional pivotal movement of the carrier to the total pivotal movement of the carrier between the first and second positions is within the range 1:12 to 1:20.

Optionally the capping element comprises a substantially rigid channel-shaped element.

Optionally the capping element incorporates a lip which is formed from an elastomeric material.

Optionally the capping element is arranged to engage with a face portion of the carrier when the carrier is located in the first position whereby a recessed portion of the capping element is effectively closed against loss of contained moisture and ingress of contaminating material.

Optionally the capping element incorporates a lip which is formed from an elastomeric material, wherein the lip is configured to locate about the print head nozzles when the capping member is in the second position, and wherein the lip is arranged to engage with a face portion of the carrier when the carrier is located in the first position whereby a recessed portion of the capping element is effectively closed against loss of contained moisture and ingress of contaminating material.

Optionally the capping member is provided with at least one first stop member that is arranged to contact the print head and thereby to effect pivoting of the capping member relative to the carrier as the carrier makes the transitional movement from the transition position to the second position.

Optionally the capping member is provided with at least one second stop member that is arranged to contact the carrier and thereby prevent pivoting of the capping member relative to the carrier as the carrier moves from the transition position to the first position.

Optionally the capping member is pivotally mounted to the carrier by a pivot shaft which extends along a marginal edge portion of the carrier.

Optionally a biasing device is mounted to the capping member and engages the carrier in a manner to bias the capping member in a direction away from nozzle capping engagement with the print head.

Optionally the biasing device comprises a torsion spring.

Optionally the actuating mechanism comprises an electric motor which is coupled to the carrier and arranged to impart pivotal motion to the carrier by way of a crank and a motion translating mechanism.

Optionally at least one abutment is located adjacent the print head and is operable to effect pivoting of the capping member when the carrier approaches the first position, whereby the capping member is moved away from the print media feed path.

In a further aspect there is provided a protector, wherein:

the print head has a plurality of nozzles arranged to deliver ink onto print media which, in use, is transported past the print head; and the capping mechanism comprises:
   a) a capping member that is configured to contact the print head in nozzle capping engagement,
   b) a carrier supporting the capping member, and
   c) an actuating mechanism arranged to effect movement of the carrier back and forth between a first position at which the capping member is located remotely with respect to the print head and a second position at which the capping member is located in contact with the print head;

the capping member being pivotally mounted to the carrier and being arranged to pivot relative to the carrier during back and forth transitional movement of the carrier between a transition position and the second position, where the transition position is located intermediate the first and second positions.

In a further aspect there is provided a protector wherein;

the print head has a plurality of nozzles arranged to deliver ink onto print media which, in use, is transported past the print head; and the capping mechanism comprises:

a) a capping member that is configured to contact the print head in nozzle capping engagement, b) a carrier supporting the capping member, and c) an actuating mechanism arranged to effect movement of the carrier back and forth between a first position at which the capping member is located remotely with respect to the print head and a second position at which the capping member is located in contact with the print head;

the capping member being pivotally mounted to the carrier and being arranged to pivot relative to the carrier during back and forth transitional movement of the carrier between a transition position and the second position, where the transition position is located intermediate the first and second positions, the print head, the capping mechanism and the protector being arranged for use in an inkjet printer.

Optionally the capping mechanism and the print head are arranged for use within an inkjet printer.

In a twenty fifth aspect the present invention provides a inkjet printer having a protector for a capping facility for a print head within the printer, the protector comprising a covering member which is arranged to engage with the capping facility during intervals when the capping facility is not engaged with the print head.

In another aspect the present invention provides an inkjet printer having a protector for a capping facility in the form of a capping mechanism for a print head having a plurality of ink-delivery nozzles and wherein:

a) the capping mechanism comprises i) a capping member that is configured to contact the print head in nozzle capping engagement, ii) a carrier supporting the capping member, and iii) an actuating mechanism arranged to effect movement of the carrier back and forth between a first position at which the capping member is located remotely with respect to the print head and a second position at which the capping member is located in contact with the print head; and b) the protector comprises a covering member which is arranged to be engaged by the capping member when the capping member is located in the first position.

In a further aspect the present invention provides an inkjet printer having a protector for a capping facility in the form of a capping mechanism for a pagewidth print head having a plurality of nozzles located along the print head, and wherein:

a) the capping mechanism comprises:

i) a capping member which has a length corresponding substantially to that of the print head and which is configured to contact the print head in nozzle capping engagement, ii) a carrier supporting the capping member, and iii) an actuating mechanism arranged to effect movement of the carrier back and forth between a first position at which the capping member is located remotely with respect to the print head and a second position at which the capping member is located in contact with the print head;

b) the capping member is pivotally mounted to the carrier and is arranged to pivot relative to the carrier during back and forth transitional movement of the carrier between a transition position and the second position, where the transition position is located intermediate the first and second positions; and c) the protector comprises a covering member which is arranged to be engaged by the capping member when the capping member is located in the first position.

Optionally the covering member is constituted by the carrier.

Optionally the actuating mechanism is arranged to move the carrier pivotally between the first and second positions during a capping operation.

Optionally the carrier is pivotally mounted to a support by way of a pivotal element having a first pivot axis, and the capping member is pivotally mounted to the carrier by way of a pivoting arrangement having a second pivot axis that is located parallel to and spaced from the first pivot axis.

Optionally the capping member has a capping element that is radially displaced from the second pivot axis, and the radial displacement of the capping element from the second pivot axis is small relative to the spacing between the first and second pivot axes.

Optionally the spacing between the first and second pivot axes is of the order of three times the radial displacement of the capping element from the second pivot axis.

Optionally the transition position is located a distance from the second position which is small relative to the distance between the first and second positions.

Optionally the ratio of the transitional pivotal movement of the carrier to the total pivotal movement of the carrier between the first and second positions is within the range 1:12 to 1:20.

Optionally the capping element comprises a substantially rigid channel-shaped element.

Optionally the capping element incorporates a lip which is formed from an elastomeric material.

Optionally the capping element is arranged to engage with a face portion of the carrier when the carrier is located in the first position whereby a recessed portion of the capping element is effectively closed against loss of contained moisture and ingress of contaminating material.

Optionally the capping element incorporates a lip which is formed from an elastomeric material, wherein the lip is configured to locate about the print head nozzles when the capping member is in the second position, and wherein the lip is arranged to engage with a face portion of the carrier when the carrier is located in the first position whereby a recessed portion of the capping element is effectively closed against loss of contained moisture and ingress of contaminating material.

Optionally the capping member is provided with at least one first stop member that is arranged to contact the print head and thereby to effect pivoting of the capping member relative to the carrier as the carrier makes the transitional movement from the transition position to the second position.

Optionally the capping member is provided with at least one second stop member that is arranged to contact the carrier and thereby prevent pivoting of the capping member relative to the carrier as the carrier moves from the transition position to the first position.

Optionally the capping member is pivotally mounted to the carrier by a pivot shaft which extends along a marginal edge portion of the carrier.

Optionally a biasing device is mounted to the capping member and engages the carrier in a manner to bias the capping member in a direction away from nozzle capping engagement with the print head.

Optionally the biasing device comprises a torsion spring.

Optionally the actuating mechanism comprises an electric motor which is coupled to the carrier and arranged to impart pivotal motion to the carrier by way of a crank and a motion translating mechanism.

Optionally at least one abutment is located adjacent the print head and is operable to effect pivoting of the capping member when the carrier approaches the first position, whereby the capping member is moved away from the print media feed path.

In a further aspect there is provided an inkjet printer wherein;

the print head has a plurality of nozzles arranged to deliver ink onto print media which, in use, is transported past the print head; and the capping mechanism comprises:

a) a capping member that is configured to contact the print head in nozzle capping engagement, b) a carrier supporting the capping member, and c) an actuating mechanism arranged to effect movement of the carrier back and forth between a first position at which the capping member is located remotely with respect to the print head and a second position at which the capping member is located in contact with the print head;

the capping member being pivotally mounted to the carrier and being arranged to pivot relative to the carrier during back and forth transitional movement of the carrier between a transition position and the second position, where the transition position is located intermediate the first and second positions.

The invention may be embodied in various arrangements, one of which is now described by way of illustration with reference to the accompanying drawings.

DETAILED DESCRIPTION OF THE EXEMPLARY EMBODIMENT

Figure 1:
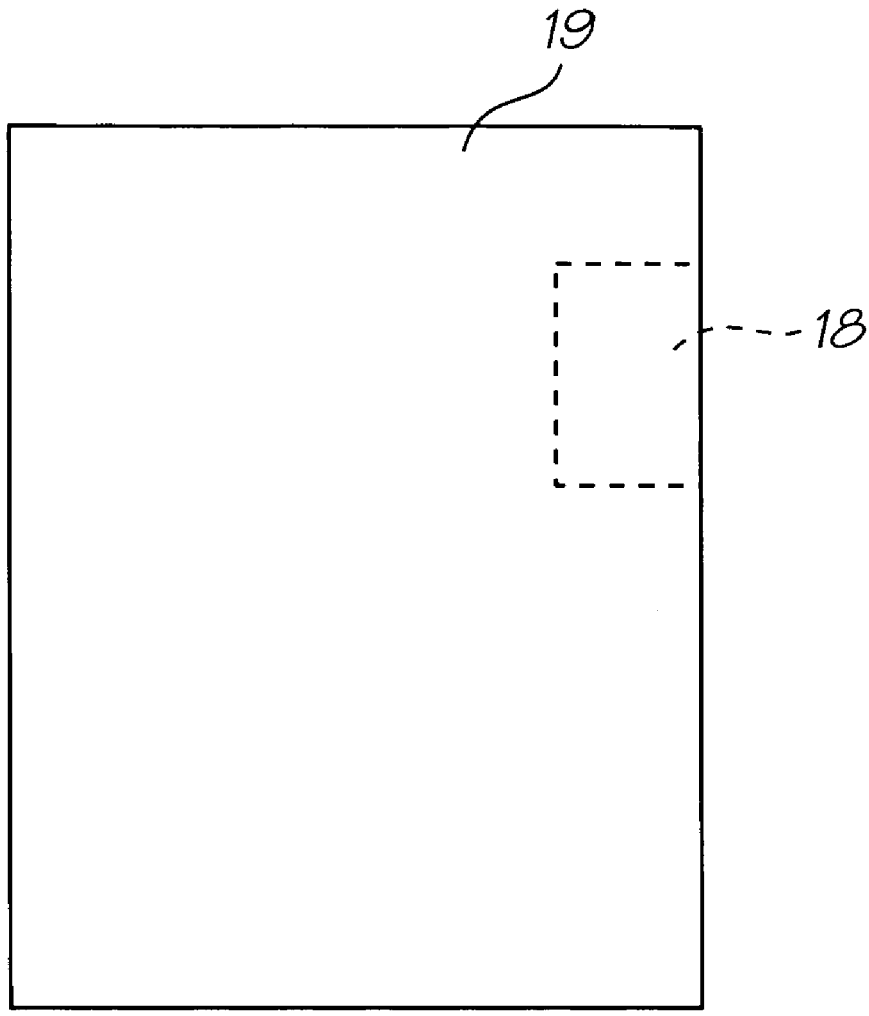
FIG. 1 is a diagrammatic illustration of a printer having a pagewidth printhead.
Figure 1A:
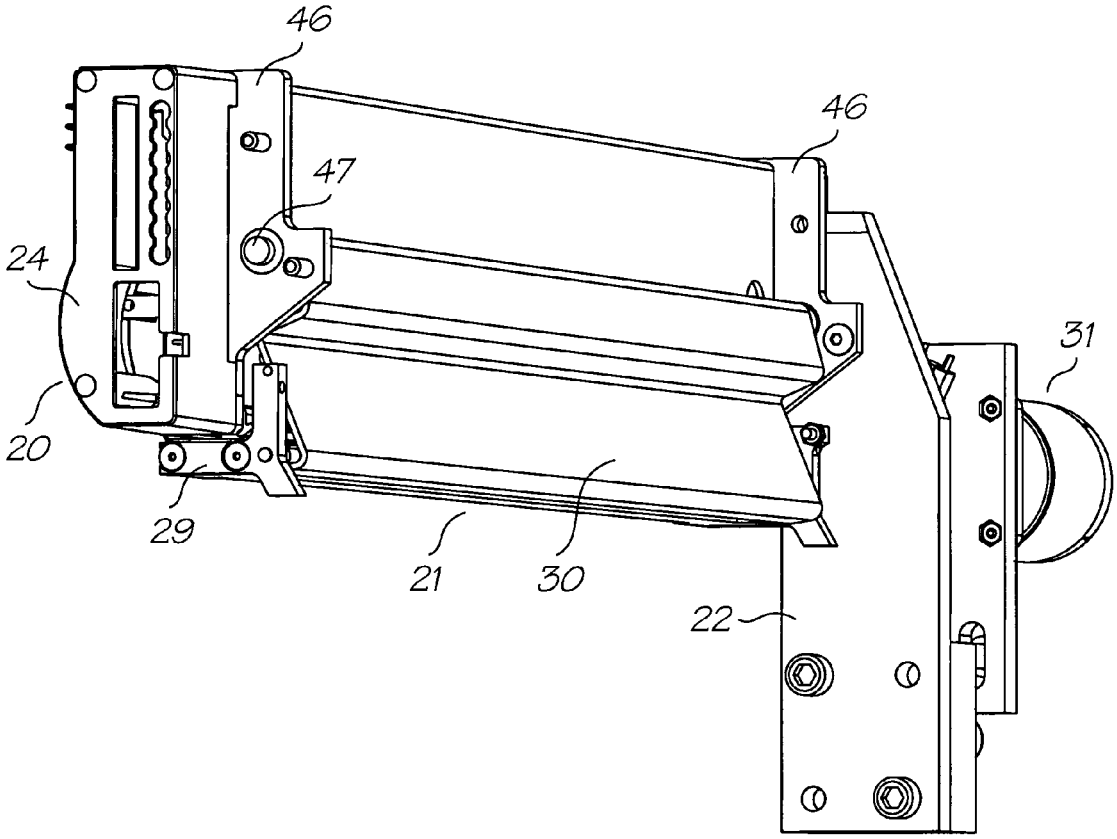
FIG. 1A shows, in perspective, an assembly of the pagewidth printhead and a capping mechanism mounted in operative relationship to the printhead, the assembly being removed from a printer chassis to which it normally would be mounted.
Figure 2:
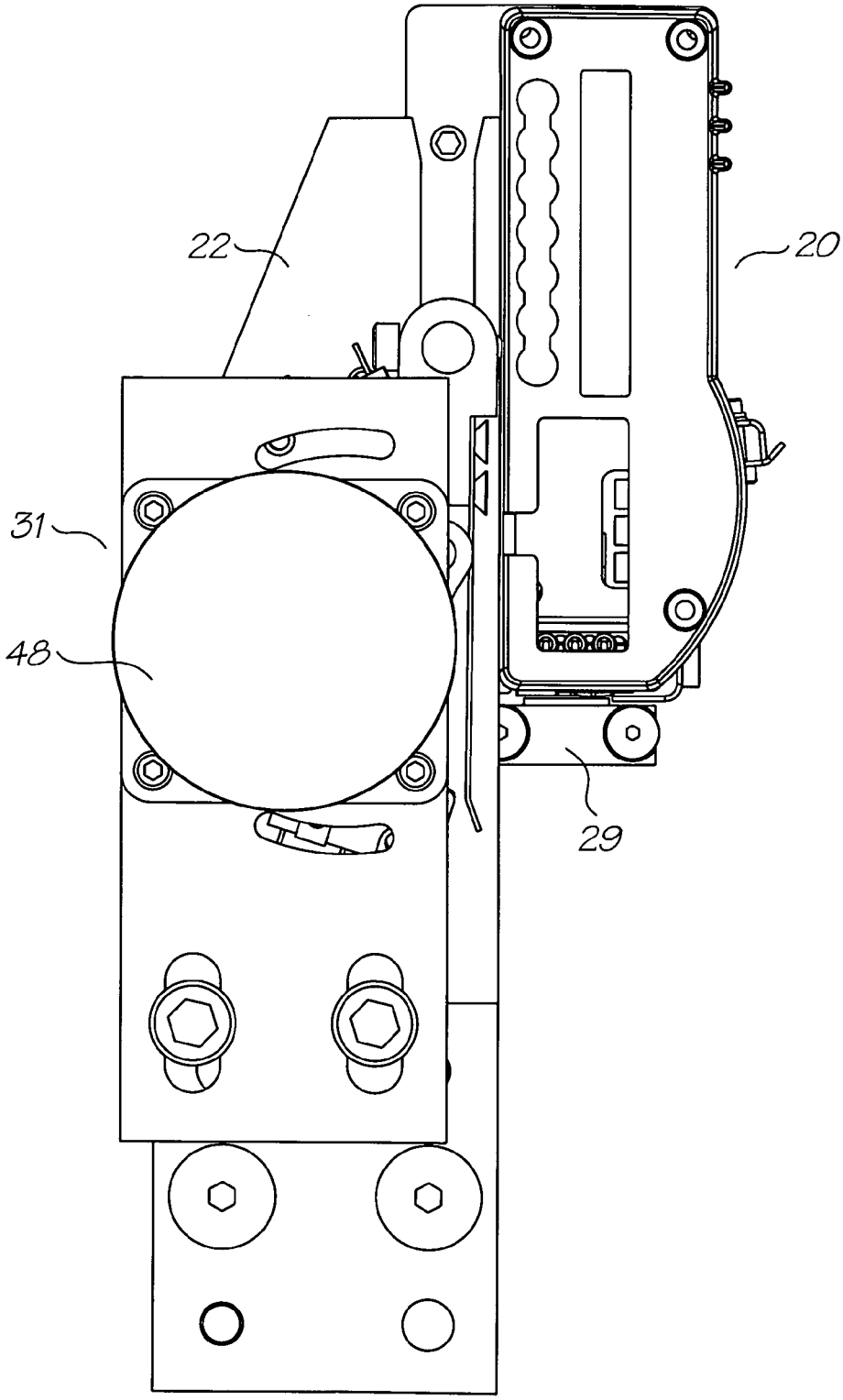
FIG. 2 shows an end view of the assembly as seen from the far end of FIG. 1.
Figure 3:
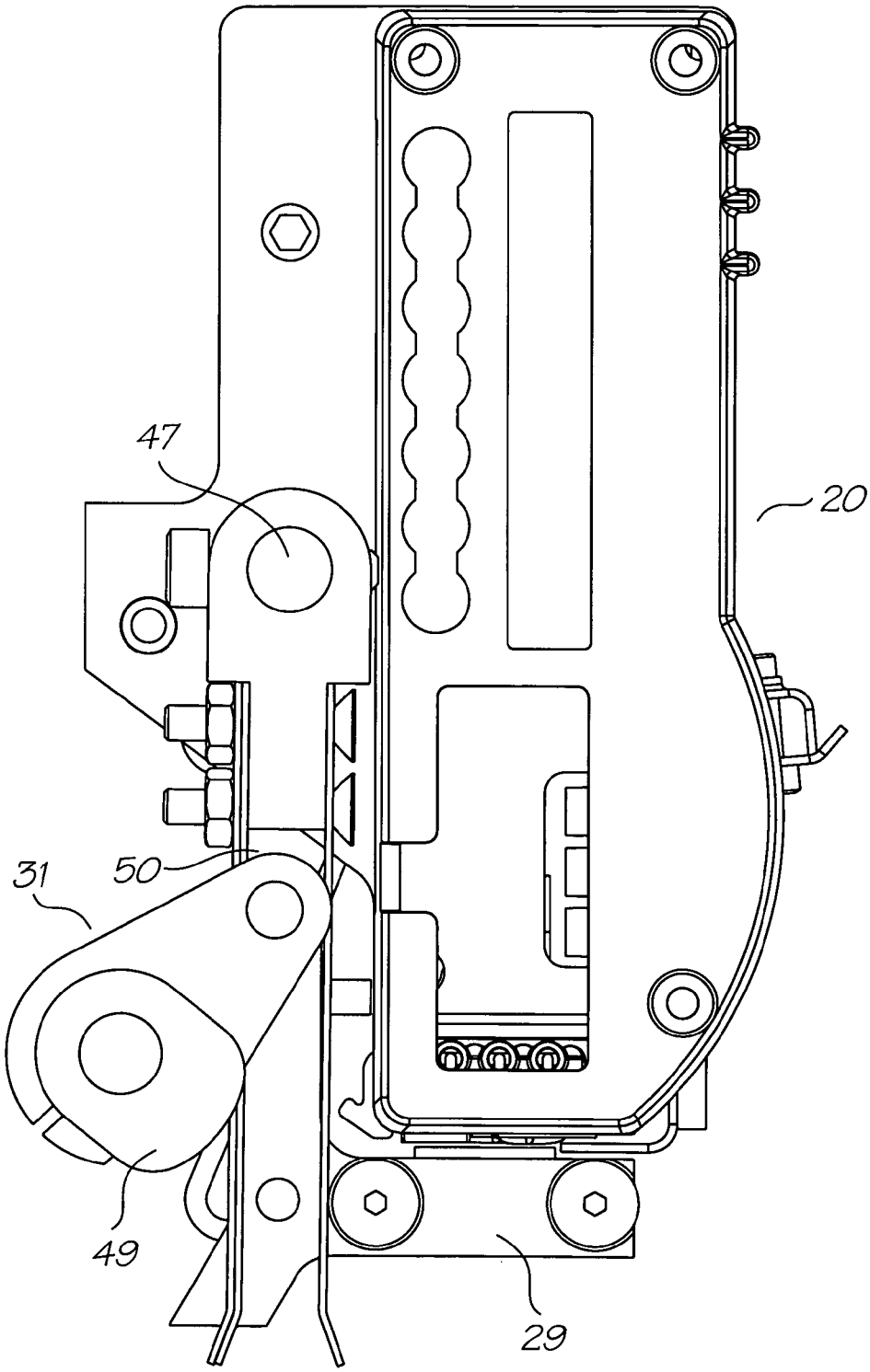
FIG. 3 shows a slightly enlarged view of the assembly as shown in FIG. 2 but with a drive motor and end plate removed to reveal an actuating mechanism that is driven by the drive motor.
Figure 4:
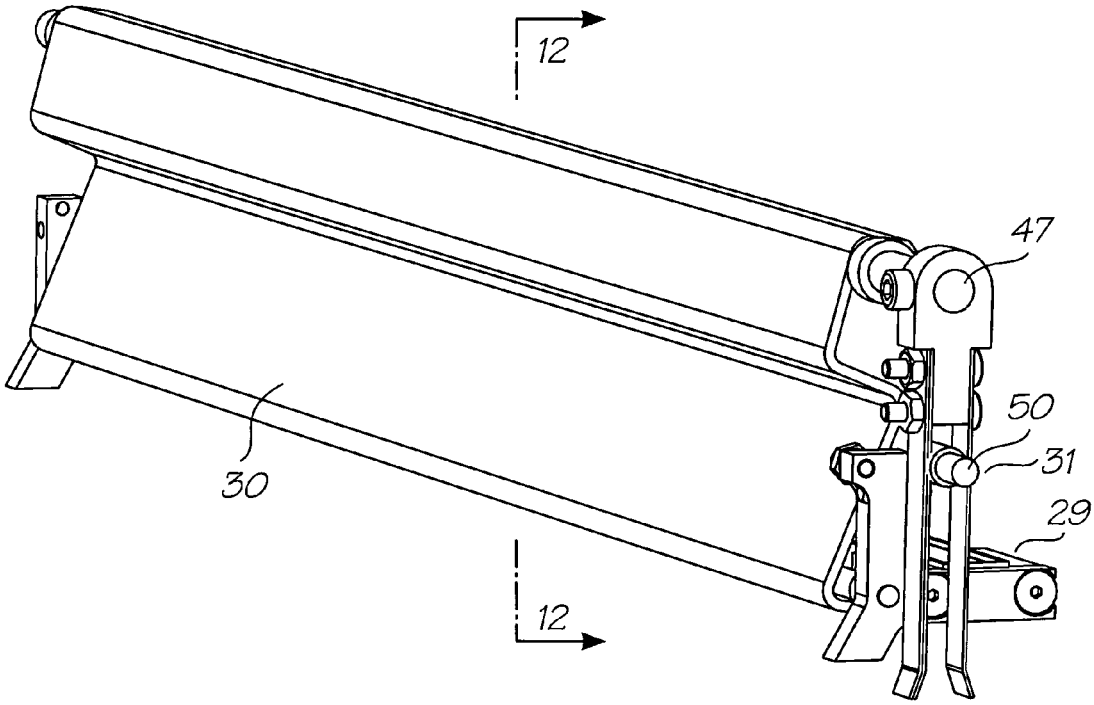
FIG. 4 shows a perspective view of the assembly as seen from the end shown in FIG. 3.
Figure 5:
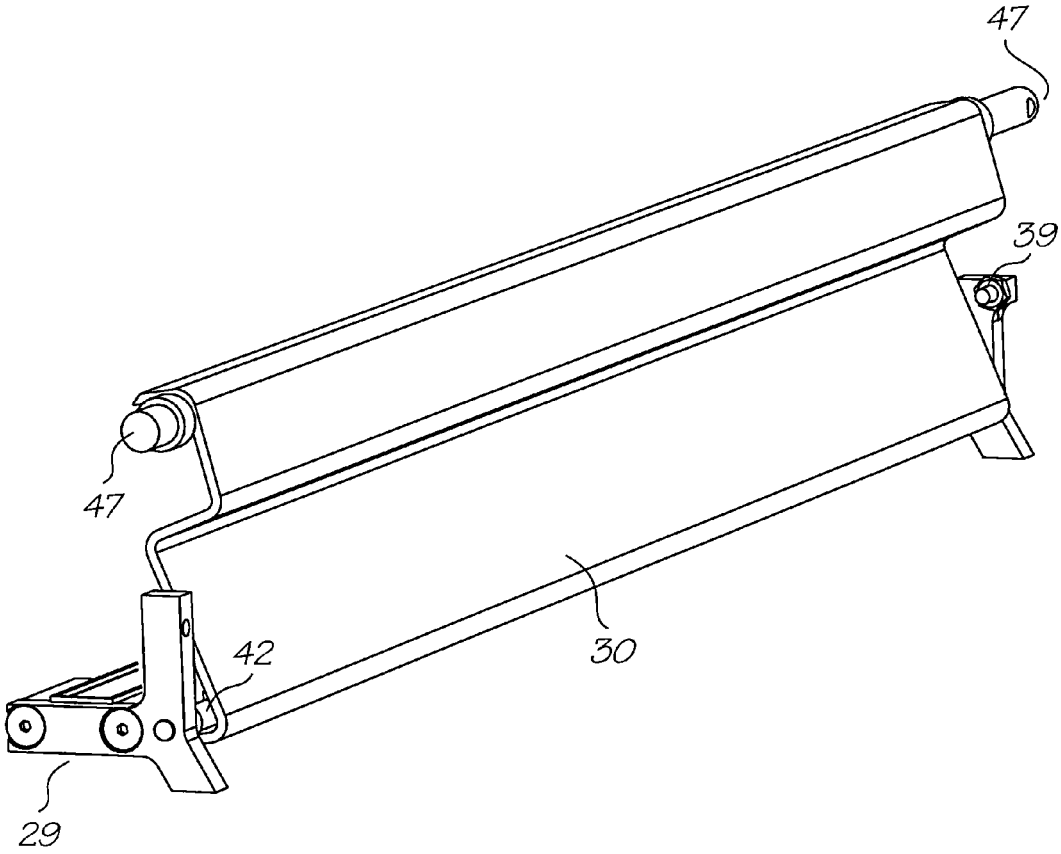
FIG. 5 shows a perspective view of the capping mechanism removed from the printhead.
Figure 6:
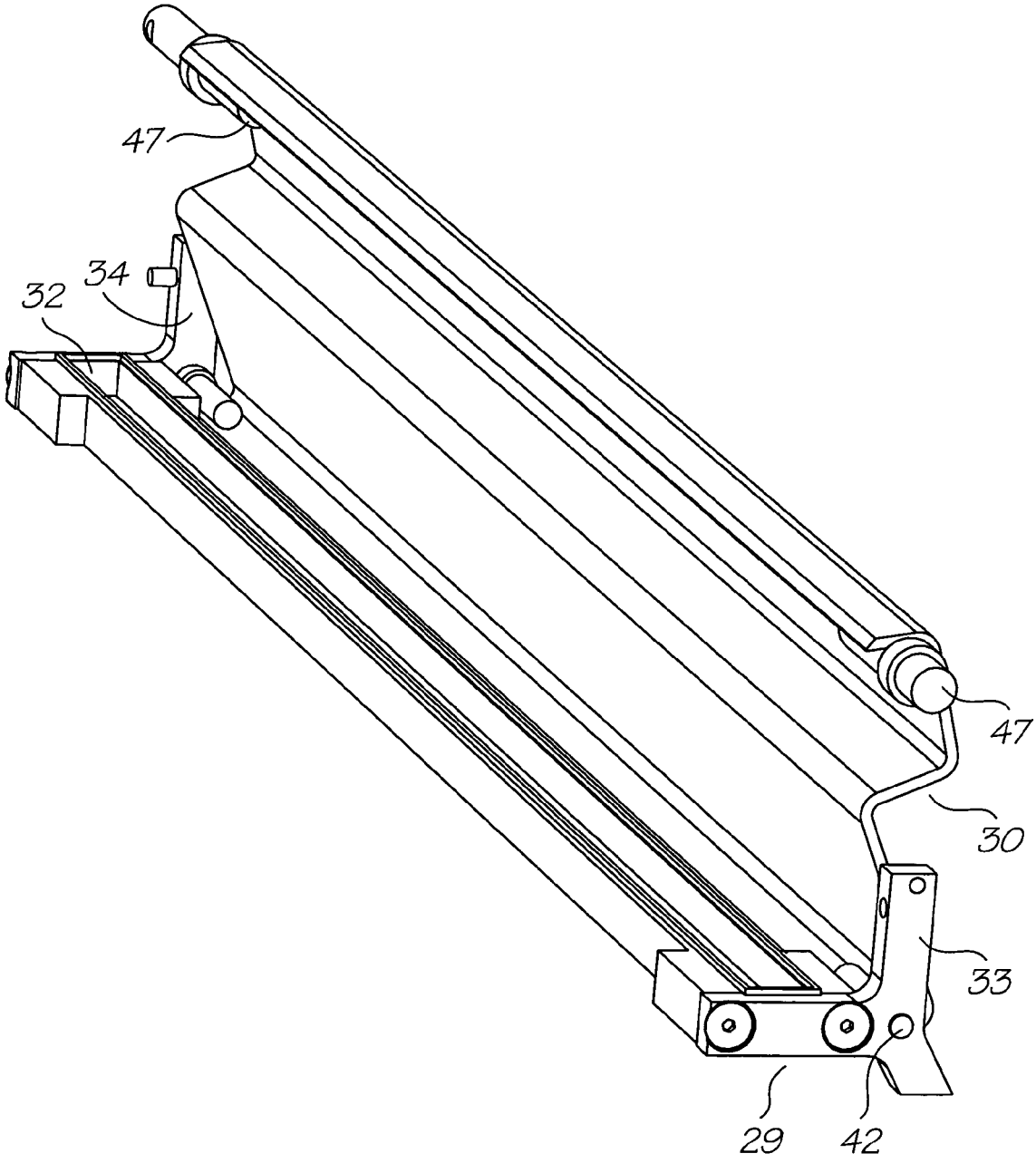
FIG. 6 shows, in perspective, an end view of the capping mechanism of FIG. 5.
Figure 7:
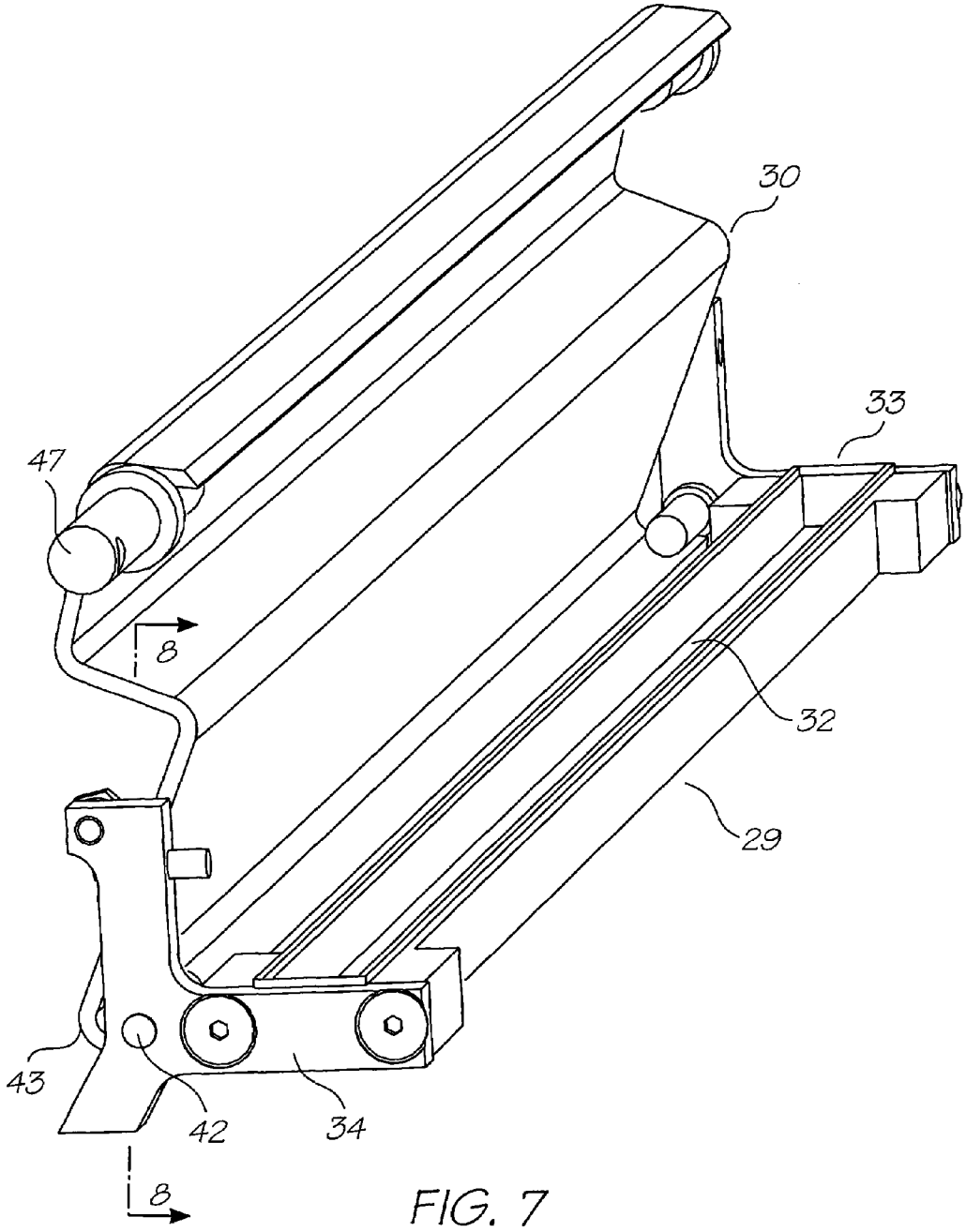
FIG. 7 shows, again in perspective, an opposite end view of the capping mechanism.

FIGS. 1A to 4 show an assembly 18 of a pagewidth printhead 20, a capping mechanism 21 and a mounting plate 22. The assembly 18 is shown removed from a mounting structure or chassis of the printer 19 that is shown diagrammatically in FIG. 1.

The printer 19 of FIG. 1 is shown diagrammatically because it may be constituted by any one of a large number of printer types; including desk-top, office, commercial and wide format printers. Also, the printer may incorporate a single sheet feed system or a roll-feed system for print media (also not shown), and it may be arranged for printing alpha-numeric, graphical or decorative images.

The printhead 20 may incorporate the features of or comprise any one of a number of different types of printheads, including thermal or piezo-electric activated bubble jet printheads as are known in the art.

Each of the printheads 20 may, for example, be in the form of that which is described in the Applicant's co-pending U.S. patent applications listed in the cross-references section above and all of which are incorporated herein by reference. But other types of pagewidth printheads (including thermal or piezo-electric activated bubble jet printers) that are known in the art may alternatively be employed.

As illustrated in FIGS. 16 to 20 for exemplification purposes, the printhead 20 comprises four printhead modules 23 mounted within a casing 24, each of which in turn comprises a unitary arrangement of:

a) a plastics material support member 25,
b) four printhead micro-electro-mechanical system (MEMS) integrated circuit chips 26 (referred to herein simply as "printhead chips"),
c) a fluid distribution arrangement 58 mounting each of the printhead chips 26 to the support member 25, and
d) a flexible printed circuit connector 59 for connecting electrical power and signals to each of the printhead chips 26.

However, it will be understood that each of the printheads 20 may comprise substantially more than four modules 23 and/or that substantially more than four printhead chips 26 may be mounted to each module.

Each of the chips (as described in more detail later) has up to 7680 nozzles formed therein for delivering printing fluid onto the surface of the print media and, possibly, a further 640 nozzles for delivering pressurised air or other gas toward the print media.

Figure 16:
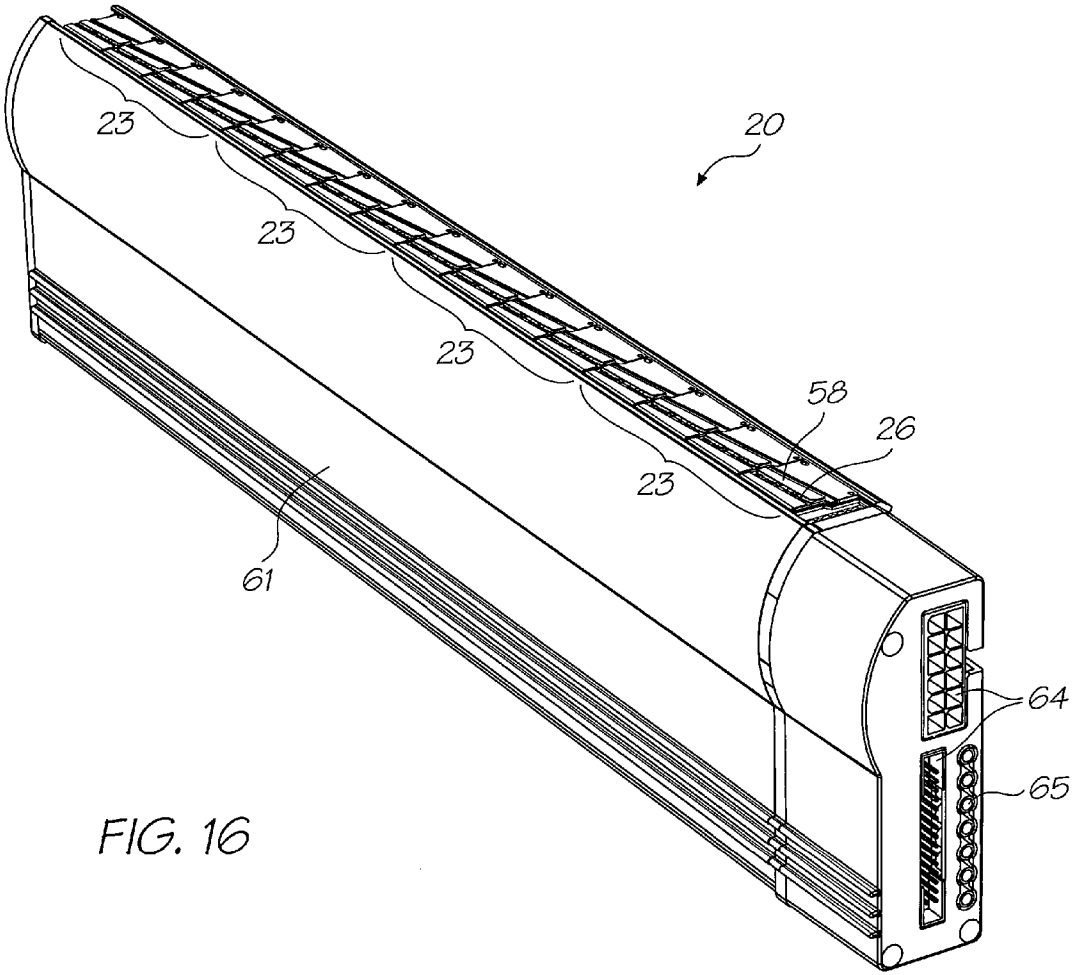
FIG. 16 shows a perspective view of one of the printheads as seen in the direction of a printing zone of the printhead.

The four printhead modules 23 are removably located in a channel portion 27 of a casing 24 by way of the support member 25, and the casing contains electrical circuitry 63 mounted on four printed circuit boards 62 (one for each printhead module 23) for controlling delivery of computer regulated power and drive signals by way of flexible PCB connectors 63*a* to the printhead chips 26. As illustrated in FIG. 16, electrical power and print activating signals are delivered to the printhead 51 by way of conductors 64, and printing ink and air are delivered by fluid delivery lines 65.

The printed circuit boards 62 are carried by plastics material mouldings 66 which are located within the casing 24 and the mouldings also carry busbars 67 which in turn carry current for powering the printhead chips 26 and the electrical circuitry. A cover 68 normally closes the casing 24 and, when closed, the cover acts against a loading element 69 that functions to urge the flexible printed circuit connector 59 against the busbars 67.

The four printhead modules 23 may incorporate four conjoined support members 25 or, alternatively, a single support member 25 may be provided to extend along the full length of the printhead 51 and be shared by all four printhead modules. That is, a single support member 25 may carry all sixteen printhead chips 26.

Figure 17:
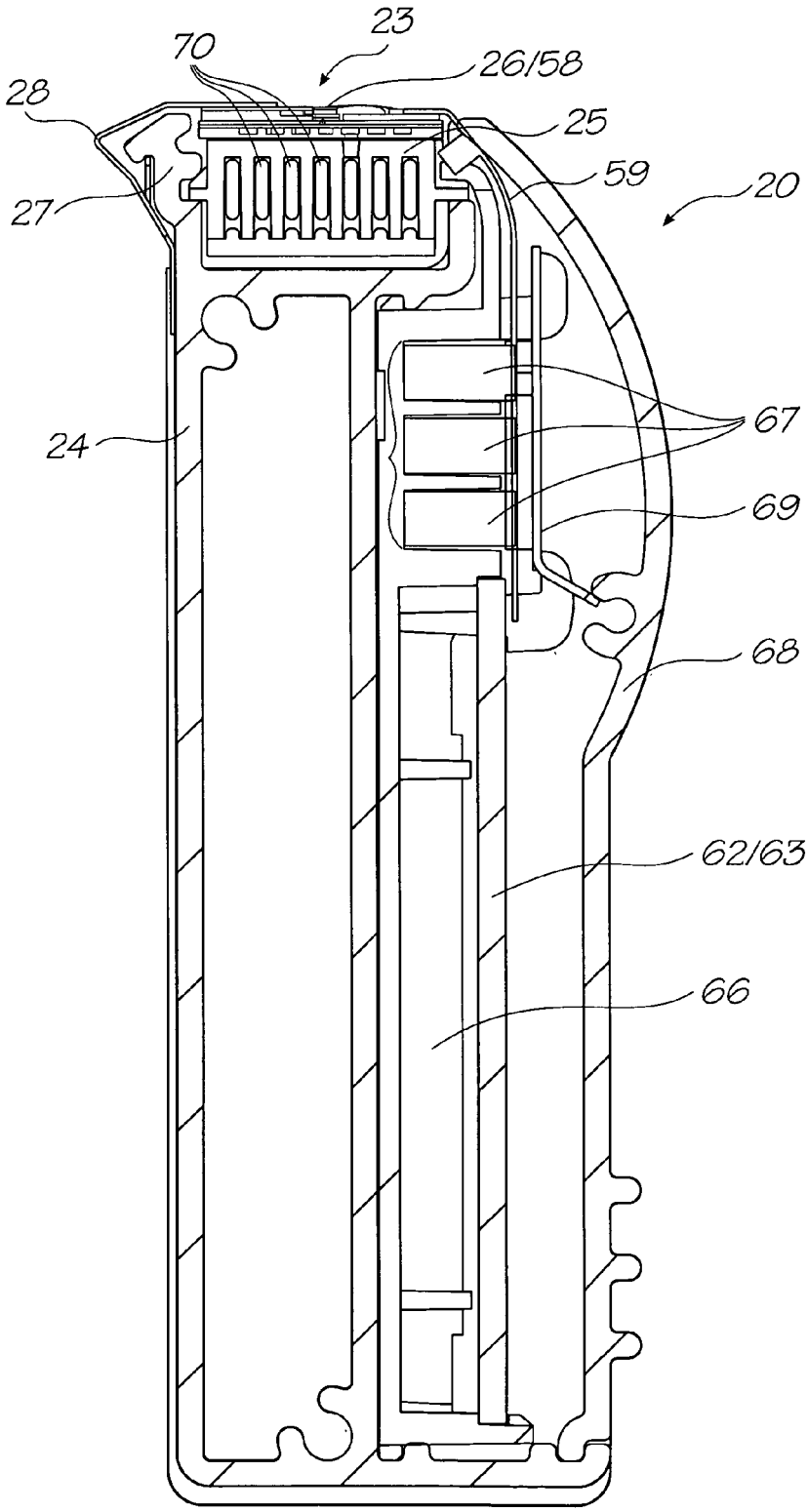
FIG. 17 shows a sectional end view of one of the printheads.
Figure 18:
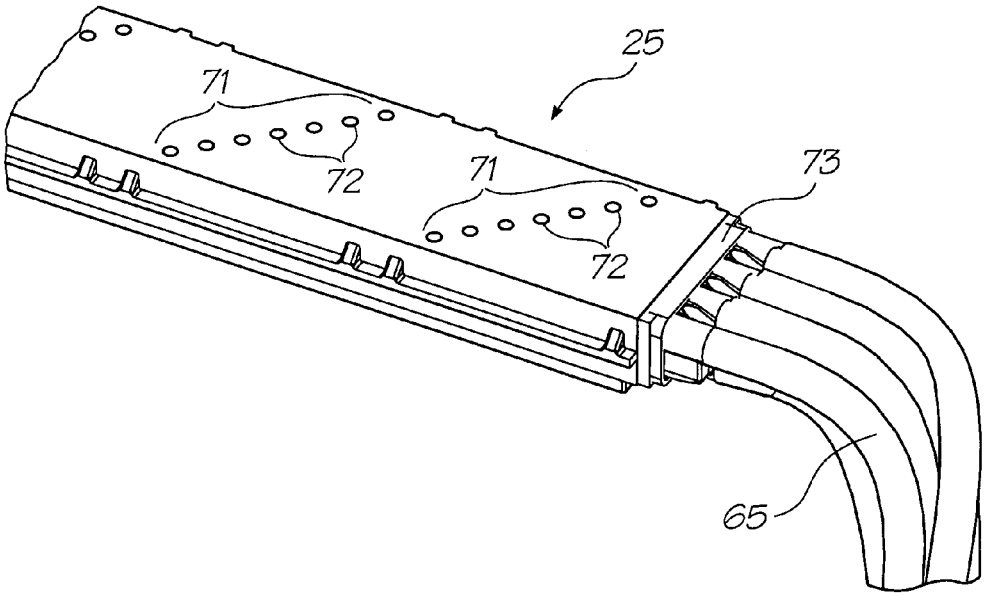
FIG. 18 shows a perspective view of an end portion of a channelled support member removed from the printhead of FIG. 17 and fluid delivery lines connected to the support member.
Figure 19:
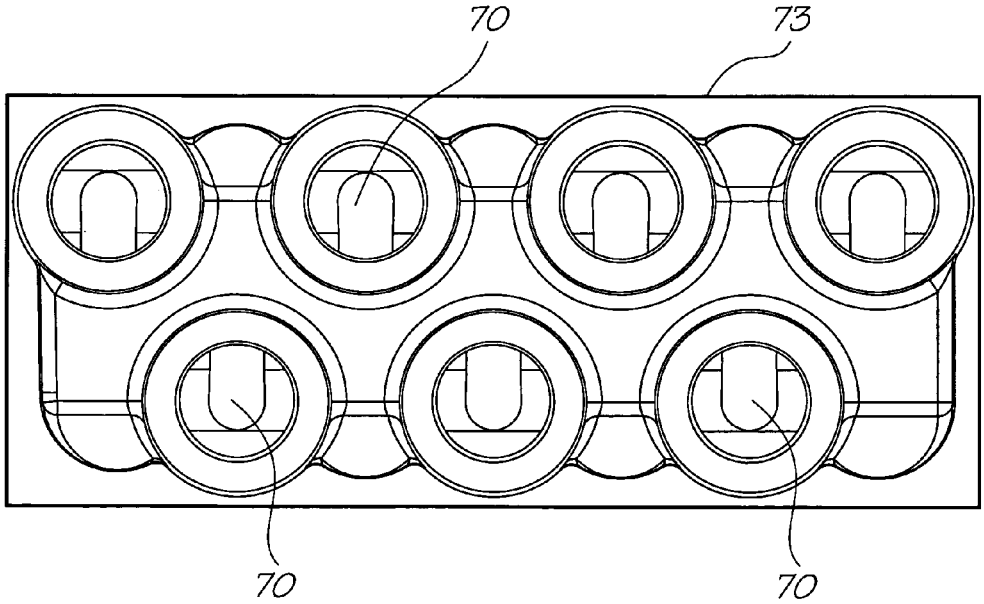
FIG. 19 shows an end view of connections made between the fluid delivery lines and the channelled support member of FIG. 18.
Figure 20:
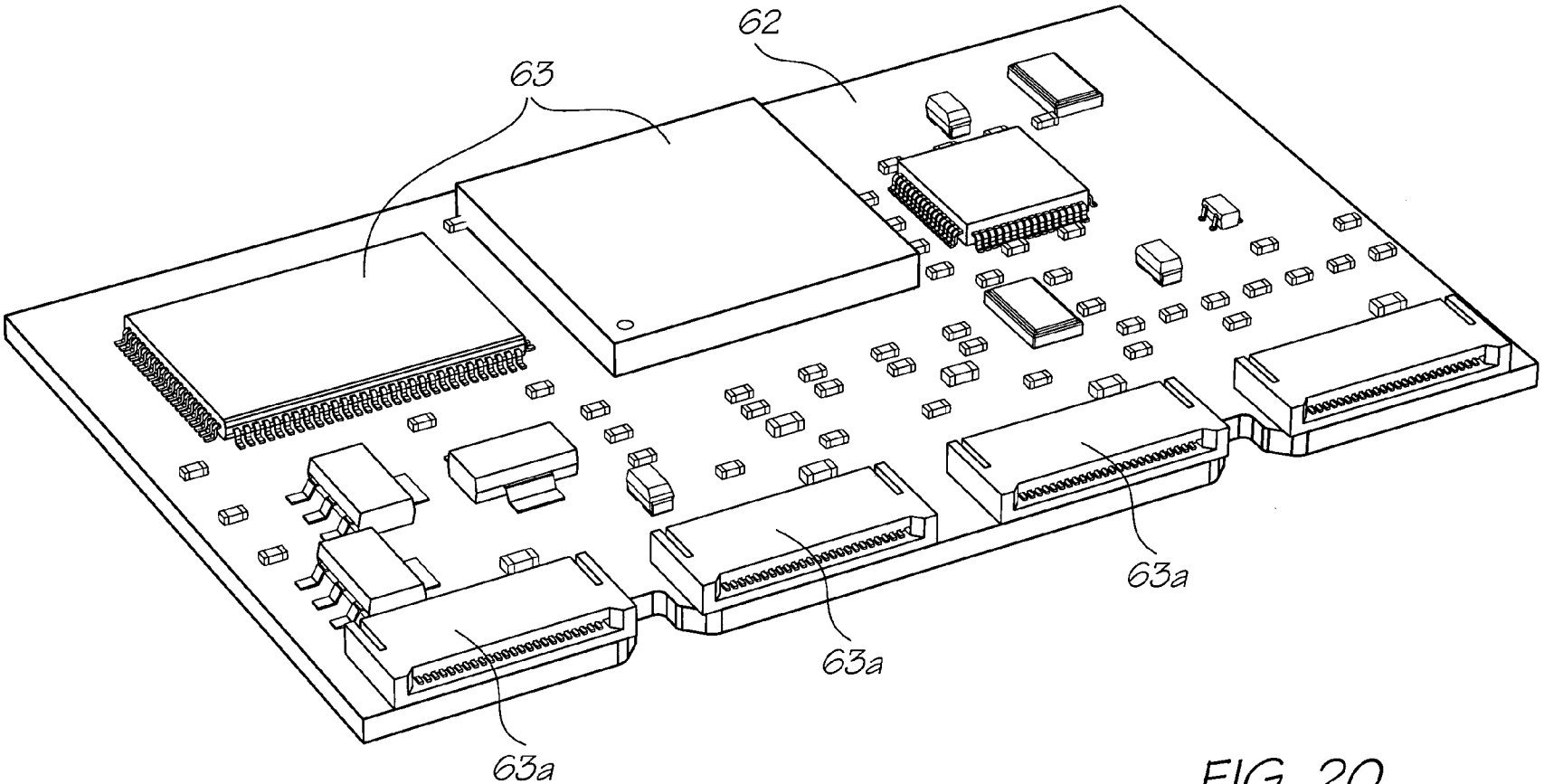
FIG. 20 shows a printed circuit board, with electronic components mounted to the board, when removed from a casing portion of the printhead of FIG. 17.
Figure 21:
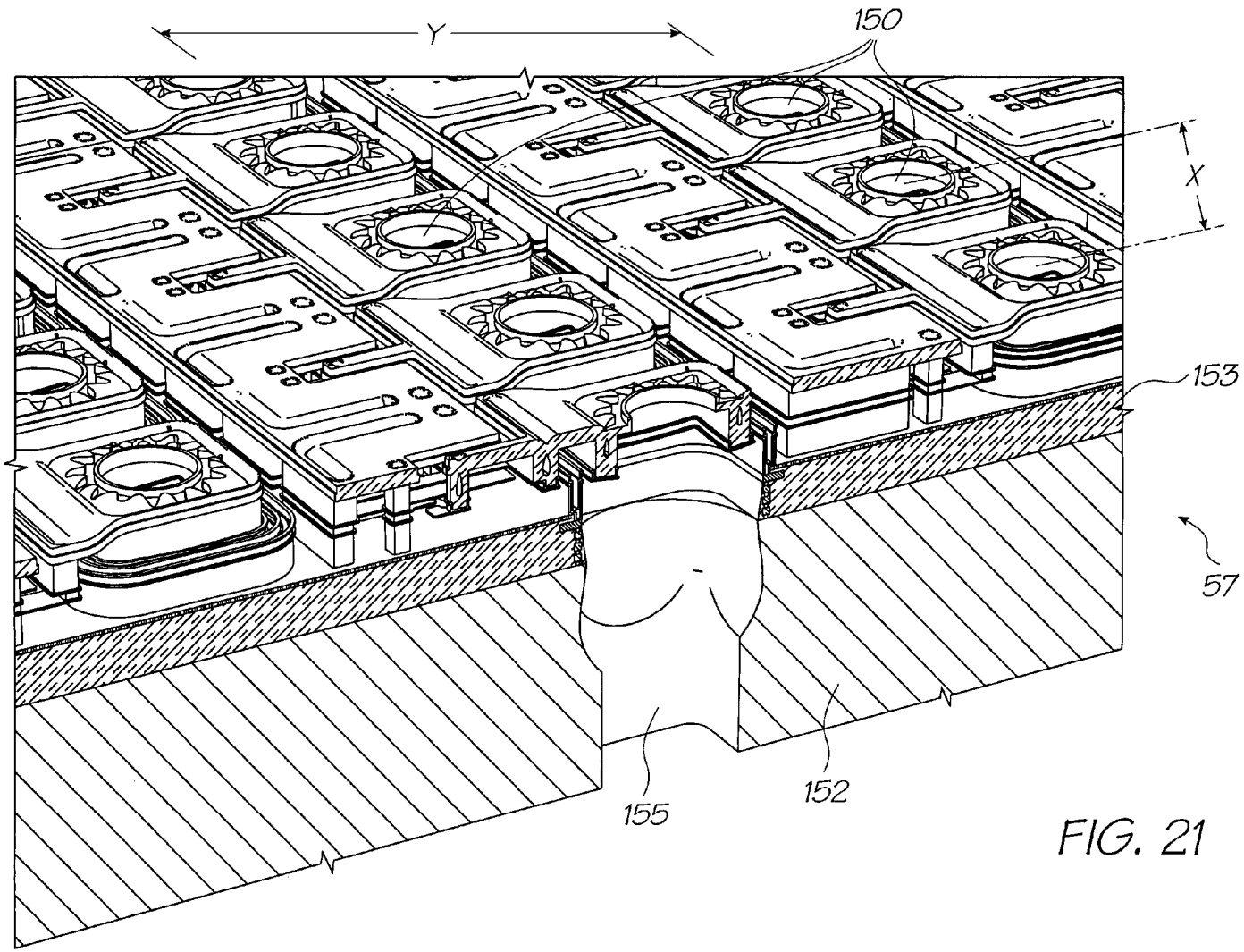
FIG. 21 shows, in perspective, a sectional view of a portion a printhead chip that is mounted to the printhead and which incorporates printing fluid delivery nozzles and nozzle actuators.
Figure 22:
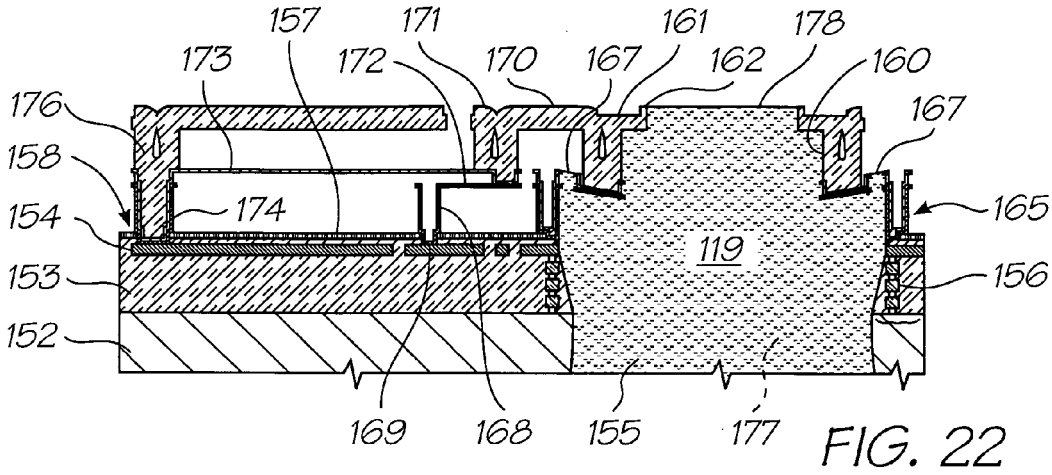
FIG. 22 shows a vertical section of a single nozzle in a quiescent state.

As shown in FIGS. 17 and 18, the support member 25 comprises an extrusion that is formed with seven longitudinally extending closed channels 70, and the support member is provided in its upper surface with groups 71 of millimetric sized holes. Each group comprises seven separate holes 72 which extend into respective ones of the channels 70 and each group of holes is associated with one of the printhead chips 26. Also, the holes 72 of each group are positioned obliquely across the support member 25 in the longitudinal direction of the support member.

A coupling device 73 is provided for coupling fluid into the seven channels 70 from respective ones of the fluid delivery lines 65.

The fluid distribution arrangements 58 are provided for channelling fluid (printing ink and air) from each group 71 of holes to an associated one of the printhead chips 26. Printing fluids from six of the seven channel 70 are delivered to twelve rows of nozzles on each printhead chip 26 (ie, one fluid to two rows) and the millimetric-to-micrometric distribution of the fluids is effected by way of the fluid distribution arrangements 58. For a more detailed description of one arrangement for achieving this process reference may be made to the co-pending U.S. patent applications referred to previously.

An illustrative embodiment of one printhead chip 26 is described in more detail below, with reference to FIGS. 21 to 30; as is an illustrative embodiment of a print engine controller for the printhead 20. The print engine controller is also later described with reference to FIGS. 31 to 33.

A print media guide 28 is mounted to the printhead 20 and is shaped and arranged to guide the print media past the printing zone, as defined collectively by the printhead chips 26, in a manner to preclude the print media from contacting the nozzles of the printhead chips.

The fluids to be delivered to the printheads 20 will be determined by the functionality of the printer. However, as illustrated, provision is made for delivering six printing fluids and air to the printhead chips 26 by way of the seven channels 70 in the support member 25. The six printing fluids may comprise:

Cyan (C) printing ink
Magenta (M) printing ink
Yellow (Y) printing ink
Black (K) printing ink
Infrared (IR) ink
Fixative.

The filtered air will in use be delivered at a pressure slightly above atmospheric from a pressurised source (not shown) that is integrated in the printer.

One of the printhead chips 26 is now described in more detail with reference to FIGS. 21 to 30.

As indicated above, each printhead chip 26 is provided with 7680 printing fluid delivery nozzles 150. The nozzles are arrayed in twelve rows 151, each having 640 nozzles, with an inter-nozzle spacing X of 32 microns. Adjacent rows are staggered by a distance equal to one-half of the inter-nozzle spacing so that a nozzle in one row is positioned mid-way between two nozzles in adjacent rows. Also, there is an inter-nozzle spacing Y of 80 microns between adjacent rows of nozzles.

Two adjacent rows of the nozzles 150 are fed from a common supply of printing fluid. This, with the staggered arrangement, allows for closer spacing of ink dots during printing than would be possible with a single row of nozzles and also allows for a level of redundancy that accommodates nozzle failure.

The printhead chips 26 are manufactured using an integrated circuit fabrication technique and, as previously indicated, embody micro-electromechanical systems (MEMS). Each printhead chip 26 includes a silicon wafer substrate 152, and a 0.42 micron 1 P4M 12 volt CMOS microprocessing circuit is formed on the wafer. Thus, a silicon dioxide layer 153 is deposited on the substrate 152 as a dielectric layer and aluminium electrode contact layers 154 are deposited on the silicon dioxide layer 153. Both the substrate 152 and the layer 153 are etched to define an ink channel 155, and an aluminium diffusion barrier 156 is positioned about the ink channel 155.

A passivation layer 157 of silicon nitride is deposited over the aluminium contact layers 154 and the layer 153. Portions of the passivation layer 157 that are positioned over the contact layers 154 have openings 158 therein to provide access to the contact layers.

Each nozzle 150 includes a nozzle chamber 159 which is defined by a nozzle wall 160, a nozzle roof 161 and a radially inner nozzle rim 162. The ink channel 155 is in fluid communication with the chamber 159.

Figure 25:
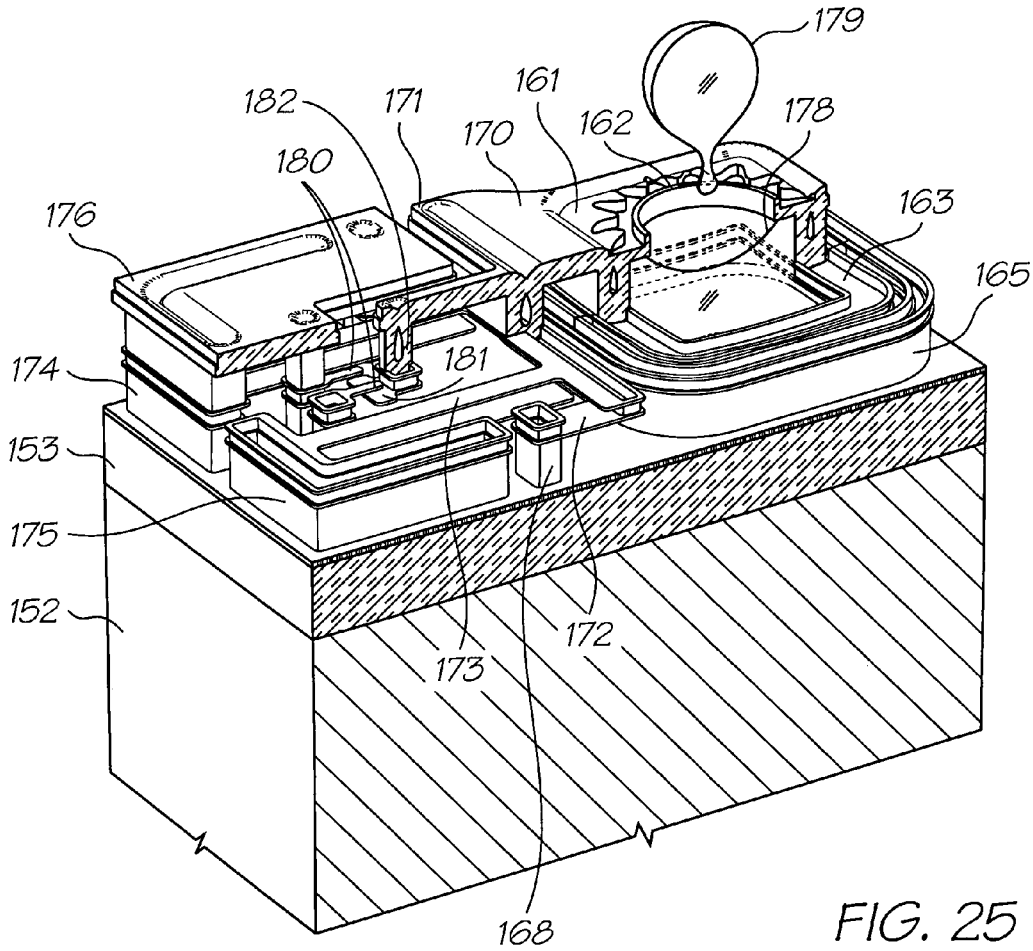
FIG. 25 shows a perspective view of a single nozzle in the activation state shown in FIG. 24.
Figure 26:
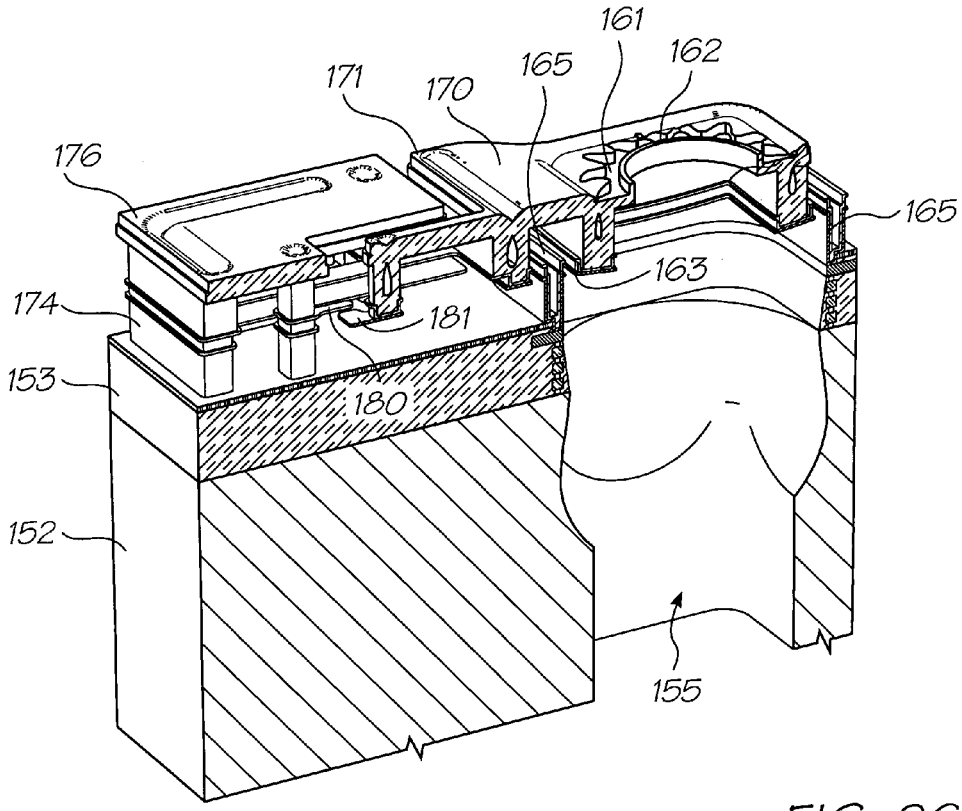
FIG. 26 shows in perspective a sectioned view of the nozzle of FIG. 25.
Figure 27:
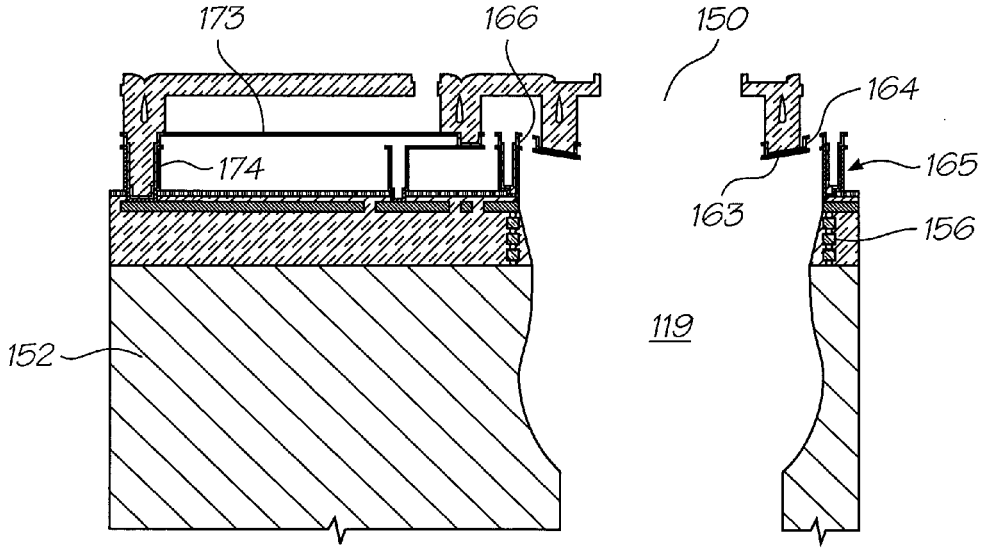
FIG. 27 shows a sectional elevation view of the nozzle of FIG. 25.

A moveable rim 163, that includes a movable seal lip 164, is located at the lower end of the nozzle wall 160. An encircling wall 165 surrounds the nozzle and provides a stationery seal lip 166 that, when the nozzle 150 is at rest as shown in FIG. 25, is adjacent the moveable rim 163. A fluidic seal 167 is formed due to the surface tension of ink trapped between the stationery seal 166 and the moveable seal lip 164. This prevents leakage of ink from the chamber whilst providing a low resistance coupling between the encircling wall 165 and a nozzle wall 160.

Figure 28:
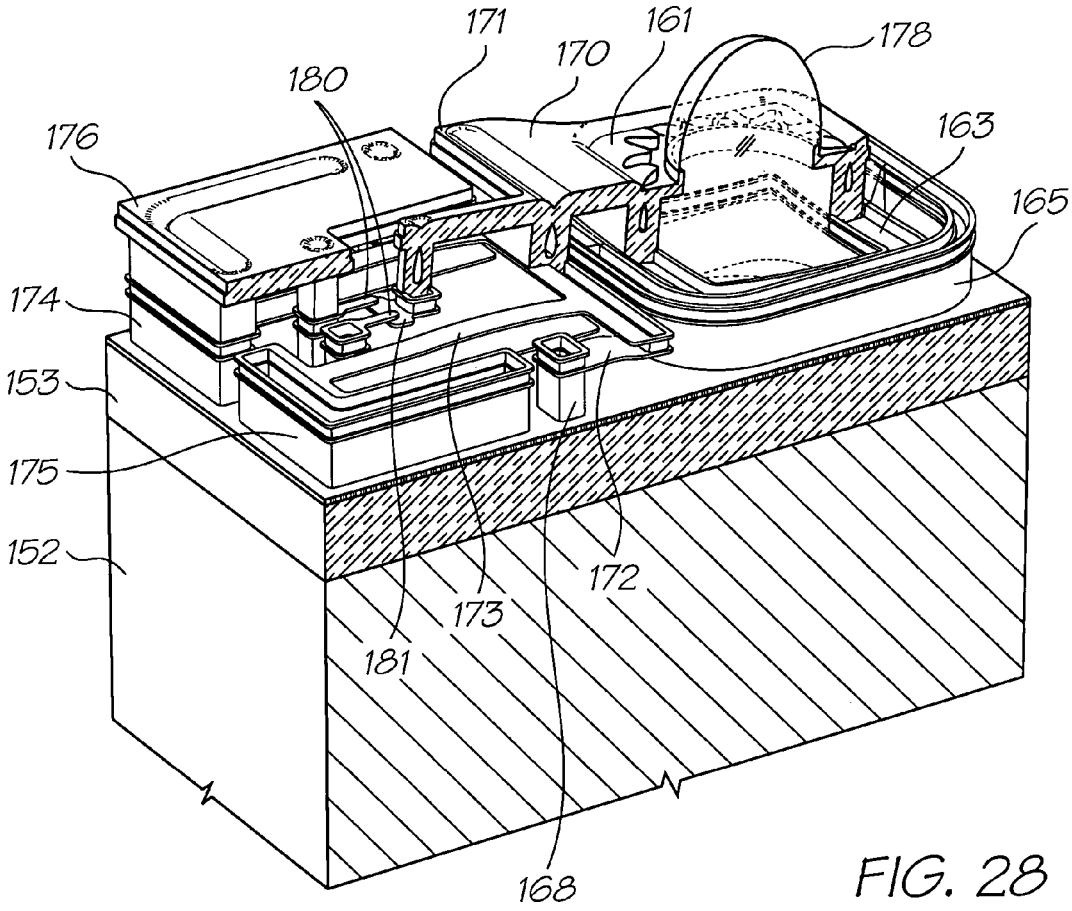
FIG. 28 shows in perspective a partial sectional view of the nozzle of FIG. 23.
Figure 29:
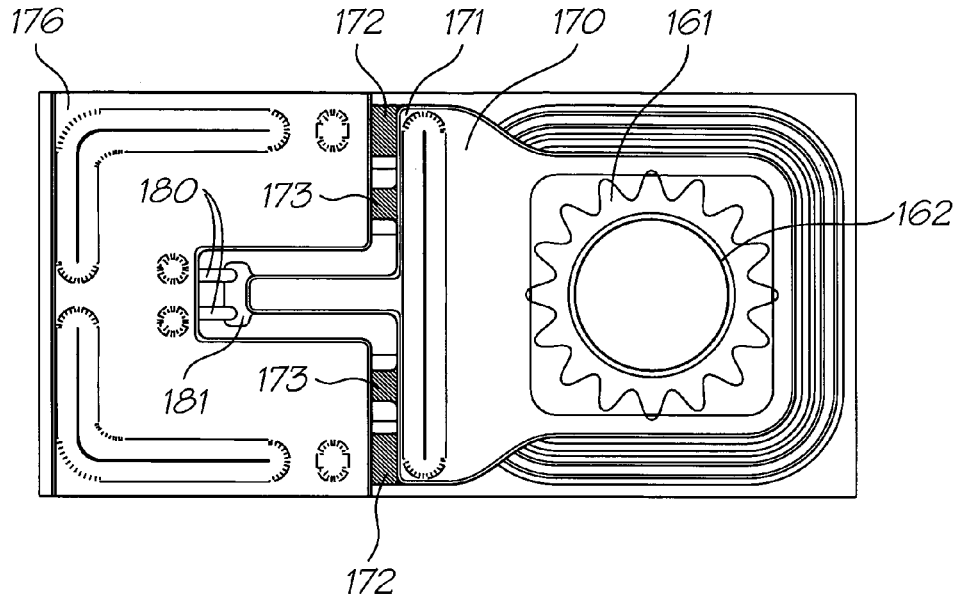
FIG. 29 shows a plan view of the nozzle of FIG. 22.

The nozzle wall 160 forms part of lever arrangement that is mounted to a carrier 168 having a generally U-shaped profile with a base 169 attached to the layer 157. The lever arrangement also includes a lever arm 170 that extends from the nozzle wall and incorporates a lateral stiffening beam 171. The lever arm 170 is attached to a pair of passive beams 172 that are formed from titanium nitride and are positioned at each side of the nozzle as best seen in FIGS. 25 and 28. The other ends of the passive beams 172 are attached to the carriers 168. The lever arm 170 is also attached to an actuator beam 173, which is formed from TiN. This attachment to the actuator beam is made at a point a small but critical distance higher than the attachments to the passive beam 172.

As can best be seen from FIGS. 25 and 28, the actuator beam 173 is substantially U-shaped in plan, defining a current path between an electrode 174 and an opposite electrode 175. Each of the electrodes 174 and 175 is electrically connected to a respective point in the contact layer 154. The actuator beam 173 is also mechanically secured to an anchor 176, and the anchor 176 is configured to constrain motion of the actuator beam 173 to the left of FIGS. 22 to 24 when the nozzle arrangement is activated.

The actuator beam 173 is conductive, being composed of TiN, but has a sufficiently high electrical resistance to generate self-heating when a current is passed between the electrodes 174 and 175. No current flows through the passive beams 172, so they do not experience thermal expansion.

In operation, the nozzle is filled with ink 177 that defines a meniscus 178 under the influence of surface tension. The ink is retained in the chamber 159 by the meniscus, and will not generally leak out in the absence of some other physical influence.

To fire ink from the nozzle, a current is passed between the contacts 174 and 175, passing through the actuator beam 173. The self-heating of the beam 173 causes the beam to expand, and the actuator beam 173 is dimensioned and shaped so that the beam expands predominantly in a horizontal direction with respect to FIGS. 22 to 24. The expansion is constrained to the left by the anchor 176, so the end of the actuator beam 173 adjacent the lever arm 170 is impelled to the right.

The relative horizontal inflexibility of the passive beams 172 prevents them from allowing much horizontal movement of the lever arm 170. However, the relative displacement of the attachment points of the passive beams and actuator beam respectively to the lever arm causes a twisting movement that, in turn, causes the lever arm 170 to move generally downwardly with a pivoting or hinging motion. However, the absence of a true pivot point means that rotation is about a pivot region defined by bending of the passive beams 172.

Figure 23:
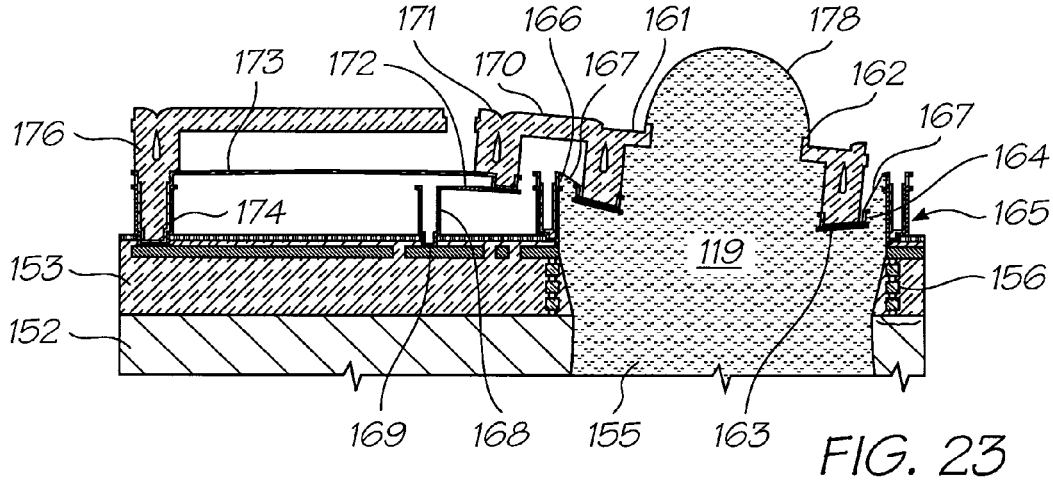
FIG. 23 shows a vertical section of a single nozzle in an initial activation state.

The downward movement (and slight rotation) of the lever arm 170 is amplified by the distance of the nozzle wall 160 from the passive beams 172. The downward movement of the nozzle walls and roof causes a pressure increase within the chamber 159, causing the meniscus 178 to bulge as shown in FIG. 23, although the surface tension of the ink causes the fluid seal 167 to be stretched by this motion without allowing ink to leak out.

Figure 30:
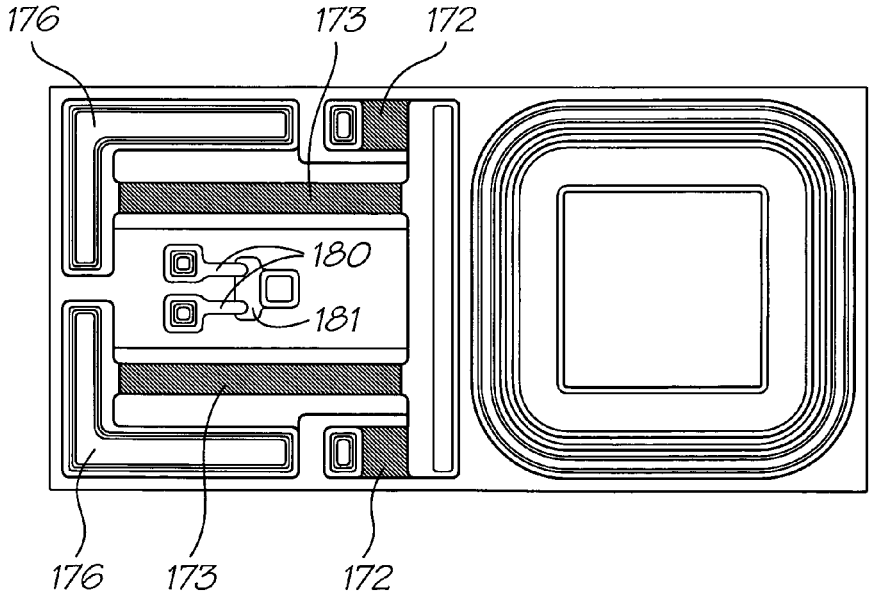
FIG. 30 shows a view similar to FIG. 29 but with lever arm and moveable nozzle portions omitted.

As shown in FIG. 30, at the appropriate time the drive current is stopped and the actuator beam 173 quickly cools and contracts. The contraction causes the lever arm to commence its return to the quiescent position, which in turn causes a reduction in pressure in the chamber 159. The interplay of the momentum of the bulging ink and its inherent surface tension, and the negative pressure caused by the upward movement of the nozzle chamber 159 causes thinning, and ultimately snapping, of the bulging meniscus 178 to define an ink drop 179 that continues outwardly until it contacts passing print media.

Figure 24:
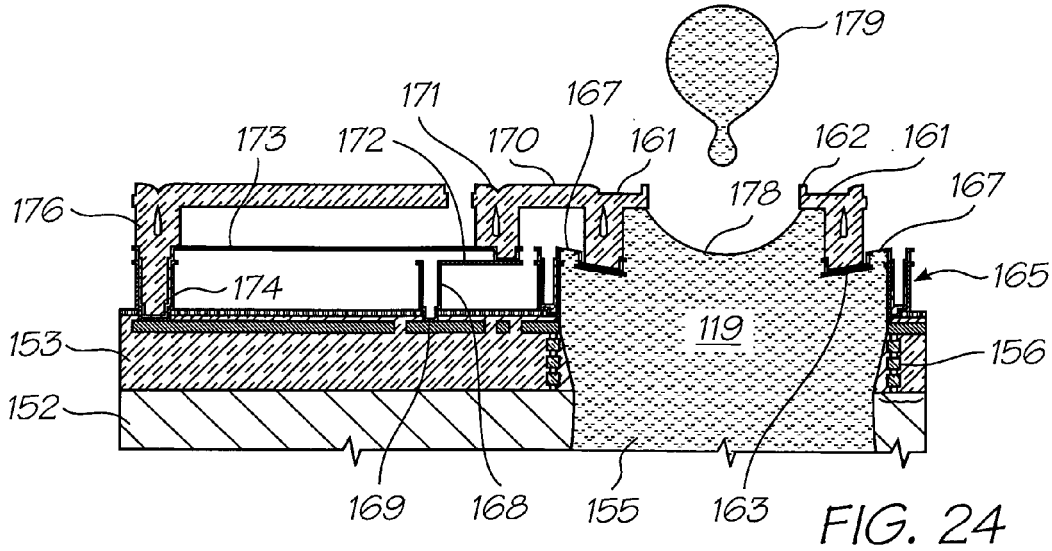
FIG. 24 shows a vertical section of a single nozzle in a later activation state.

Immediately after the drop 179 detaches, the meniscus 178 forms the concave shape shown in FIG. 24. Surface tension causes the pressure in the chamber 159 to remain relatively low until ink has been sucked upwards through the inlet 155, which returns the nozzle arrangement and the ink to the quiescent situation shown in FIG. 24. As can best be seen from FIG. 25, the printhead chip 26 also incorporates a test mechanism that can be used both post-manufacture and periodically after the print head assembly has been installed. The test mechanism includes a pair of contacts 180 that are connected to test circuitry (not shown). A bridging contact 181 is provided on a finger 182 that extends from the lever arm 170. Because the bridging contact 181 is on the opposite side of the passive beams 172, actuation of the nozzle causes the bridging contact 181 to move upwardly, into contact with the contacts 180. Test circuitry can be used to confirm that actuation causes this closing of the circuit formed by the contacts 180 and 181. If the circuit is closed appropriately, it can generally be assumed that the nozzle is operative.

As stated previously the integrated circuits of the printhead chip 26 is controlled by the print engine controller (PEC) integrated circuits of the drive electronics 63. One or more PEC integrated circuits 190 is or are provided (depending upon the printing speed required) in order to enable page-width printing over a variety of different sized pages or continuous sheets. As described previously, each of the printed circuit boards 62 carried by the support moulding 66 carries one PEC integrated circuit 190 (FIG. 31) which interfaces with four of the printhead chips 26, and the PEC integrated circuit 190 essentially drives the integrated circuits of the printhead chips 26 and transfers received print data thereto in a form suitable to effect printing.

An example of a PEC integrated circuit which is suitable for driving the printhead chips is described in the Applicant's co-pending U.S. patent application Ser. Nos. 09/575,108, 09/575,109, 09/575,110, 09/607,985, 09/607,990 and 09/606,999, which are incorporated herein by reference.

However, a brief description of the circuit is provided as follows with reference to FIGS. 31 to 33.

The data flow and functions performed by the PEC integrated circuit 190 are described for a situation where the PEC integrated circuit is provided for driving a printhead 20 having a plurality of printhead modules 23; that is four modules as described above. As also described above, each printhead module 23 provides for six channels of fluid for printing, these being:

- Cyan, Magenta and Yellow (CMY) for regular colour printing;
- Black (K) for black text and other black or greyscale printing;
- Infrared (IR) for tag-enabled applications; and
- Fixative (F) to enable printing at high speed.

Figure 31:
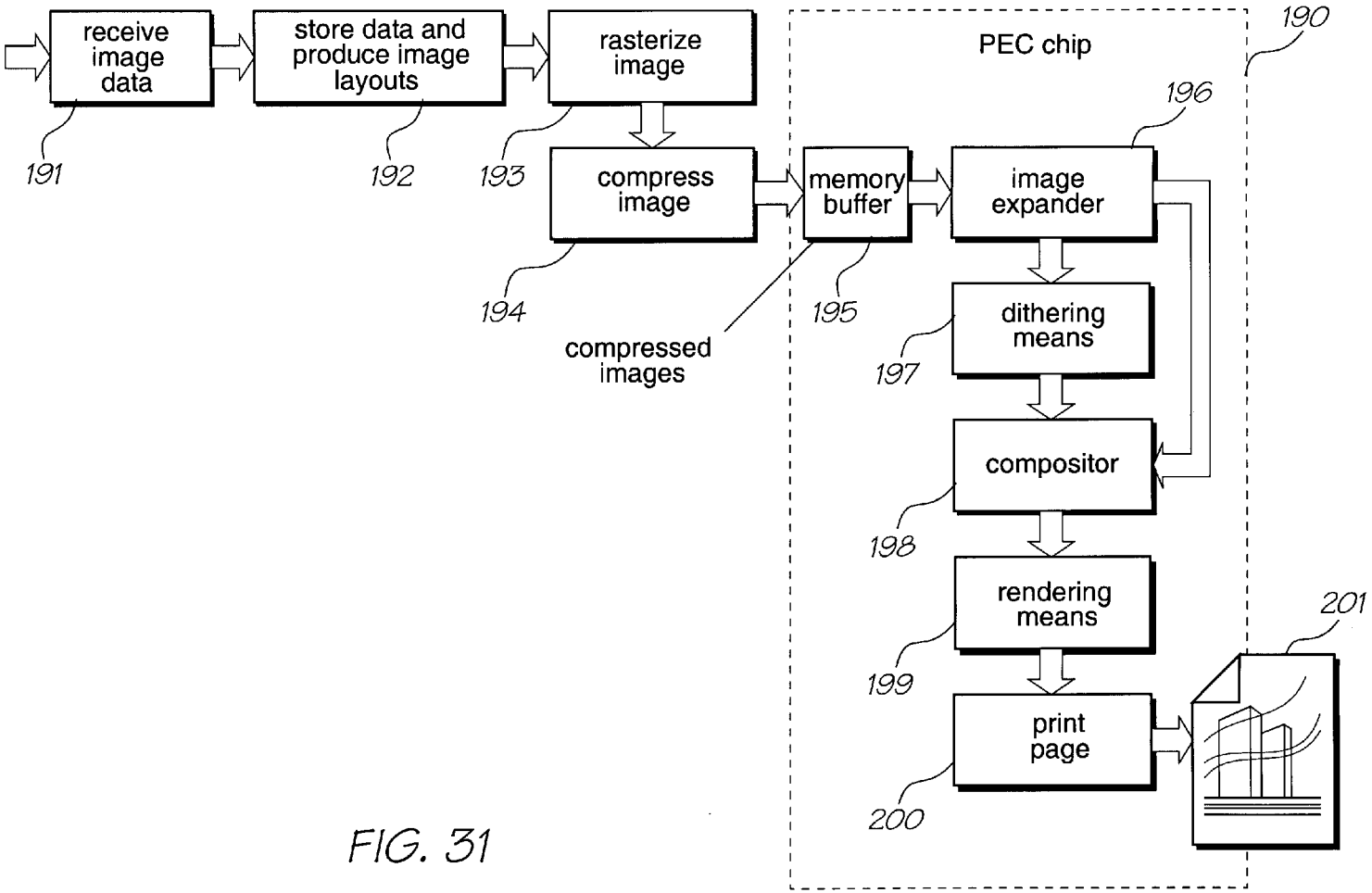
FIG. 31 illustrates data flow and functions performed by a print engine controller ("PEC") that forms one of the circuit components shown in FIG. 20.

As indicated in FIG. 31, images are supplied to the PEC integrated circuit 190 by a computer, which is programmed to perform the various processing steps 191 to 194 involved in printing an image prior to transmission to the PEC integrated circuit 190. These steps will typically involve receiving the image data (step 191) and storing this data in a memory buffer of the computer system (step 192) in which image layouts may be produced and any required objects may be added. Pages from the memory buffer are rasterized (step 193) and are then compressed (step 194) prior to transmission to the PEC integrated circuit 190. Upon receiving the image data, the PEC integrated circuit 190 processes the data so as to drive the integrated circuits of the printhead chips 26.

Due to the page-width form of the printhead assembly, each image should be printed at a constant speed to avoid creating visible artifacts. This means that the printing speed should be varied to match the input data rate. Document rasterization and document printing are therefore decoupled to ensure the printhead assembly has a constant supply of data. In this arrangement, an image is not printed until it is fully rasterized and, in order to achieve a high constant printing speed, a compressed version of each rasterized page image is stored in memory.

Because contone colour images are reproduced by stochastic dithering, but black text and line graphics are reproduced directly using dots, the compressed image format contains a separate foreground bi-level black layer and background contone colour layer. The black layer is composited over the contone layer after the contone layer is dithered. If required, a final layer of tags (in IR or black ink) is optionally added to the image for printout.

Dither matrix selection regions in the image description are rasterized to a contone-resolution bi-lev bitmap which is losslessly compressed to negligible size and which forms part of the compressed image. The IR layer of the printed page optionally contains encoded tags at a programmable density.

Each compressed image is transferred to the PEC integrated circuit 190 where it is then stored in a memory buffer 195. The compressed image is then retrieved and fed to an image expander 196 in which images are retrieved. If required, any dither may be applied to any contone layer by a dithering means 197 and any black bi-level layer may be composited over the contone layer by a compositor 198 together with any infrared tags which may be rendered by the rendering means 199. The PEC integrated circuit 190 then drives the integrated circuits of the printhead chips 26 to print the composite image data at step 200 to produce a printed image 201.

The process performed by the PEC integrated circuit 190 may be considered to consist of a number of distinct stages. The first stage has the ability to expand a JPEG-compressed contone CMYK layer. In parallel with this, bi-level IR tag data can be encoded from the compressed image. The second stage dithers the contone CMYK layer using a dither matrix selected by a dither matrix select map and, if required, composites a bi-level black layer over the resulting bi-level K layer and adds the IR layer to the image. A fixative layer is also generated at each dot position wherever there is a need in any of the C, M, Y, K, or IR channels. The last stage prints the bi-level CMYK+IR data through the printhead assembly 20.

Figure 32:
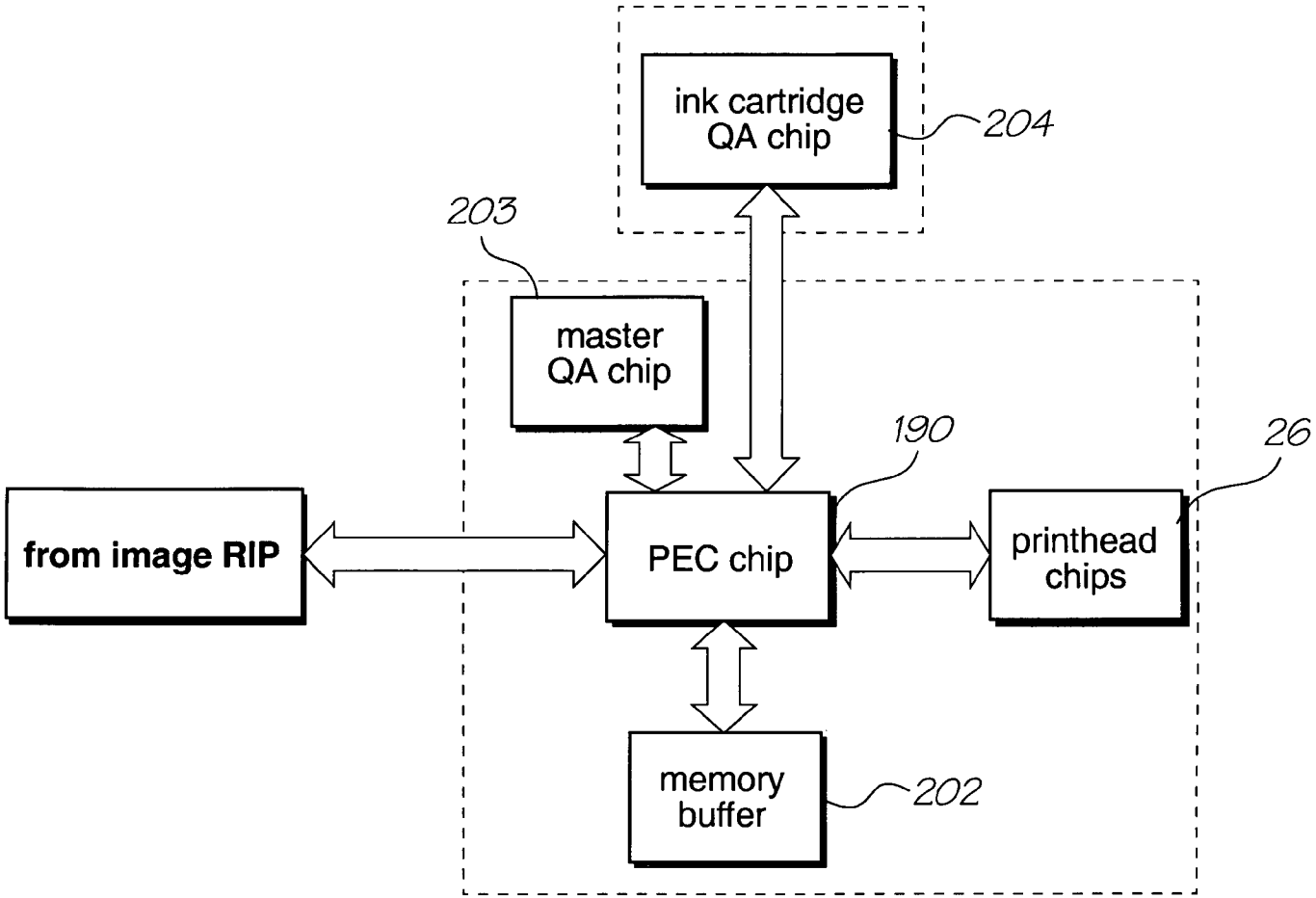
FIG. 32 illustrates the PEC of FIG. 31 in the context of an overall printing system architecture.
Figure 33:
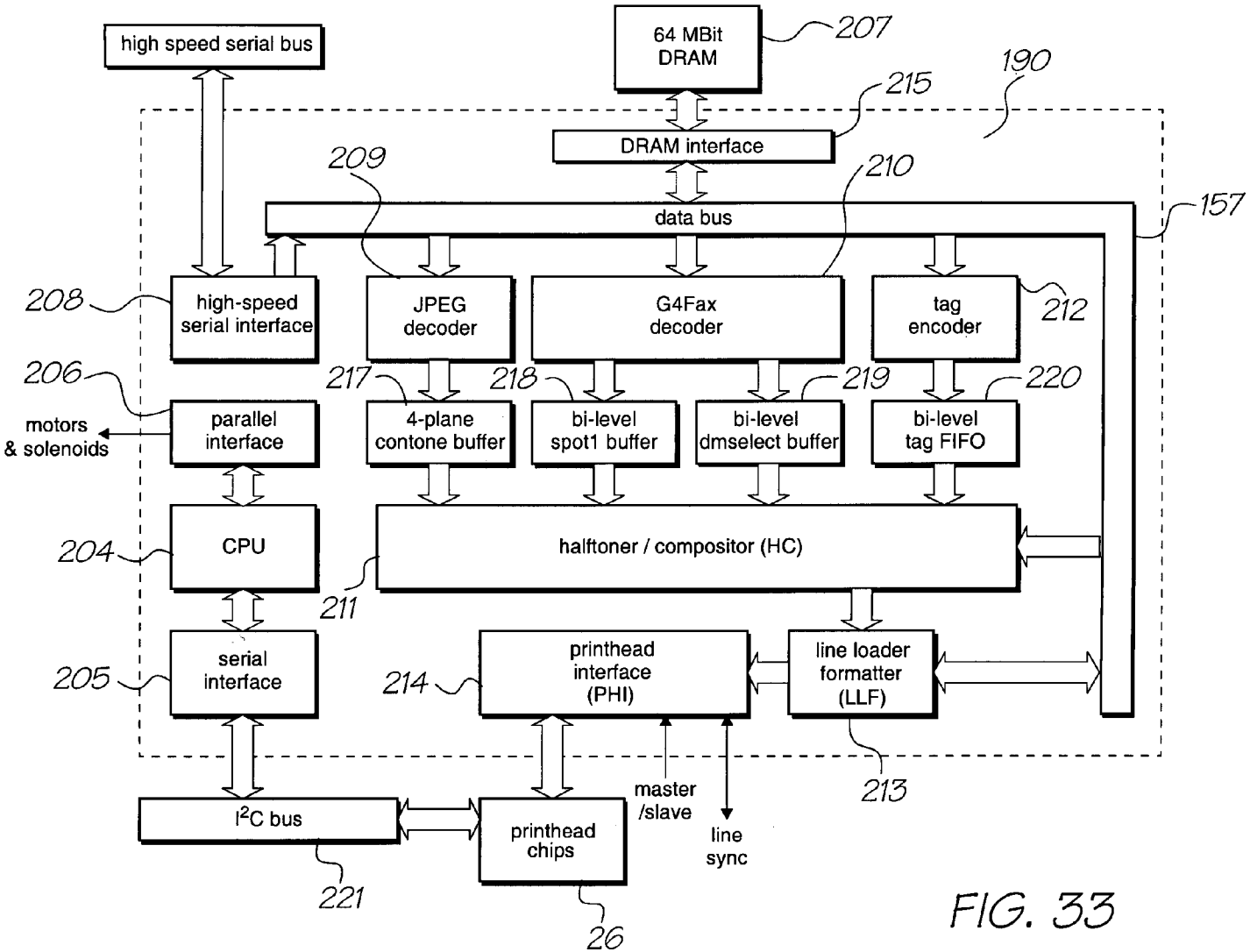
FIG. 33 illustrates the architecture of the PEC of FIG. 32.

FIG. 32 shows the PEC integrated circuit 190 in the context of the overall printing system architecture. The various components of the architecture include:

- The PEC integrated circuit 190 which is responsible for receiving the compressed page images for storage in a memory buffer 202, performing the page expansion, black layer compositing and sending the dot data to the printhead chips 26. The PEC integrated circuit 190 may also communicate with a master Quality Assurance (QA) integrated circuit 203 and with an ink cartridge Quality Assurance (QA) integrated circuit 204. The PEC integrated circuit 190 also provides a means of retrieving the printhead assembly characteristics to ensure optimum printing.
  - The memory buffer 202 for storing the compressed image and for scratch use during the printing of a given page. The construction and working of memory buffers is known to those skilled in the art and a range of standard integrated circuits and techniques for their use might be utilized.
  - The master integrated circuit 203 which is matched to the ink cartridge QA integrated circuit 204. The construction and working of QA integrated circuits is also known to those skilled in the art and a range of known QA processes might be utilized.

The PEC integrated circuit 190 effectively performs four basic levels of functionality:

- Receiving compressed pages via a serial interface such as an IEEE 1394.
- Acting as a print engine for producing an image from a compressed form. The print engine functionality includes expanding the image, dithering the contone layer, compositing the black layer over the contone layer, optionally adding infrared tags, and sending the resultant image to the integrated circuits of the printhead chips.
- Acting as a print controller for controlling the printhead chips 26 and the stepper motors 102, 108 and 111 of the printing system.
- Serving as two standard low-speed serial ports for communication with the two QA integrated circuits. In this regard, two ports are used, and not a single port, so as to ensure strong security during authentication procedures.

These functions are now described in more detail with reference to FIG. 33, which provides a more specific, exemplary illustration of the PEC integrated circuit architecture.

The PEC integrated circuit 190 incorporates a simple micro-controller CPU core 204 to perform the following functions:

- Perform QA integrated circuit authentication protocols via a serial interface 205 between print images.
- Run stepper motors of the printing system via a parallel interface 206 during printing to control delivery of the print media to the printer for printing.

Synchronize the various components of the PEC integrated circuit 190 during printing.

Provide a means of interfacing with external data requests (programming registers, etc).

Provide a means of interfacing with the printhead assemblies' low-speed data requests (such as reading characterization vectors and writing pulse profiles).

Provide a means of writing portrait and landscape tag structures to an external DRAM 207.

In order to perform the image expansion and printing process, the PEC integrated circuit 190 includes a high-speed serial interface 208 (such as a standard IEEE 1394 interface), a standard JPEG decoder 209, a standard Group 4 Fax decoder 210, a custom half-toner/compositor (HC) 211, a custom tag encoder 212, a line loader/formatter (LLF) 213, and a printhead interface 214 (PHI) which communicates with the printhead chips 26. The decoders 209 and 210 and the tag encoder 212 are buffered to the HC 211. The tag encoder 212 allocates infrared tags to images.

The print engine function works in a double-buffered manner. That is, one image is loaded into the external DRAM 207 via a DRAM interface 215 and a data bus 216 from the high-speed serial interface 208, while the previously loaded image is read from the DRAM 207 and passed through the print engine process. When the image has been printed, the image just loaded becomes the image being printed, and a new image is loaded via the high-speed serial interface 208.

At the aforementioned first stage, the process expands any JPEG-compressed contone (CMYK) layers, and expands any of two Group 4 Fax-compressed bi-level data streams. The two streams are the black layer and a matte for selecting between dither matrices for contone dithering. At the second stage, in parallel with the first, any tags are encoded for later rendering in either IR or black ink.

Finally, in the third stage the contone layer is dithered, and position tags and the bi-level spot layer are composited over the resulting bi-level dithered layer. The data stream is ideally adjusted to create smooth transitions across overlapping segments in the printhead assembly and ideally it is adjusted to compensate for dead nozzles in the printhead assemblies. Up to six channels of bi-level data are produced from this stage.

However, it will be understood that not all of the six channels need be activated. For example, the printhead modules 23 may provide for CMY only, with K pushed into the CMY channels and IR ignored. Alternatively, the position tags may be printed in K if IR ink is not employed. The resultant bi-level CMYK–IR dot-data is buffered and formatted for printing with the integrated circuits of the printhead chips 26 via a set of line buffers (not shown). The majority of these line buffers might be ideally stored on the external DRAM 207. In the final stage, the six channels of bi-level dot data are printed via the PHI 214.

The HC 211 combines the functions of half-toning the contone (typically CMYK) layer to a bi-level version of the same, and compositing the spot1 bi-level layer over the appropriate half-toned contone layer(s). If there is no K ink, the HC 211 functions to map K to CMY dots as appropriate. It also selects between two dither matrices on a pixel-by-pixel basis, based on the corresponding value in the dither matrix select map. The input to the HC 211 is an expanded contone layer (from the JPEG decoder 205) through a buffer 217, an expanded bi-level spot1 layer through a buffer 218, an expanded dither-matrix-select bitmap at typically the same resolution as the contone layer through a buffer 219, and tag data at full dot resolution through a buffer (FIFO) 220.

The HC 211 uses up to two dither matrices, read from the external DRAM 207. The output from the HC 211 to the LLF 213 is a set of printer resolution bi-level image lines in up to six colour planes. Typically, the contone layer is CMYK or CMY, and the bi-level spot1 layer is K. Once started, the HC 211 proceeds until it detects an "end-of-image" condition, or until it is explicitly stopped via a control register (not shown).

The LLF 213 receives dot information from the HC 211, loads the dots for a given print line into appropriate buffer storage (some on integrated circuit (not shown) and some in the external DRAM 207) and formats them into the order required for the integrated circuits of the printhead chips 26. More specifically, the input to the LLF 213 is a set of six 32-bit words and a Data Valid bit, all generated by the HC 211.

As previously described, the physical location of the nozzles 150 on the printhead chips is in two offset rows 151, which means that odd and even dots of the same colour are for two different lines. In addition, there is a number of lines between the dots of one colour and the dots of another. Since the six colour planes for the same dot position are calculated at one time by the HC 211, there is a need to delay the dot data for each of the colour planes until the same dot is positioned under the appropriate colour nozzle. The size of each buffer line depends on the width of the printhead assembly. A single PEC integrated circuit 190 may be employed to generate dots for up to 16 printhead chips 26 and, in such case, a single odd or even buffer line is therefore 16 sets of 640 dots, for a total of 10,240 bits (1280 bytes).

The PHI 214 is the means by which the PEC integrated circuit 190 loads the printhead chips 26 with the dots to be printed, and controls the actual dot printing process. It takes input from the LLF 213 and outputs data to the printhead chips 26. The PHI 214 is capable of dealing with a variety of printhead assembly lengths and formats.

A combined characterization vector of each printhead assembly 20 can be read back via the serial interface 205. The characterization vector may include dead nozzle information as well as relative printhead module alignment data. Each printhead module can be queried via a low-speed serial bus 221 to return a characterization vector of the printhead module.

The characterization vectors from multiple printhead modules can be combined to construct a nozzle defect list for the entire printhead assembly and allows the PEC integrated circuit 190 to compensate for defective nozzles during printing. As long as the number of defective nozzles is low, the compensation can produce results indistinguishable from those of a printhead assembly with no defective nozzles.

Some of the features of the complete pagewidth printhead 20 that incorporates the chips 26 and associated print engine controllers may be summarised as follows:

1. The printhead will normally have at least four color channels.

2. The printhead will normally incorporate at least 1400 ink delivery nozzles per inch of print width for each color.

3. The printhead may incorporate a total of at least 50,000 nozzles.

4. The dot printing processing rate and the drop deposition rate of the printhead may be of the order of $10^9$ $sec^{-1}$ or greater.

5. The volume deposited per drop may be of the order of $2\times10^{-12}$ 1 or less.

6. The energy level expenditure per drop ejection may be of the order of $200\times10^{-9}$ J. or less.

Figure 15:
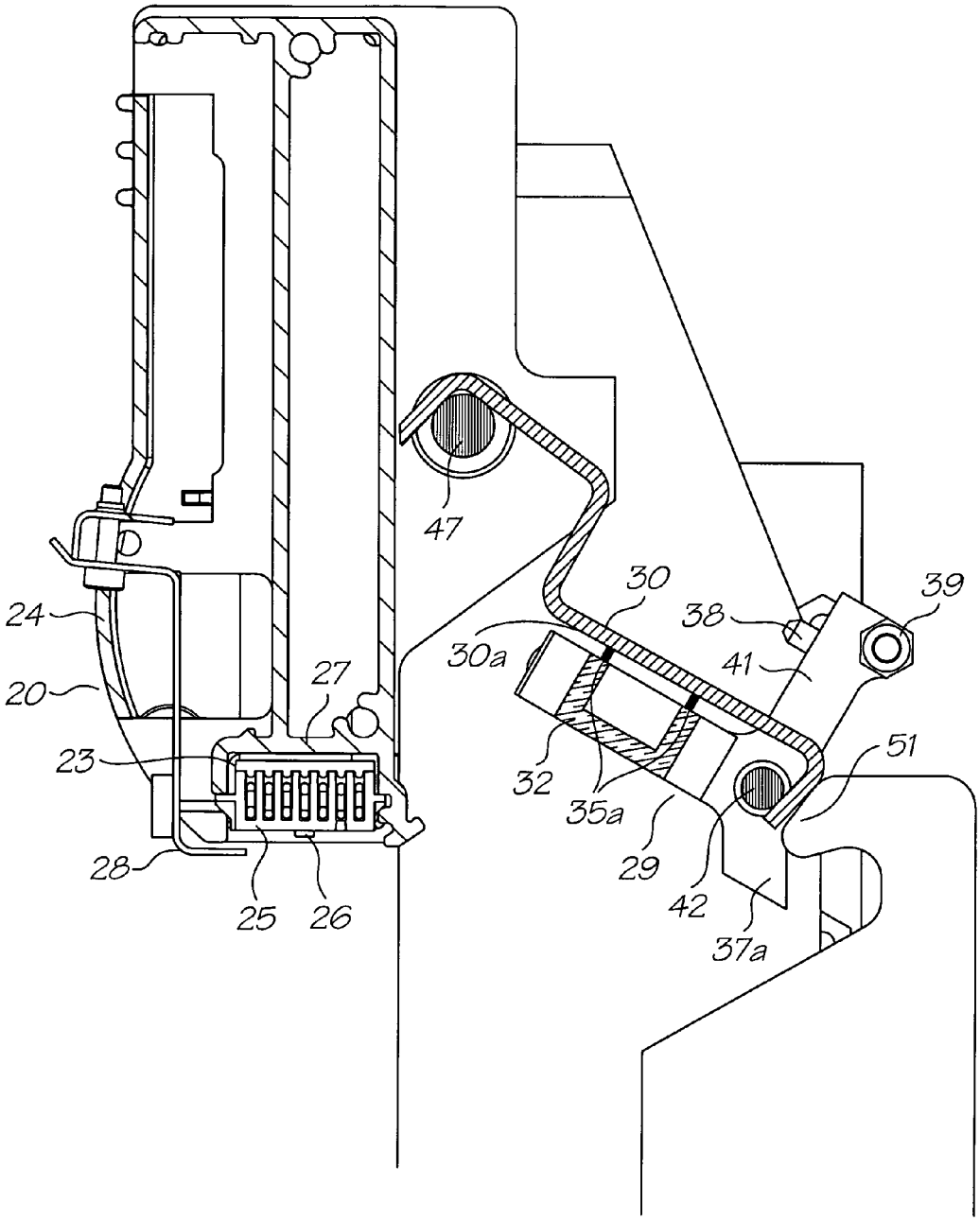
FIG. 15 shows a view similar to that of FIG. 14 but with the capping member moved to a parked position remote from the printhead.

The capping mechanism 21 comprises, in broad terms, a capping member 29, a carrier 30 supporting the capping member 29, and an actuating mechanism 31. The actuating mechanism 31 is arranged to effect movement of the carrier 30 back and forth between a first position (FIG. 15) at which the capping member is located remotely with respect to the printhead 20 and a second position (FIG. 12) at which the capping member 29 contacts the printhead 20. When in the first position, as shown in FIG. 15, the capping member is protected against loss of moisture and ingress of such contaminating material as paper dust, as hereinafter described in more detail.

Figure 9:
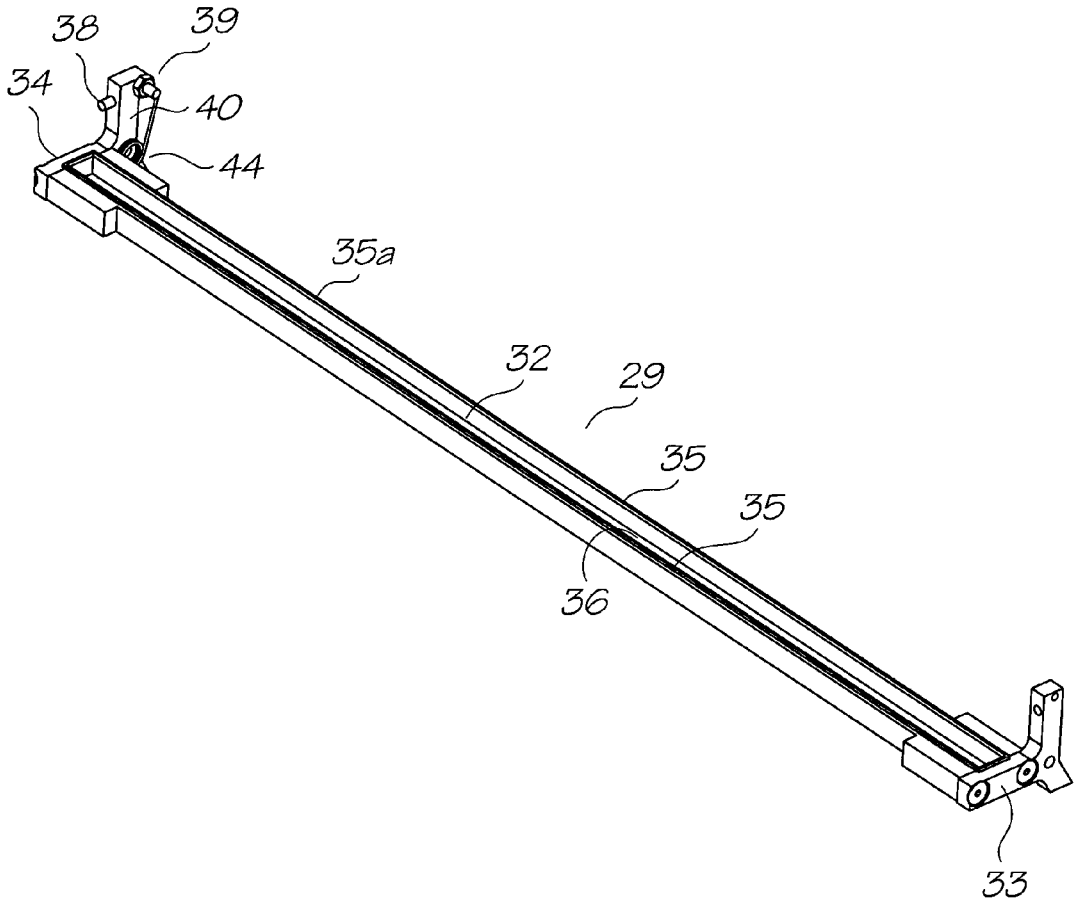
FIG. 9 shows a perspective view of a capping member removed from the capping mechanism of FIGS. 5 to 8, FIGS. 10 and 11 show elevation views of first and second end members respectively of the capping member.

The capping member 29 is shown removed from the mechanism in FIG. 9 and it comprises a capping element 32 which extends between and interconnects two end members 33 and 34. The capping element 32 comprises a channel-shaped element having thin-section side walls 35 separated by a recess 36 and it desirably is formed predominantly from a rigid material such as a metal (eg, aluminium) or a high density plastics material. Also, the capping element has a length which is sufficient to space the end members 33 and 34 apart by a distance that is greater than the width of the widest of print media to be moved past the printhead 20.

The upper surface of the walls 35 of the capping element may be provided with an elastomeric material lip 35*a* (see FIG. 15) to facilitate sealing of the printhead chips 26 and to facilitate closing and, thus, protection of the capping element when the capping member 29 is moved to its parked (ie, the first) position.

Figure 10:
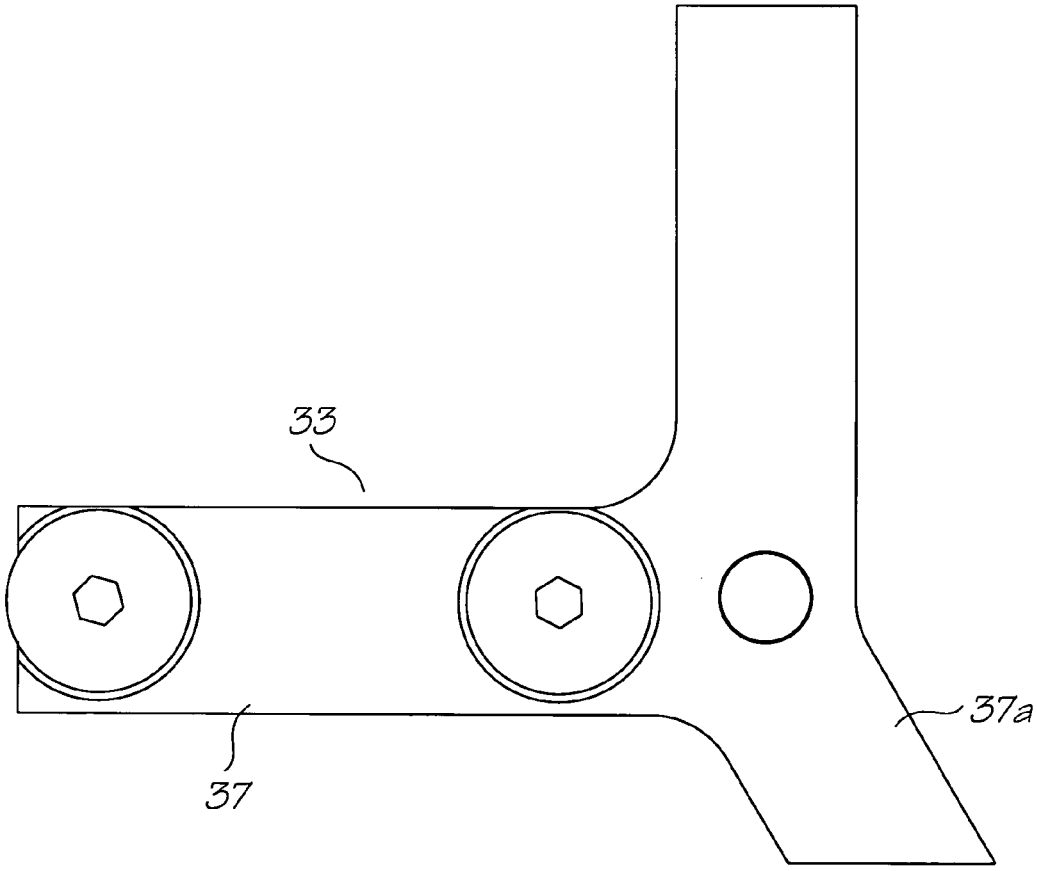
Figure 11:
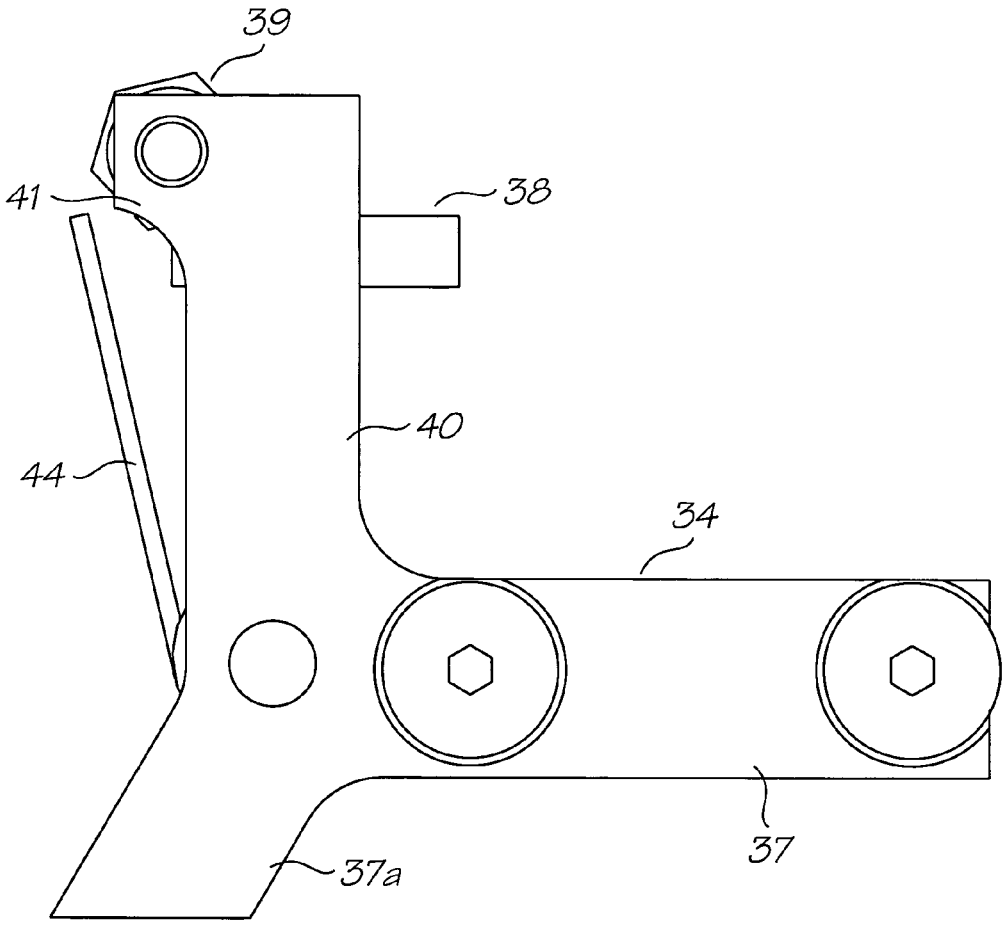

The right-hand end member 33 (as viewed in FIG. 9 and shown in FIG. 10) comprises a generally L-shaped member having one arm 37 to which the capping element 32 is connected and a further, truncated arm 37*a,* the function of which will hereinafter be described. The left-hand end member 34 is similar to the right-hand end member 33, having corresponding arms 37 and 37*a,* but (as shown in FIGS. 9 and 11) it carries first and second adjustable stop members 38 and 39 respectively on an arm 40 which includes a lateral projection 41. The functions of the stop members 38 and 39 will be described in more detail later with reference to FIGS. 12 to 14. At this stage it is sufficient to state that the first stop member 38 is positioned to engage with the casing 24 of the printhead 20 and the second stop member 39 is positioned to engage with the carrier 30.

Although not illustrated in the drawings, in an alternative embodiment of the invention the right-hand and left-hand members 33 and 34 might be constructed in the same way. That is, the first and second adjustable stop members 38 and 39 may be provided at both ends of the capping member 29, particularly in the case of a wide format printer.

Figure 8:
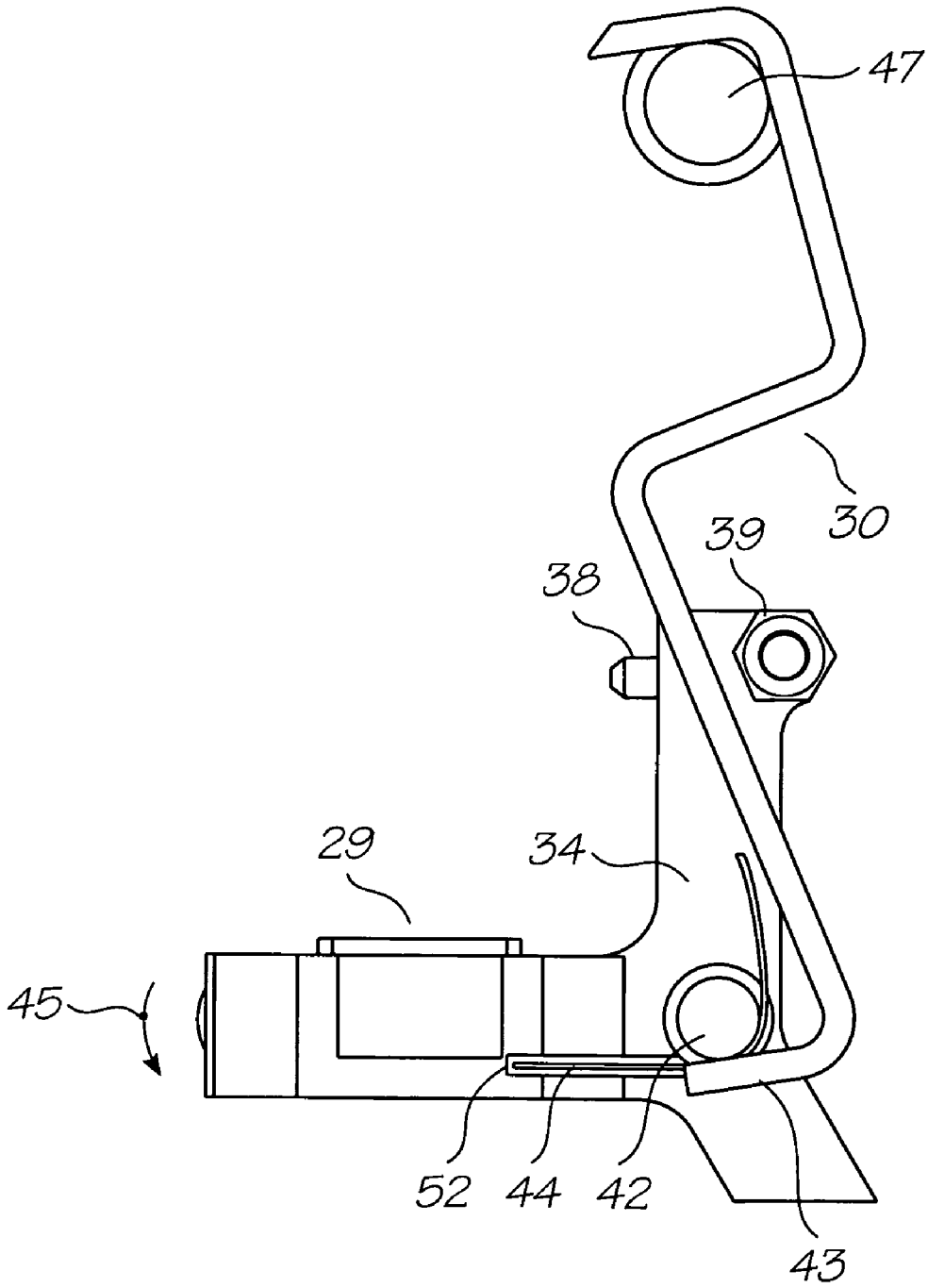
FIG. 8 shows a perspective view of the capping mechanism as seen in the direction of section plane 8-8 shown in FIG. 7

The complete capping member 29 is pivotally mounted to the carrier 30 by way of a pivot shaft 42 which extends along a marginal lower lip 43 of the carrier and which provides a common pivot axis for the two end members 33 and 34. A biasing device in the form of a torsion spring 44 is located about the pivot shaft 42 adjacent the inner face of the end member 34 and, when the capping member 29 is assembled to the carrier 30, the radial limbs of the spring 44 are loaded against the carrier 30 and the end plate 34 in a manner to bias the capping member 29 in the direction of arrow 45 as shown in FIG. 8. For this purpose one of the radial arms of the spring locates in a channel 52 within the end member 34.

The carrier 30 has a length which is marginally smaller than the distance between the end members 33 and 34, as can best be seen from FIG. 1, and the carrier is pivotally mounted to end plates 46 which are indirectly mounted to the printhead 20. The carrier is supported between the end plates 46 by axially aligned pivot pins 47, one of which is connected to the actuating mechanism 31.

Thus, the carrier 30 is pivotal about a first pivot axis that is located parallel to but spaced from a second pivot axis about which the capping member 29 is pivotally mounted to the carrier. For reasons which will be explained later, the spacing between the first and second pivot axes is large relative to the radial displacement of the capping element 32 from the second pivot axis, typically three times the radial displacement.

The actuating mechanism 31 might take various forms but, as illustrated, it comprises an electric stepping motor 48 coupled by way of a crank 49 and a motion translating arrangement 50 to one of the pivot pins 47. In operation of the capping mechanism, energisation and partial rotation of the motor 48 causes pivotal movement to be imparted to the motion translating mechanism 50 and, consequently to the pivot pins 47 and the carrier 30. This results in movement of the carrier from the first (remote) position shown in FIG. 15 to the second (capping) position shown in FIG. 12. Continuing rotation, or subsequent partial rotation, of the motor 48 then causes pivoting of the motion translating mechanism 50 and the carrier 30 in the reverse direction, and consequential movement of the carrier from the second position, as shown in FIG. 12, to the first position as shown in FIG. 15.

The operation of the capping mechanism and the protection of that mechanism will now be described with reference to FIGS. 12 to 15.

Figure 12:
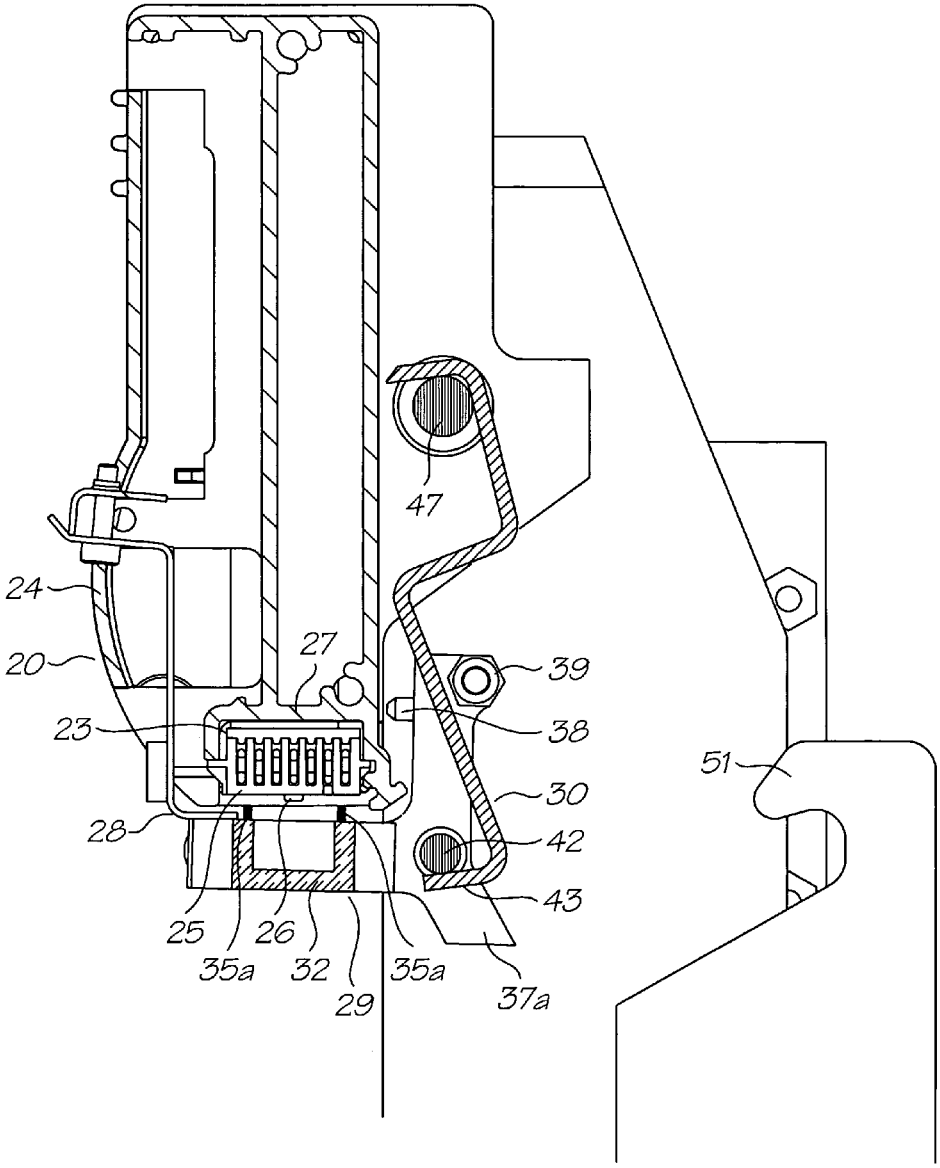
FIG. 12 shows an end view of a portion of the assembly of FIGS. 1 to 4, as viewed in the direction of section plane 12-12 shown in FIG. 4, with the capping member located in a nozzle capping position.

FIG. 12 shows the capping mechanism 21 in the second position, with the capping member 29 in nozzle capping engagement with the printhead 20. In this position the capping element 32 is located immediately below the printhead chips 26 and is able to receive fluid that is purged from the chips. Purging may be effected to clear any unwanted material from the chips' nozzles and/or to establish a humid atmosphere in the environment of the capped nozzles. To assist in this latter function the capping element 32 may be coated or be lined with a hydrophilic material. In a possible alternative arrangement, in which a suction system (not shown) is connected with the capping member for extracting purged material, the capping element 32 may be coated or be lined with a hydrophobic material.

Two significant features are to be observed in the arrangement shown in FIG. 12:

1. The first stop member 38 is located in contact with the casing of the printhead 20, and 2. The second stop member 39 is spaced a small distance from the carrier 30.

At the completion of a capping operation, when printing is to commence or resume, counter-clockwise pivoting motion is imparted to the carrier 30 by the actuating mechanism 31. This results progressively in movement of the capping mechanism from the second (nozzle capping) position shown in FIG. 12 to the first (remote) position shown in FIG. 15.

Figure 13:
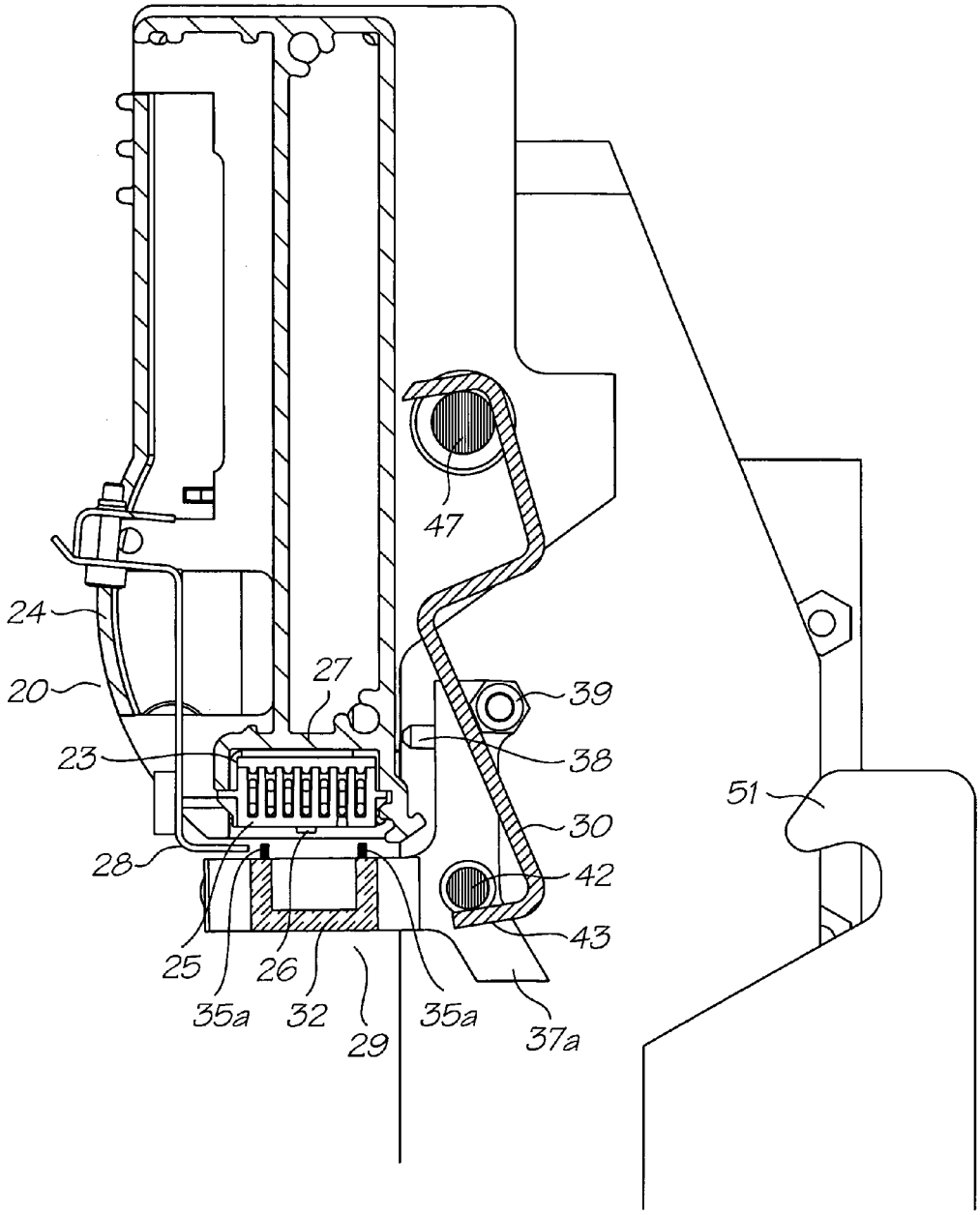
FIG. 13 shows a view similar to that of FIG. 12 but following an initial movement of the capping member away from the nozzle capping position.

During an initial, transitional movement of the carrier 30 to a transition position (intermediate the first and second positions), as shown in FIG. 13, the torsion spring 44 causes the capping member 29 to pivot in a counter-clockwise direction relative to the carrier 30 until such time as the carrier contacts the second stop member 39. This relative pivotal movement of the capping member 29 causes the capping element 32 to move in a direction that is approximately normal to the confronting face of the printhead, due to the small radial dimension of the capping member relative to the radial dimension of the carrier as determined by the spacing between the first and second pivot axes as previously identified.

When the carrier 30 contacts the second stop member 39, further rotation of the capping member 29 relative to the carrier is precluded and the capping member is carried by the carrier toward the first position as shown in FIG. 15.

Figure 14:
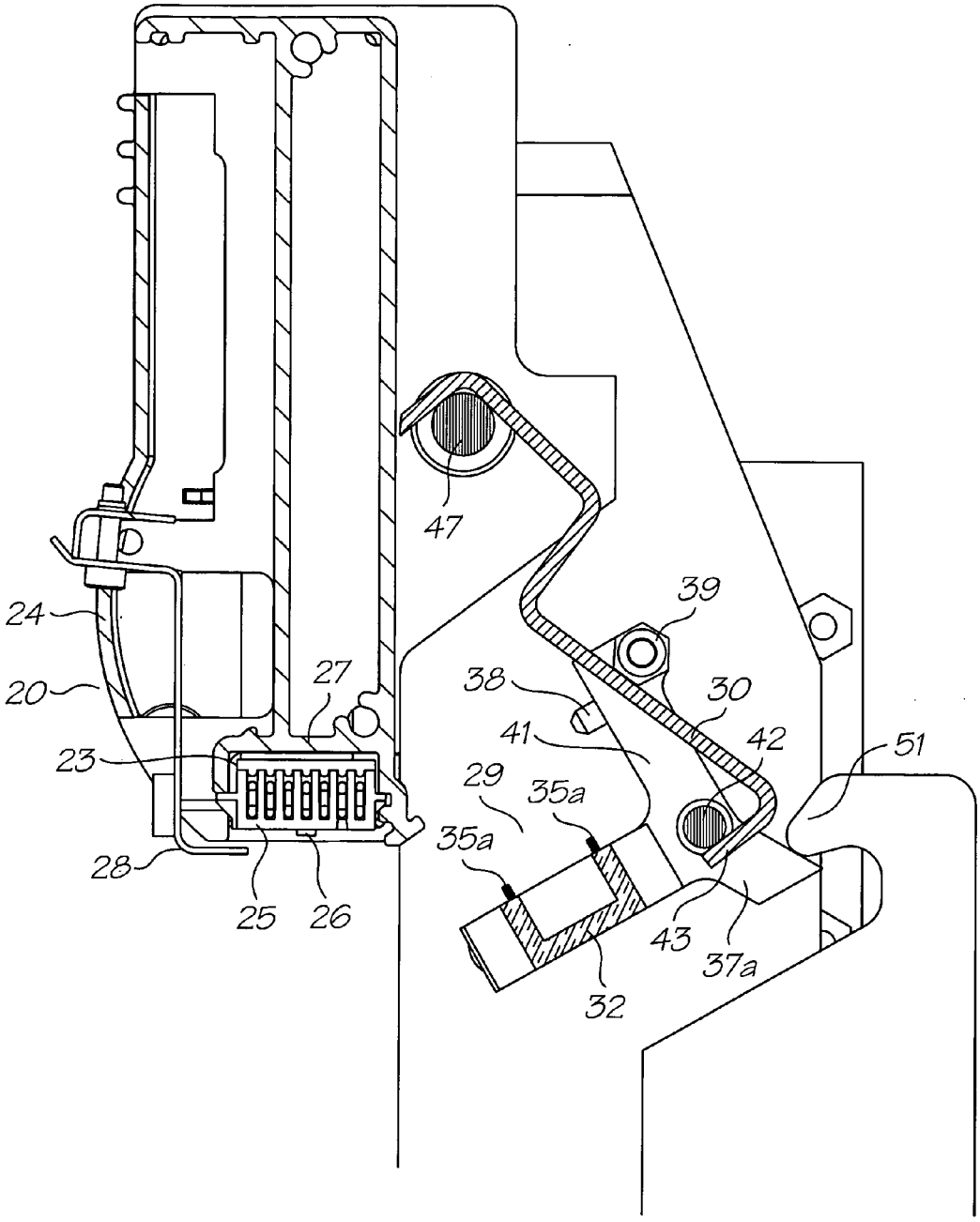
FIG. 14 shows a view similar to that of FIG. 13 but following progressively further movement of the capping member away from the nozzle capping position.

Shortly before reaching the first position and as shown in FIG. 14, the truncated arms 37*a* of the end members 33 and 34 of the capping member 29 are carried into contact with spaced-apart deflecting abutments 51. This contact causes rotation of the capping member 29 in a clockwise direction relative to the carrier 30 and serves to park the capping member in the first position where it is located away from the path followed by print media during a printing operation. Being aligned with the end members 33 and 34 of the capping mechanism, the abutments 51 are located laterally to the side of the print media path.

When parked in the first position, as shown in FIG. 15, the elastomeric lip 35*a* of the capping element 35 is engaged with a flat face portion 30*a* of the carrier 30. That is, the carrier itself functions as a covering member for the capping element. In this way the recess 36 of the capping element 35 is effectively sealed (ie, protected) against ingress of dust and other contaminants, and moisture that is present in the recess will be preserved for use in a subsequent capping operation. This is desirable in terms of capping the printhead chips 26 in a manner to prevent drying-out of the printhead nozzles.

As can be seen from FIGS. 12 and 13, the transitional movement of the carrier 30 from the second position to the transition position (or, in reverse, from the transition position to the second position) is small relative to the total pivotal movement of the carrier between the first and second positions. The ratio of the (angular) transitional movement to the total pivotal movement is within the range of 1:12 to 1:20.

When a capping operation is to be performed, the movements as above described are reversed. Thus, the actuating mechanism 31 is energised to cause pivoting of the carrier 30 from the first position as shown in FIG. 15 to the second position as shown in FIG. 12.

In moving toward the second position, the capping member 29 remains stationary relative to the carrier 30 (with the carrier contacting the second stop member 39), until reaching the transition position as shown in FIG. 13. Having reached that position, the first stop member 38 is brought into contact with the casing 24 of the printhead 20 and further movement of the capping member 29 about the carrier axis 47 is precluded. Then, as pivotal, transitional movement of the carrier continues toward the second position, the capping member 29 is caused to pivot in a clockwise direction relative to the carrier 30 and against the biasing force of the spring 44 until such time as the capping element 32 contacts the printhead 20 in nozzle capping engagement. Here again this relative pivotal movement of the capping member 29 causes the capping element 32 to move in a direction that is approximately normal to the confronting face of the printhead during the transitional movement of the carrier 30.

In moving against the biasing force of the spring 44, the force with which the capping member 29 contacts the surface of the printhead 20 is damped. This has the effect of minimising the risk of damage to the printhead chips 26 and of reducing the potential for any ink-loss from the nozzles that might otherwise result from a sudden impact on the surface of the printhead.

It will be appreciated from the foregoing description that the capping mechanism provides effectively for two-stage capping and uncapping. During the capping operation, one stage occurs during movement of the capping mechanism between the first position and the transition position and the second stage occurs during the transitional movement of the capping mechanism between the transition position and the second position. During the uncapping operation, one stage occurs during the transitional movement of the capping mechanism between the second position and the transition position, and the second stage occurs during movement of the capping mechanism between the transition position and the first position.

Variations and modifications may be made in the embodiment of the invention as above described, for exemplification purposes, without departing from the spirit and scope of the invention as defined in the appended claims.

The invention claimed is:

1. A protector for a capping facility in the form of a capping mechanism for a pagewidth printhead having a plurality of nozzles located along the printhead, and wherein:

a) the capping mechanism comprises:

i) a capping member which has a length corresponding substantially to that of the printhead and which is configured to contact the printhead in nozzle capping engagement, ii) a carrier supporting the capping member, and iii) an actuating mechanism arranged to effect movement of the carrier back and forth between a first position at which the capping member is located remotely with respect to the printhead and a second position at which the capping member is located in contact with the printhead;

b) the capping member is pivotally mounted to the carrier and is arranged to pivot relative to the carrier during back and forth transitional movement of the carrier between a transition position and the second position, where the transition position is located intermediate the first and second positions; and c) the protector comprises a covering member which is arranged to be engaged by the capping member when the capping member is located in the first position.

2. The protector as claimed in claim 1 wherein the covering member is constituted by the carrier.

3. The protector as claimed in claim 2 wherein the actuating mechanism is arranged to move the carrier pivotally between the first and second positions during a capping operation.

4. The protector as claimed in claim 2 wherein the carrier is pivotally mounted to a support by way of a pivotal element having a first pivot axis, and the capping member is pivotally mounted to the carrier by way of a pivoting arrangement having a second pivot axis that is located parallel to and spaced from the first pivot axis.

5. The protector as claimed in claim 4 wherein the capping member has a capping element that is radially displaced from the second pivot axis, and the radial displacement of the capping element from the second pivot axis is small relative to the spacing between the first and second pivot axes.

6. The protector as claimed in claim 5 wherein the spacing between the first and second pivot axes is of the order of three times the radial displacement of the capping element from the second pivot axis.

7. The protector as claimed in claim 5 wherein the capping element comprises a substantially rigid channel-shaped element.

8. The protector as claimed in claim 5 wherein the capping element incorporates a lip which is formed from an elastomeric material.

9. The protector as claimed in claim 8 wherein the capping element is arranged to engage with a face portion of the carrier when the carrier is located in the first position whereby a recessed portion of the capping element is effectively closed against loss of contained moisture and ingress of contaminating material.

10. The protector as claimed in claim 5 wherein the capping element incorporates a lip which is formed from an elastomeric material, wherein the lip is configured to locate about the printhead nozzles when the capping member is in the second position, and wherein the lip is arranged to engage with a face portion of the carrier when the carrier is located in the first position whereby a recessed portion of the capping element is effectively closed against loss of contained moisture and ingress of contaminating material.

11. The protector as claimed in claim 2 wherein the transition position is located a distance from the second position which is small relative to the distance between the first and second positions.

12. The protector as claimed in claim 11 wherein a ratio of the transitional pivotal movement of the carrier to a total pivotal movement of the carrier between the first and second positions is within the range 1:12 to 1:20.

13. The protector as claimed in claim 2 wherein the capping member is provided with at least one first stop member that is arranged to contact the printhead and thereby to effect pivoting of the capping member relative to the carrier as the carrier makes the transitional movement from the transition position to the second position.

14. The protector as claimed in claim 2 wherein the capping member is provided with at least one second stop member that is arranged to contact the carrier and thereby prevent pivoting of the capping member relative to the carrier as the carrier moves from the transition position to the first position.

15. The protector as claimed in claim 2 wherein the capping member is pivotally mounted to the carrier by a pivot shaft which extends along a marginal edge portion of the carrier.

16. The protector as claimed in claim 2 wherein a biasing device is mounted to the capping member and engages the carrier in a manner to bias the capping member in a direction away from nozzle capping engagement with the printhead.

17. The protector as claimed in claim 16 wherein the biasing device comprises a torsion spring.

18. The protector as claimed in claim 2 wherein the actuating mechanism comprises an electric motor which is coupled to the carrier and arranged to impart pivotal motion to the carrier by way of a crank and a motion translating mechanism.

19. The protector as claimed in claim 2 wherein at least one abutment is located adjacent the printhead and is operable to effect pivoting of the capping member when the carrier approaches the first position, whereby the capping member is moved away from a print media feed path.

* * * * *